US011141985B2

(12) United States Patent
Ishizawa et al.

(10) Patent No.: US 11,141,985 B2
(45) Date of Patent: Oct. 12, 2021

(54) LIQUID SUPPLY UNIT

(71) Applicant: Seiko Epson Corporation, Tokyo (JP)

(72) Inventors: Taku Ishizawa, Matsumoto (JP); Satoshi Shinada, Shiojiri (JP); Yoshiaki Shimizu, Matsumoto (JP); Noriyuki Fukasawa, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/712,616

(22) Filed: Dec. 12, 2019

(65) Prior Publication Data

US 2020/0114651 A1 Apr. 16, 2020

Related U.S. Application Data

(63) Continuation of application No. 16/066,012, filed as application No. PCT/JP2016/084211 on Nov. 18, 2016, now Pat. No. 10,543,692.

(30) Foreign Application Priority Data

Dec. 28, 2015 (JP) ..... JP2015-256025

(51) Int. Cl.

| | |
|---|---|
| ***B41J 2/175*** | (2006.01) |
| ***B41J 2/14*** | (2006.01) |
| *B41J 2/13* | (2006.01) |

(52) U.S. Cl.

CPC ..... *B41J 2/1752* (2013.01); *B41J 2/14* (2013.01); *B41J 2/175* (2013.01); *B41J 2/1753* (2013.01);

(Continued)

(58) Field of Classification Search

CPC ..... B41J 2/13; B41J 2/14; B41J 2/175; B41J 2/1752; B41J 2/17523; B41J 2/17526;

(Continued)

(56) References Cited

U.S. PATENT DOCUMENTS 5,448,274 A 9/1995 Hirabayashi et al.
5,534,899 A * 7/1996 Uchikata ..... B41J 2/17513 347/49

(Continued)

FOREIGN PATENT DOCUMENTS

GN 104972762 A 10/2015
JP H02-198862 A 8/1990

(Continued)

OTHER PUBLICATIONS

International Search Report dated Feb. 14, 2017 in PCT/JP2016/084211 with English-language translation (4 pgs.).

*Primary Examiner* — Anh T Vo
(74) *Attorney, Agent, or Firm* — Oliff PLC

(57) ABSTRACT

A liquid supply unit includes an outer shell, a liquid supply portion that is arranged in the outer shell and can supply a liquid to the liquid ejection apparatus, and an engaged structure including an engaged portion that can engage with the engagement portion of the liquid ejection apparatus, and a first opening that is formed in the outer shell and through which the engagement structure can be inserted. The engaged portion is arranged further inward than an outer surface of the outer shell.

12 Claims, 37 Drawing Sheets

(52) U.S. Cl.
CPC ..... *B41J 2/17523* (2013.01); *B41J 2/17553* (2013.01); *B41J 2/13* (2013.01); *B41J 2/17526* (2013.01); *B41J 2/17546* (2013.01); *B41J 2002/17516* (2013.01)

(58) Field of Classification Search
CPC .. B41J 2/1753; B41J 2/17546; B41J 2/17553; B41J 2002/17516
See application file for complete search history.

(56) References Cited

U.S. PATENT DOCUMENTS

| | | | | |
|---|---|---|---|---|
| 6,196,670 | B1 | 3/2001 | Saruta | |
| 6,312,105 | B1 * | 11/2001 | Miyauchi | B41J 2/17513 347/49 |
| 6,511,167 | B1 | 1/2003 | Kitabatake et al. | |
| 6,719,415 | B1 * | 4/2004 | Hattori | B41J 2/17503 347/86 |
| 7,018,027 | B2 | 3/2006 | Harada et al. | |
| 7,258,431 | B2 | 8/2007 | Shinada et al. | |
| 7,293,864 | B2 | 11/2007 | Kimura et al. | |
| 7,438,401 | B2 | 10/2008 | Seino et al. | |
| 7,806,523 | B2 | 10/2010 | Seino et al. | |
| 7,954,935 | B2 | 6/2011 | Kimura et al. | |
| 8,177,340 | B2 * | 5/2012 | Harazim | B41J 2/1752 347/86 |
| 8,297,738 | B1 | 10/2012 | Kodama et al. | |
| 8,439,482 | B1 | 5/2013 | Kodama et al. | |
| 8,708,469 | B2 | 4/2014 | Kodama et al. | |
| 8,721,045 | B2 | 5/2014 | Kodama et al. | |
| 8,752,944 | B2 | 6/2014 | Nozawa et al. | |
| 8,807,721 | B2 | 8/2014 | Nozawa et al. | |
| 8,915,582 | B2 | 12/2014 | Kodama et al. | |
| 8,974,044 | B2 | 3/2015 | Kodama et al. | |
| 8,985,743 | B2 | 3/2015 | Sasaki | |
| 9,039,153 | B2 | 5/2015 | Matsuzaki et al. | |
| 9,039,154 | B2 | 5/2015 | Kodama et al. | |
| 9,205,661 | B2 | 12/2015 | Kawate | |
| 9,248,656 | B2 | 2/2016 | Nozawa et al. | |
| 9,340,029 | B2 | 5/2016 | Naito et al. | |
| 2002/0085075 | A1 | 7/2002 | Shinada et al. | |
| 2005/0036015 | A1 | 2/2005 | Seino et al. | |
| 2005/0052511 | A1 | 3/2005 | Seino et al. | |
| 2006/0170742 | A1 | 8/2006 | Inoue et al. | |
| 2015/0077486 | A1 | 3/2015 | Kodama et al. | |
| 2015/0290945 | A1 | 10/2015 | Naito et al. | |
| 2016/0129696 | A1 | 5/2016 | Nozawa et al. | |

FOREIGN PATENT DOCUMENTS

| | | | |
|---|---|---|---|
| JP | 2002-254673 | A | 9/2002 |
| JP | 2005-059317 | A | 3/2005 |
| JP | 2005-343146 | A | 12/2005 |
| JP | 2013-248779 | A | 12/2013 |
| JP | 2014-117836 | A | 6/2014 |
| JP | 2015-027805 | A | 2/2015 |

* cited by examiner

CROSS-SECTIONAL DIAGRAM ALONG F2-F2

LIQUID SUPPLY UNIT

CROSS REFERENCE TO RELATED APPLICATIONS

This application a continuation of U.S. application Ser. No. 16/066,012, filed Jun. 25, 2018; which is a National Stage Entry of PCT/JP2016/084211, filed Nov. 18, 2016; which claims priority to Japanese Appl. No. 2015-256025 filed Dec. 28, 2015; the disclosures of both of which are incorporated by reference herein in their entirety.

TECHNICAL FIELD

The present invention relates to a technology for a liquid supply unit.

BACKGROUND ART

Up until now, there has been known an ink cartridge that can be mounted onto a holder of a printer (see, for example, Patent Literature 1).

PRIOR ART DOCUMENTS

Patent Literature

[Patent Literature 1] JP 2013-248779 A

SUMMARY

Technical Problem

A conventional ink cartridge includes an ink supply port that can supply ink to a printer, and a lever that is provided on a side surface of the ink cartridge and can engage with a concave portion of a holder.

With this conventional ink cartridge, there have been demands to increase the reliability of mounting the ink cartridge onto the printer. Such a demand is not limited to an ink cartridge that can be mounted onto a printer and also applies to a liquid supply unit for other types of liquid ejection apparatus. Existing technology is also required to be smaller, have lower cost, use less resources, be easier to manufacture, and be easier to use.

Solution to Problem

The present invention has been made in order to at least partly solve the above-described problems and may be implemented as the following aspects or application examples.

(1) According to one aspect of the present invention, there is provided a liquid supply unit that includes an engagement structure having an engagement portion and that can be mounted onto a liquid ejection apparatus. This liquid supply unit includes: an outer shell; a liquid supply portion that is arranged in the outer shell and can supply a liquid to the liquid ejection apparatus; and an engaged structure including an engaged portion that can engage with the engagement portion of the liquid ejection apparatus, and a first opening that is formed in the outer shell and through which the engagement structure can be inserted, the engaged portion being arranged further inward than an outer surface of the outer shell.

According to this aspect, because the engaged portion is formed further inward than the outer surface of the outer shell, the liquid supply unit can be made smaller compared to a case in which the engaged portion is formed further outward than the outer surface of the outer shell. In addition, because the engaged portion is formed inside the outer shell, the possibility of foreign matter such as dirt adhering to the engaged portion or the vicinity thereof can be reduced. With this configuration, the engaged portion and the engagement portion can precisely engage with each other, and hence the liquid supply unit can be mounted more reliably.

(2) In the above-described aspect, in the liquid supply unit, the engaged structure may further include a second opening open toward a direction different from a direction in which the first opening is open.

According to this aspect, because the engaged structure includes the second opening in addition to the first opening, even in a case in which foreign matter such as dirt has entered the engaged structure, the foreign matter can be easily expelled to the outside of the engaged structure.

(3) In the above-described aspect, the engaged structure may further include a third opening open toward a direction different from a direction in which the first opening is open and a direction in which the second opening is open.

According to this aspect, because the engaged structure further includes the third opening, foreign matter than has entered the engaged structure can be easily expelled to the outside of the engaged structure.

(4) In the above-described aspect, the liquid supply unit may further include a unit-side operation unit that is operated in order to release engagement between the engaged portion and the engagement portion.

According to this aspect, engagement between the engaged portion and the engagement portion can be easily released by operating the unit-side operation unit.

(5) In the above-described aspect, in a process of mounting the liquid supply unit onto the liquid ejection apparatus, the engaged portion may be able to move by coming into contact with the engagement structure.

According to this aspect, the engaged portion can be easily moved.

(6) In the above-described aspect, the engaged portion may be formed by a protrusion that can engage with the engagement portion that is a concave portion or an opening.

According to this aspect, the engaged portion can be formed with a simple structure.

(7) In the above-described aspect, the engaged portion may be formed by a concave portion or an opening that can engage with the engagement portion which is a protrusion.

According to this aspect, the engaged portion can be formed with a simple structure.

(8) In the above-described aspect, the liquid ejection apparatus may include a holder unit that is provided with the engagement structure and onto which the liquid supply unit can be mounted, and the unit-side operation unit may be arranged at a position exposed from the holder unit in a mounted state in which the liquid supply unit is mounted onto the liquid ejection apparatus.

According to this aspect, the user can easily operate the unit-side operation unit.

(9) In the above-described aspect, the unit-side operation unit may be arranged at a position of the outer shell closer to a rear end portion, which opposes a tip end portion and is located closer to a demounting direction opposite to a mounting direction of mounting the liquid supply unit onto the liquid ejection apparatus, than the tip end portion in the mounting direction.

According to this aspect, the user can more easily operate the unit-side operation unit.

(10) In the above-described aspect, a part of the outer shell may be configured to move by the unit-side operation unit being operated, and the engaged portion may be connected to the moveable part of the outer shell so as to move in conjunction with the motion of the moveable part of the outer shell.

According to this aspect, the engaged portion can easily be moved.

(11) In the above-described aspect, in the outer shell, the unit-side operation unit may be arranged closer to a rear end portion, which opposes a tip end portion and is located closer to a demounting direction opposite to a mounting direction of mounting the liquid supply unit onto the liquid ejection apparatus, than the tip end portion in the mounting direction.

According to this aspect, the user can more easily operate the unit-side operation unit.

(12) In the above-described aspect, the engagement structure may further include an apparatus-side operation unit that can move the engagement portion by being operated, and engagement between the engaged portion and the engagement portion may be released as a result of the engagement portion moving.

According to this aspect, the engagement between the engaged portion and the engagement portion can be easily released.

(13) In the above-described aspect, the liquid supply unit may further include a contact portion that can electronically connect to an electrode portion including the liquid ejection apparatus by making contact with the electrode portion, in which, in a first direction orthogonal to a mounting direction of mounting the liquid supply unit onto the liquid ejection apparatus, the liquid supply portion, the contact portion, and a position of engagement between the engagement portion and the engaged portion are arranged on one side, and the position of engagement is located between the liquid supply portion and the contact portion.

According to this aspect, contact between the contact portion and the electrode portion can be favorably maintained in the first direction compared to a case in which the position of engagement is not located between the liquid supply portion and the contact portion.

(14) In the above-described aspect, the outer shell may include: a first wall portion provided with the liquid supply portion and the first opening; a second wall portion that opposes the first wall portion; a third wall portion that intersects with the first wall portion and the second wall portion; a fourth wall portion that intersects with the first wall portion and the second wall portion and that opposes the third wall portion; a fifth wall portion that intersects with the first wall portion, the second wall portion, the third wall portion and the fourth wall portion; and a sixth wall portion that intersects with the first wall portion, the second wall portion, the third wall portion and the fourth wall portion and that opposes the fifth wall portion.

According to this aspect, a liquid supply unit having the first to sixth wall portions can be provided.

(15) In the above-described aspect, a distance between the third wall portion and the fourth wall portion may be longer than a distance between the fifth wall portion and the sixth wall portion.

According to this aspect, there can be provided a liquid supply unit in which the distance between the third wall portion and the fourth wall portion is longer than the distance between the fifth wall portion and the sixth wall portion.

For example, in one aspect of the present invention, the present invention can also be implemented as an apparatus including one or more of a plurality of elements such as the outer shell, the liquid supply portion and the engaged structure. In other words, this apparatus may or may not include the outer shell. In addition, this apparatus may or may not include the liquid supply portion. Further, this apparatus may or may not include the engaged structure. These various aspects can solve at least one of the variety of different problems such as making the apparatus smaller, reducing cost, saving resources, simplifying manufacturing and improving ease of use. The technical features of each of the aspects of the liquid supply unit described above may be partially or entirely applied to this apparatus.

The present invention can be implemented in the form of various aspects other than the liquid supply unit, and may be implemented as a method of manufacturing a liquid supply unit, a liquid ejection system including a liquid supply unit and a liquid ejection apparatus, or the like.

DESCRIPTION OF EMBODIMENTS

A. First Embodiment

Figure 1:
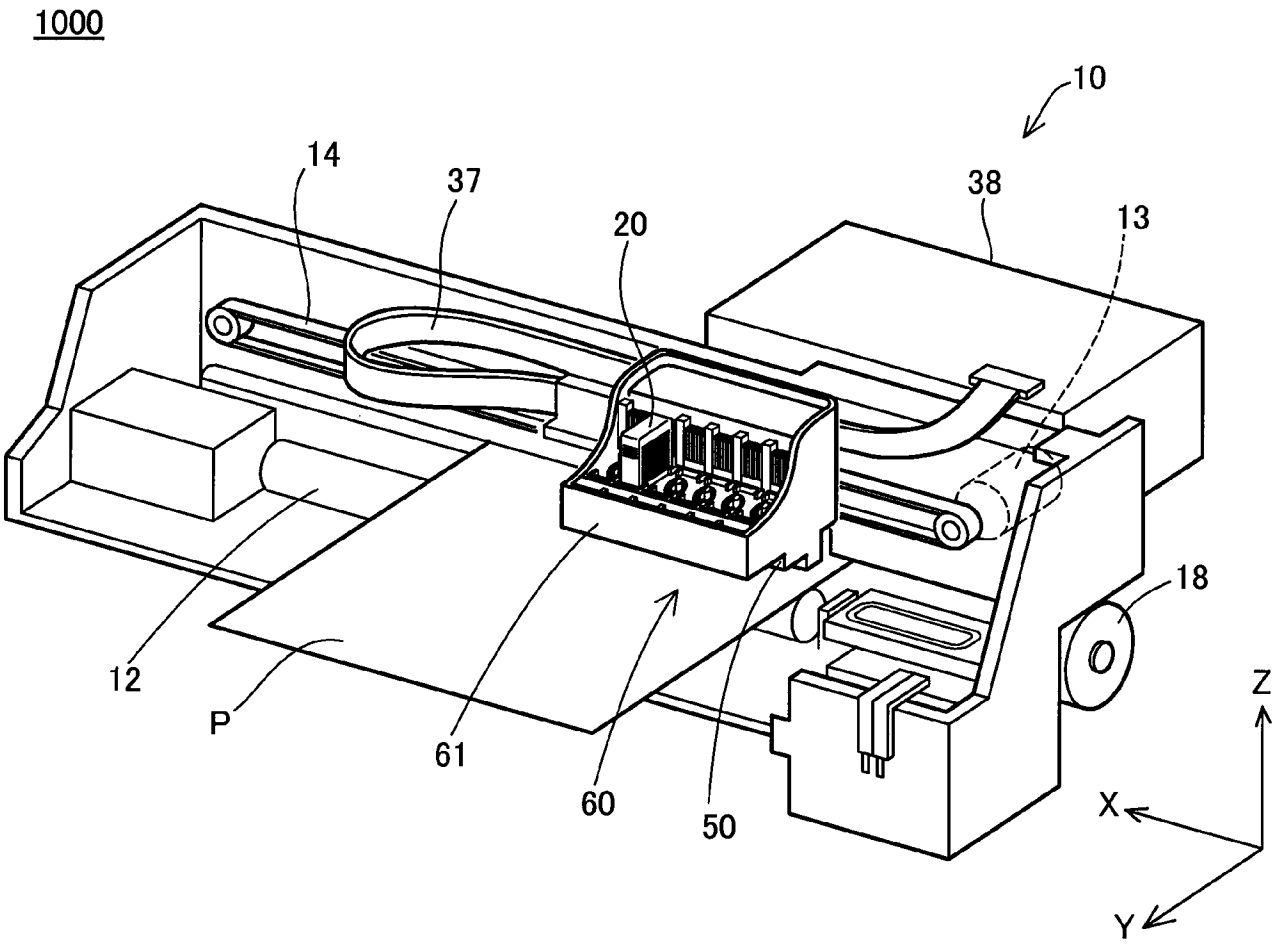
FIG. 1 is a perspective view for illustrating a configuration of a liquid ejection system according to a first embodiment.

A-1: Configuration of Liquid Ejection System:

FIG. 1 is a perspective view for illustrating the configuration of a liquid ejection system 1000 according to a first embodiment of the present invention. FIG. 1 shows XYZ axes that are all orthogonal to each other. The XYZ axes are also shown as needed in other diagrams to follow. The XYZ axes in FIG. 1 correspond to the XYZ axes in other diagrams. The liquid ejection system 1000 includes a cartridge 20 as a liquid supply unit and a printer 10 as a liquid ejection apparatus. The printer 10 includes a carriage unit 60. The carriage unit 60 includes a holder unit 61 onto which the cartridge 20 can be mounted and a head unit 50 that can eject ink to the outside. The cartridge 20 is removably mounted onto the holder unit 61 of the printer 10.

The cartridge 20 stores ink therein. The ink stored in the cartridge 20 is supplied to the head unit 50 by flowing through a liquid supply portion and a liquid injecting needle to be described later. In this embodiment, a plurality of the cartridges 20 is removably mounted onto the holder unit 61 of the printer 10. In this embodiment, a total of six (only one is shown in FIG. 1) different types of cartridges 20 that each correspond to six different colors (black, yellow, magenta, light magenta, cyan and light cyan) are mounted onto the holder unit 61. The number of cartridges 20 to be mounted onto the holder unit 61 is not limited to six.

The printer 10 distributes the ink to the head unit 50 via the liquid injecting needle to be described later by sucking in the ink stored in the cartridge 20 mounted onto the holder unit 61. The head unit 50 has a discharge mechanism such as a piezoelectric element to discharge (supply) the ink to a printing medium P such as paper or a label. With this configuration, data such as characters, shapes and images are printed onto the printing medium P.

A control unit 38 provided in the printer 10 controls each unit of the printer 10. The carriage unit 60 of the printer 10 is configured to move the head unit 50 relative to the printing medium P. The control unit 38 and the carriage unit 60 are electronically connected to one another via a flexible cable 37. The discharge mechanism of the head unit 50 performs a discharge operation on the basis of a control signal transmitted from the control unit 38.

In this embodiment, the holder unit 61 is configured together with the head unit 50 in the carriage unit 60. In this way, the type of the printer 10 onto which the cartridge 20 is mounted onto the holder unit 61 on the carriage unit 60 that moves the head unit 50 is a type that is also referred to as an "on-carriage printer". In other embodiments, the printer 10 may include a stationary holder unit 61 at a place different to the carriage unit 60 and supply the ink from the cartridge 20 mounted onto the holder unit 61 to the head unit 50 via a tube. This type of printer is also referred to as an "off-carriage printer".

The printer 10 further includes a main scanning feed mechanism and a sub-scanning feed mechanism that move the carriage unit 60 and the printing medium P relative to each other to print on the printing medium P. The main scanning feed mechanism of the printer 10 includes a carriage motor 13 and a drive belt 14. The main scanning feed mechanism moves the carriage unit 60 back and forth in a main scanning direction by transmitting power of the carriage motor 13 to the carriage unit 60 via the drive belt 14. The sub-scanning feed mechanism of the printer 10 includes a transfer motor 18 and a platen 12. The printing medium P is transferred in a sub-scanning direction orthogonal to the main scanning direction by transmitting power of the transfer motor 18 to the platen 12.

In this embodiment, in a usage state (also referred to as "usage orientation") of the liquid ejection system 1000, an axis along the sub-scanning direction (front-back direction) in which the printing medium P is transferred is a Y-axis, an axis along the main scanning direction (left-right direction) in which the carriage unit 60 is moved back and forth is an X-axis, and an axis along a gravity direction (up-down direction) is a Z-axis. The usage state of the liquid ejection system 1000 is a state in which the liquid ejection system 1000 is installed on a horizontal plane. In this embodiment, the horizontal plane is a plane (XY-plane) parallel to both the X-axis and the Y-axis.

In this embodiment, the sub-scanning direction (front direction) is a positive Y-axis direction, a direction opposite to that direction (back direction) is a negative Y-axis direction, a direction (up direction) down to up in the direction of gravity is a positive Z-axis direction, and a direction opposite to that direction (down direction) is a negative Z-axis direction. In this embodiment, a direction from the right side surface to the left side surface of the liquid ejection system 1000 is a positive X-axis direction (left direction), and a direction opposite to that direction is a negative X-axis direction (right direction). In this embodiment, the arrangement direction of the plurality of cartridges 20 mounted onto the holder unit 61 is a direction (left-right direction, also simply referred to as "X-axis direction") along the X-axis. The direction (left-right direction) along the X-axis is also referred to as "X-axis direction", and a direction (up-down direction) along the Z-axis is also referred to as "Z-axis direction". Further, in this embodiment, a mounting direction of mounting the cartridge 20 onto the holder unit 61 is a negative Z-axis direction, and a demounting direction of demounting the cartridge 20 from the holder unit 61 is a positive Z-axis direction.

Figure 2:
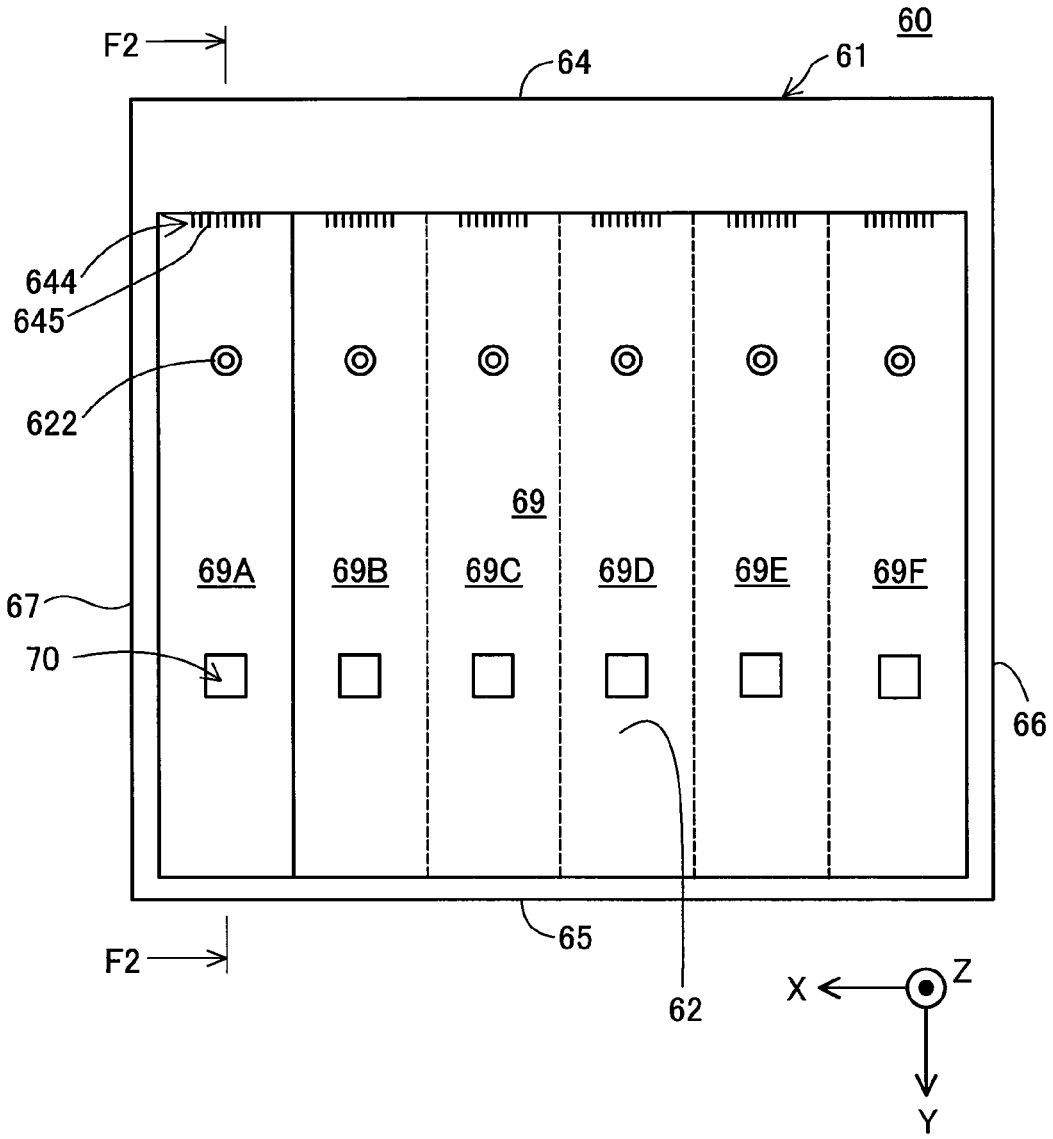
FIG. 2 is a schematic top view of a carriage unit.
Figure 3:
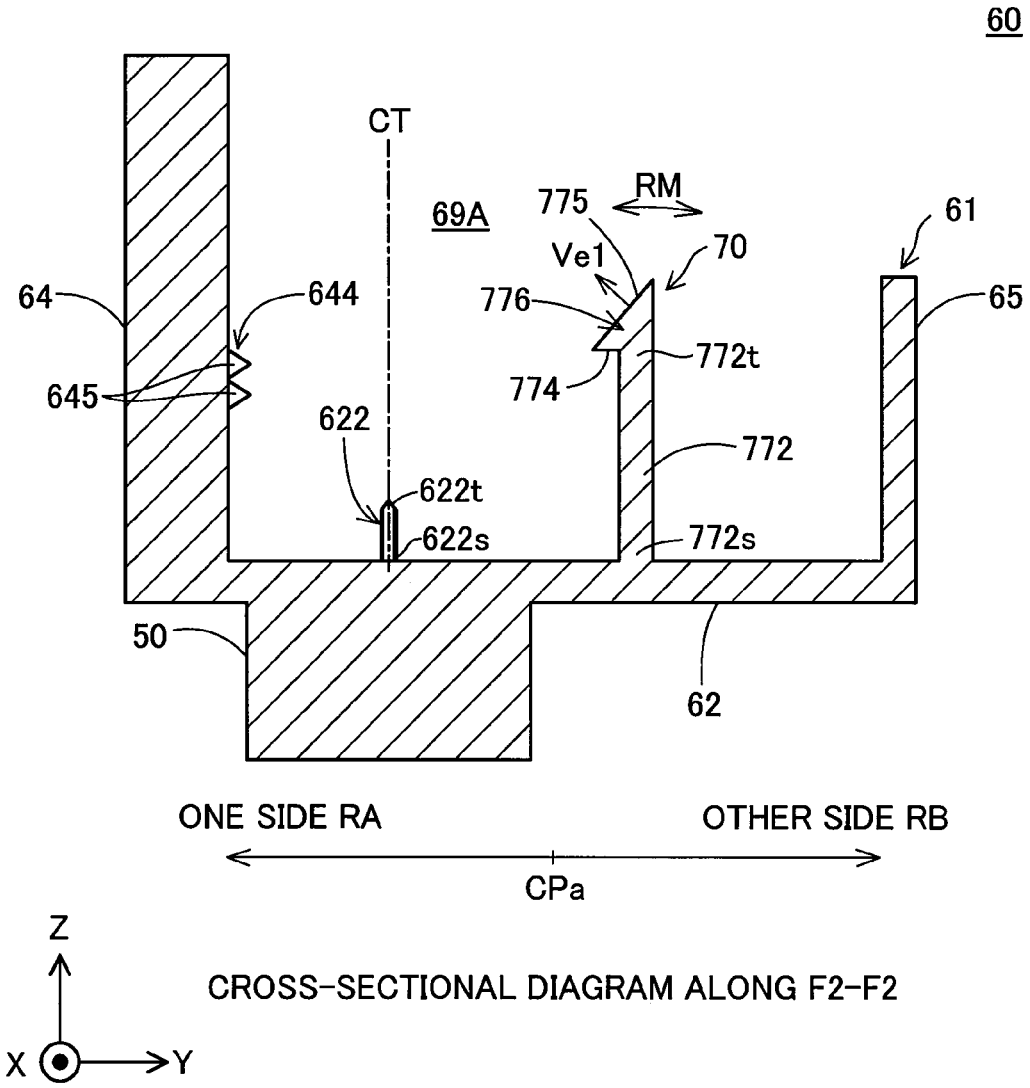
FIG. 3 is a schematic cross-sectional view along the line F2-F2 in FIG. 2.

A-2. Configuration of Carriage Unit 60:

FIG. 2 is a schematic top view of the carriage unit 60. FIG. 3 is a schematic cross-sectional view along the line F2-F2 in FIG. 2. The holder unit 61 (FIGS. 2 and 3) includes five wall portions 62, 64, 65, 66 and 67. The wall portion 62 is also referred to as "device front wall portion 62", the wall portion 64 is also referred to as "first side wall portion 64", the wall portion 65 is also referred to as "second side wall portion 65", the wall portion 66 is also referred to as "third side wall portion 66", and the wall portion 67 is also referred to as "fourth side wall portion 67". These five wall portions 62, 64, 65, 66 and 67 are, for example, molded of a synthetic resin.

The device front wall portion 62 forms a bottom wall of the holder unit 61. The device front wall portion 62 is located on the mounting direction side.

The four wall portions 64, 65, 66 and 67 extend in the positive Z-axis direction (demounting direction) from a peripheral edge portion of the device front wall portion 62. The five wall portions 62, 64, 65, 66 and 67 form a concave portion. This concave portion forms a cartridge storage chamber 69 (also referred to as "cartridge mounting portion 69") that houses the cartridges 20. The cartridge storage chamber 69 includes a plurality of slots (mounting spaces) 69A to 69F that can each receive one of the cartridges 20. The plurality of slots 69A to 69F may be divided by, for example, providing plate-shaped partition walls on the device front wall portion 62.

The first side wall portion 64 and the second side wall portion 65 oppose each other in the Y-axis direction. The third side wall portion 66 and the fourth side wall portion 67 oppose each other in the X-axis direction. In the holder unit 61 according to this embodiment, the Z-axis direction is a height direction, the Y-axis direction is a length direction, and the X-axis direction is a width direction.

The holder unit 61 includes a liquid injecting needle 622 as a liquid injection portion, an engagement structure 70 and an electrode portion 644 for each slot 69A to 69F.

The liquid injecting needle 622 (FIG. 3) is disposed on the device front wall portion 62. The liquid injecting needle 622 protrudes from the device front wall portion 62 in the positive Z-axis direction. A flow path through which the ink can flow is formed inside the liquid injecting needle 622. The liquid injecting needle 622 extends along the negative Z-axis direction (mounting direction). The liquid injecting needle 622 includes a base portion 622*s* located on the device front wall portion 62 side and a tip portion 622*t* located on a side opposite to the base portion 622*s*. The liquid injecting needle 622 according to this embodiment has a lateral cross section that is substantially circular and a central axis CT that extends in the mounting direction (negative Z-axis direction). A direction extending from the base portion 622*s* to the tip portion 622*t* is the positive Z-axis direction, and a direction extending from the tip portion 622*t* to the base portion 622*s* is the negative Z-axis direction. The liquid injecting needle 622 communicates with the head unit 50.

The engagement structure 70 is a columnar member that extends from the device front wall portion 62 in the demounting direction (positive Z-axis direction). The engagement structure 70 includes a main body portion 772 that extends from the device front wall portion 62 in the demounting direction and an engagement portion 776 connected to an end (demounting direction side end) of the main body portion 772. The engagement structure 70 may be, for example, molded integrally with the device front wall portion 62 from a synthetic resin, or may be molded as a member separate to the device front wall portion 62.

The main body portion 772 is a columnar member. A one end 772*s* of the main body portion 772 is connected to the device front wall portion 62. The main body portion 772 is configured to elastically deform due to external force with the one end 772*s* as a fulcrum, to thereby allow another end 772*t* of the main body portion 772 to move in a direction RM that includes a Y-axis direction component. The external force applied to the main body portion 772 is, for example, force applied as a result of the engagement structure 70 coming into contact with the cartridge 20 in the process of mounting the cartridge 20.

The engagement portion 776 is a protrusion connected to the other end 722*t* of the main body portion 772. The engagement portion 776 protrudes from the other end 772*t* of the main body portion 772 in the demounting direction (positive Z-axis direction) and in a direction (more specifically, the negative Y-axis direction) that is orthogonal to the demounting direction and that extends from the second side wall portion 65 to the first side wall portion 64. In the mounted state in which the cartridge 20 is mounted onto the holder unit 61, the engagement portion 776 can engage with the cartridge 20 (more specifically, an engaged portion to be described later). Through the engagement between the engagement portion 776 and the engaged portion of the cartridge 20, movement of the cartridge 20 under the mounted state in the demounting direction (positive Z-axis direction) is restricted.

The engagement portion 776 includes a guideway 775 and an engagement forming surface 774. The guideway 775 comes into contact with the cartridge 20 in the process of mounting the cartridge 20. This contact causes the other end 772*t* to move toward the positive Y-axis direction. The guideway 775 is a member that is used to guide the cartridge 20 to a position of engagement. The guideway 775 faces a direction including the demounting direction (positive Z-axis direction) and a direction component orthogonal to the demounting direction. In this embodiment, the guideway 775 faces a direction including components of the demounting direction and a direction (negative Y-axis direction) that is orthogonal to the demounting direction (negative Z-axis direction) and that extends from the second side wall portion 65 to the first side wall portion 64. The phrase "surface (component) faces a direction" refers to the orientation of a normal vector Ve of the surface (component). In other words, a normal vector Ve1 of the guideway 775 is oriented in a direction that includes a positive Z-axis direction component and a negative Y-axis direction component. The engagement forming surface 774 engages with the engaged portion of the cartridge 20 in the mounted state of the cartridge 20. The engagement forming surface 774 is a horizontal surface that faces the mounting direction (negative Z-axis direction). The engagement forming surface 774 extends from the main body portion 772 toward a side (negative Y-axis direction side) on which holder-side terminals 645 are located. The engagement forming surface 774 is not limited to this embodiment provided that the engagement forming surface 774 has a shape that allows for engagement with the engaged portion of the cartridge 20 to be described later in order to restrict the movement of the cartridge 20 in the demounting direction. For example, the engagement forming surface 774 may be inclined in the demounting direction or may be an uneven surface instead of a flat surface. In addition, in place of an engagement forming surface, there may be adopted a shape that allows for engagement with the engaged portion of the cartridge 20 by being fitted into the engaged portion of the cartridge 20.

The engagement structure 70 may further include an apparatus-side operation unit (not shown) for moving the engagement portion 776 in the direction indicated by the arrow RM. The apparatus-side operation unit is located at a position at which a user can operate the apparatus-side operation unit. The apparatus-side operation unit is used to release engagement between the engagement forming surface 774 and the cartridge 20. The apparatus-side operation unit is, for example, a pole-shaped member linked to the other end 772*t*. For example, one part of the apparatus-side operation unit protrudes outward from the device front wall portion 62. The user can move the engagement portion 776 by applying an external force to the apparatus-side operation unit.

The electrode portion 644 includes a plurality of the holder-side terminals 645. The electrode portion 644 is provided on the first side wall portion 64. Nine holder-side terminals 645 are provided in this embodiment. The number of holder-side terminals 645 is not limited to nine and may be more or less than nine. The holder-side terminals 645 are electronically connected to the control unit 38 (FIG. 1). Some of the holder-side terminals 645 are located in the cartridge storage chamber 69. Each holder-side terminal 645 is a plate-shaped metal member configured to elastically deform in at least the Y-axis direction. In the mounted state, each holder-side terminal 645 makes contact with a corresponding member (contact portion) of the cartridge 20 to become electronically connected to the contact portion. Further, in the mounted state, each holder-side terminal 645 elastically deforms in the negative Y-axis direction, to thereby bias the cartridge 20 in the positive Y-axis direction.

As illustrated in FIG. 3, in the Y-axis direction (first direction), a center point between an inner surface of the first side wall portion 64 and an inner surface of the second side wall portion 65 is a center part CPa, a side closer to the first side wall portion 64 from the center part CPa is a one side RA, and a side closer to the second side wall portion 65 from the center part CPa is an other side RB. In this case, the portions of the holder unit 61 have the following positional relationship to one another. That is, the liquid injecting needle 622 and the electrode portion 644 are located on the one side RA, and the engagement portion 776 is located on the other side RB.

Figure 4:
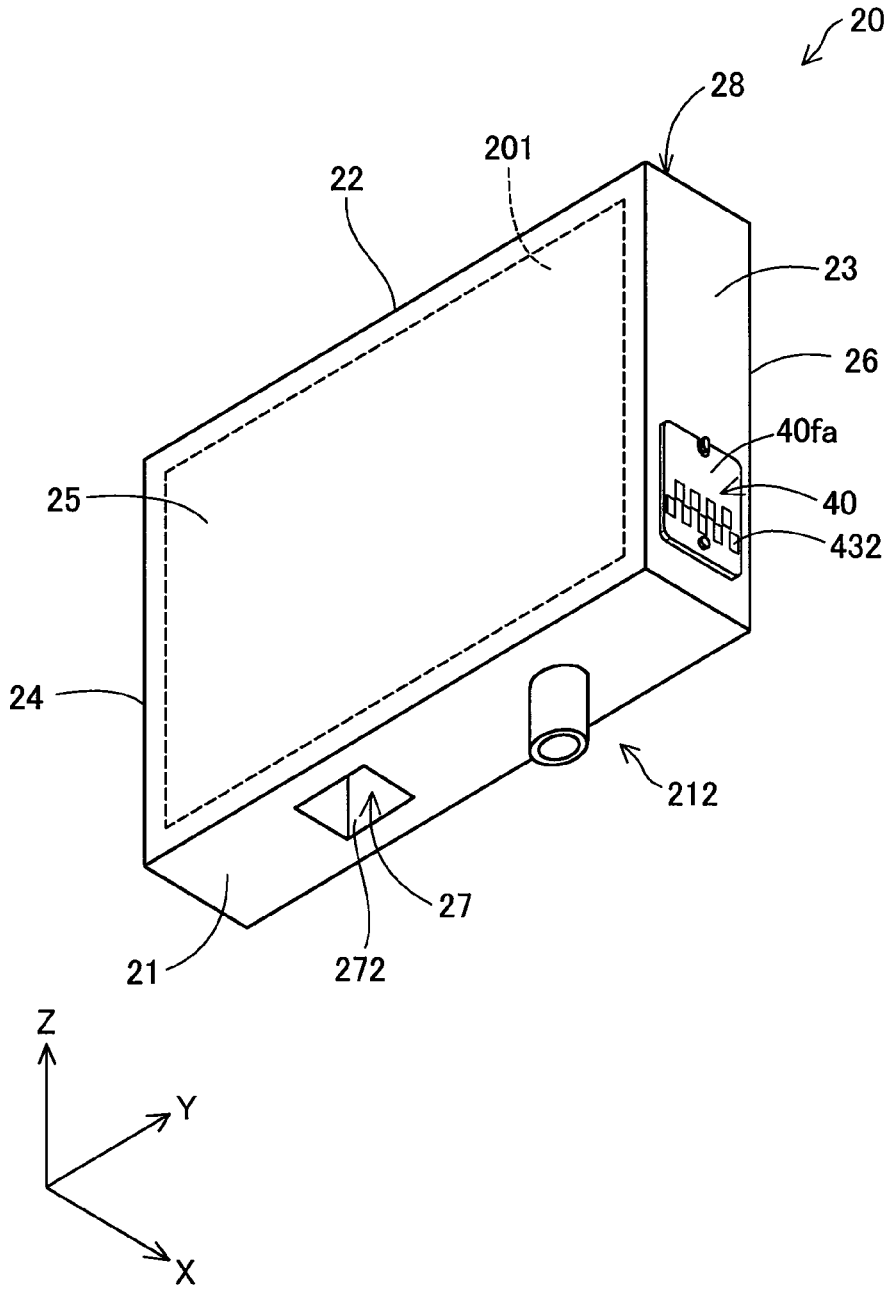
FIG. 4 is a perspective view for illustrating a cartridge according to the first embodiment.
Figure 5:
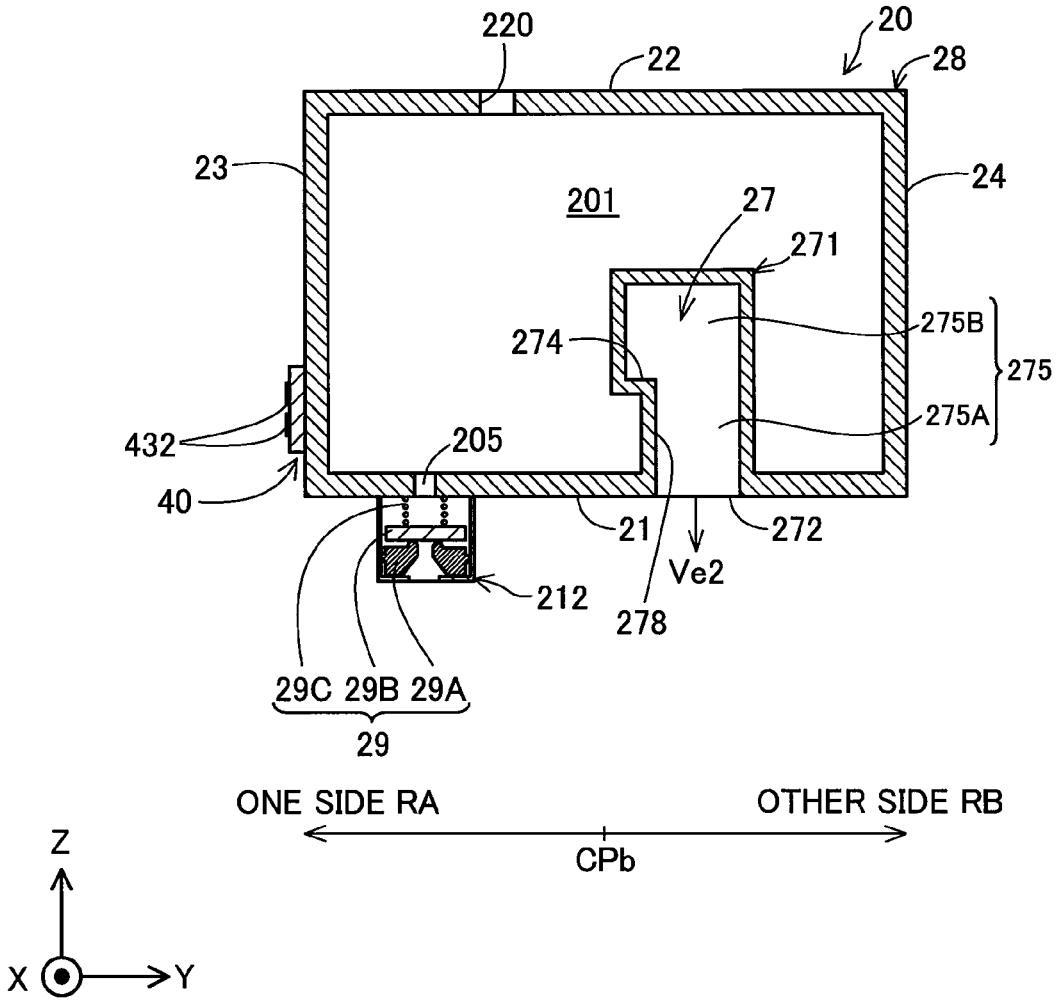
FIG. 5 is a cross-sectional view of the cartridge.

A-3. Configuration of Cartridge 20:

FIG. 4 is a perspective view of the cartridge 20 according to the first embodiment. FIG. 5 is a cross-sectional view of the cartridge 20. FIGS. 4 and 5 show XYZ-axes in the mounted state. The XYZ-axes in the mounted state are also shown in figures to follow as necessary.

The cartridge 20 (FIG. 4) includes an outer shell 28, a liquid storage portion 201, a liquid supply portion 212, a circuit substrate 40 and an engaged structure 27.

The outer shell 28 forms an outer surface of the cartridge 20. The outer shell 28 is the body of the cartridge 20 and divides the space therein that includes the liquid storage portion 201 into sections. The outer shell 28 is made of a synthetic resin such as polypropylene (PP). The outer shell 28 has a substantially triangular prism shape or a substantially cuboid shape. The outer shell 28 may be partly made of a resin film.

The outer shell 28 includes a first wall portion 21, a second wall portion 22, a third wall portion 23, a fourth wall portion 24, a fifth wall portion 25 and a sixth wall portion 26. The first to sixth wall portions 21 to 26 have outer surfaces that are substantially flat. The phrase "substantially flat" includes both a case in which the entire surface is completely flat and a case in which the surface is partly uneven. In other words, this includes a case in which, even if the surface is partly uneven, the surface can be recognized as a surface or a wall that forms the outer shell 28 of the cartridge 20. An outer shape of each of the first to sixth wall portions 21 to 26 as seen in plan view is substantially rectangular.

The first wall portion 21 forms a horizontal bottom surface in the mounted state. The first wall portion 21 faces a direction that includes a mounting direction (negative Z-axis direction) component. In this embodiment, the first wall portion 21 faces the mounting direction. In other words, in this embodiment, a normal vector of the outer surface of the first wall portion 21 is oriented in the mounting direction. Here, the first wall portion 21 is also referred to as "tip side portion 21". The first wall portion (tip side portion) 21 can also be referred to as a portion of the outer shell 28 located closer to the mounting direction. The first wall portion (tip side portion) 21 is also a portion that faces the device front wall portion 62 (FIG. 3) provided with the liquid injecting needle 622. The first wall portion 21 is not limited to facing the mounting direction and may face a direction having a mounting direction component.

The second wall portion 22 forms a horizontal top surface in the mounted state. The second wall portion 22 opposes the first wall portion 21. The second wall portion 22 is located on the side of the demounting direction opposite to the mounting direction. The second wall portion 22 is a portion that faces a direction including a demounting direction (positive Z-axis direction) component. In this embodiment, the second wall portion 22 faces the demounting direction. The second wall portion 22 is also referred to as "rear side portion 22". Herein, "a case in which two elements oppose each other" includes both a case in which another element is located between the two elements and a case in which no other element is located between the two elements. An air induction port 220 (FIG. 5) is formed in the second wall portion 22. The air induction port 220 introduces air to the liquid storage portion 201 in accordance with consumption of the ink in the liquid storage portion 201. In addition, the second wall portion 22 or another component of the cartridge 20 may be provided with a liquid inlet for injecting the ink into the liquid storage portion 201.

The third wall portion 23 forms a back surface in the mounted state. The third wall portion 23 intersects with the first wall portion 21 and the second wall portion. An outer surface of the third wall portion 23 is a surface (XZ plane) parallel to both the X-axis direction and the Z-axis direction and perpendicular to the Y-axis direction. Herein, when two elements (for example, wall portions or surfaces) "intersect with each other," this refers to any one of the following states. That is, a state in which the two elements actually intersect with each other, a state in which one element is extended and intersects with the other element, and a state in which both elements are extended and intersect with each other.

The fourth wall portion 24 forms a front surface in the mounted state. The fourth wall portion 24 intersects with the first wall portion 21 and the second wall portion 22. The fourth wall portion 24 opposes the third wall portion 23. An outer surface of the fourth wall portion 24 is a surface (XZ plane) parallel to both the X-axis direction and the Z-axis direction and perpendicular to the Y-axis direction.

The fifth wall portion 25 forms a right side surface in the mounted state. The sixth wall portion 26 forms a left side surface in the mounted state. The fifth wall portion 25 and the sixth wall portion 26 oppose each other. The fifth wall portion 25 and the sixth wall portion 26 each intersect with the first to fourth wall portions 21 to 24. Outer surfaces of the fifth wall portion 25 and the sixth wall portion 26 are surfaces (YZ plane) parallel to both the Y-axis direction and the Z-axis direction and perpendicular to the X-axis direction. The fifth wall portion 25 and the sixth wall portion 26 oppose each other.

In the outer shell 28, the dimensions of a direction (X-axis direction) in which the fifth wall portion 25 and the sixth wall portion oppose each other are smaller than the dimensions of a direction (Z-axis direction) in which the first wall portion 21 and the second wall portion 22 oppose each other and the dimensions of a direction (Y-axis direction) in which the third wall portion 23 and the fourth wall portion 24 oppose each other. In other words, the distance between the third wall portion 23 and the fourth wall portion 24 is longer than the distance between the fifth wall portion 25 and the sixth wall portion.

The Y-axis direction orthogonal to the mounting direction (Z-axis direction) is also referred to as "first direction". In this embodiment, the first direction is the direction in which the third wall portion 23 and the fourth wall portion 24 oppose each other. In other words, the first direction is one direction among two directions (X-axis direction and Y-axis direction) orthogonal to the mounting direction in which the outer shell 28 has larger dimensions. As illustrated in FIG. 5, in the cartridge 20, the center point between the outer surface of the third wall portion 23 and the outer surface of the fourth wall portion 24 is a center part CPb in the first direction, and a side closer to the third wall portion 23 from the center part CPb is the one side RA, and a side closer to the fourth wall portion 24 from the center part CPb is the other side RB.

The liquid storage portion 201 (FIG. 5) stores ink to be supplied to the head unit 50. The liquid storage portion 201 is defined by the outer shell 28.

The liquid supply portion 212 can connect with the liquid injecting needle 622 (FIG. 3). The liquid supply portion 212 communicates with the liquid storage portion 201 via a communication hole 205 formed in the first wall portion 21. In other words, the liquid supply portion 212 can supply the ink to the printer 10. The liquid supply portion 212 is arranged on the first wall portion 21 that forms the tip side portion of the outer shell 28. The liquid supply portion 212 is also located on the one side RA in the first direction. The liquid supply portion 212 is a tubular member that protrudes from the first wall portion 21 in the mounting direction. A tip of the liquid supply portion 212 is open. The liquid supply portion 212 distributes the ink stored in the liquid storage portion 201 to the outside (for example, the liquid injecting needle 622) via the tip opening. In the mounted state, the liquid supply portion 212 is connected to the liquid injecting needle 622 by inserting the liquid injecting needle 622 into the tubular liquid supply portion 212. With this connection, it is possible to distribute the ink to the liquid injecting needle 622 from the liquid supply portion 212.

A valve mechanism 29 is disposed inside the liquid supply portion 212. This valve mechanism 29 opens and closes a flow path inside the liquid supply portion 212. The valve mechanism 29 includes a sealing portion (valve seat) 29A, a valve body 29B and a biasing member 29C in order from the tip of the liquid supply portion 212. The sealing portion 29A is a substantially annular member. The sealing member 29A is configured of an elastic body such as rubber or an elastomer. The sealing member 29A is press-fitted inside a liquid supply portion 212. The valve body 29B is a substantially annular member. The valve body 29B covers a hole (valve hole) formed in the sealing member 29A in a state before the cartridge 20 is mounted onto the holder unit 61 (pre-mounted state). The biasing member 29C is a compression coil spring. The biasing member 29C biases the valve body 29B in a direction toward the sealing member 29A. In the mounted state of the cartridge 20, the liquid injecting needle 622 (FIG. 3) presses the valve body 29B toward a direction away from the sealing portion 29A, to thereby separate the valve body 29B from the sealing portion 29A. With this configuration, the valve mechanism 29 opens.

The circuit substrate 40 (FIG. 4) is electronically connected to the control unit 38 (FIG. 1) in the mounted state of the cartridge 20. A plurality of unit-side terminals 432 are provided on a front surface 40*fa* of the circuit substrate 40. Nine unit-side terminals 432 are provided to correspond to the number of holder-side terminals 645 (FIG. 3). Each unit-side terminal 432 has a substantially rectangular outer shape. A center part of the substantially rectangular-shaped unit-side terminal 432 makes contact with a corresponding holder-side terminal 645, to thereby allow electronic connection between the unit-side terminal 432 and the holder-side terminal 645. Therefore, the unit-side terminal 432 is also referred to as "contact portion 432". An electronic device (not shown) such as a storage device is provided on a rear surface of the circuit substrate 40. This electronic device is connected to the unit-side terminals 432 through wiring. For example, the storage device stores information on the ink (amount of ink remaining, color of ink) in the cartridge 20. In the mounted state of the cartridge 20, signals are sent/received between the storage device and the control unit 38 (FIG. 1).

The circuit substrate 40 (FIG. 5) is arranged on the third wall portion 23 located on the one side RA in the first direction (Y-axis direction). A normal vector of the front surface 40*fa* of the circuit substrate 40 is oriented in the negative Y-axis direction. The unit-side terminal 432 is arranged on the one side RA in the first direction.

The engaged structure 27 includes an engaged portion 274, a receiving portion 275 and a first opening 272. The engaged structure 27 is a concave portion formed in the first wall portion 21. The engaged structure 27 is defined by an inner wall portion 271 provided in the cartridge 20. The receiving portion 275 accepts the columnar engagement structure 70 (FIG. 3) in the mounted state. The receiving portion 275 includes a first receiving portion 275A that receives the main body portion 772 and a second receiving portion 275B that receives the engagement portion 776. The first receiving portion 275A is located closer to the mounting direction than the second receiving portion 275B. A step is formed at a boundary portion between the first receiving portion 275A and the second receiving portion 275B. This step forms the engaged portion 274.

The first opening 272 is an opening formed in the first wall portion 21. The first opening 272 can also be regarded as an opening of the receiving portion 275, which is a concave portion. The first opening 272 opens to allow the main body portion 772 of the engagement structure 70 to be inserted there through. The opening direction of the first opening 272 is the mounting direction (negative Z-axis direction). The opening direction is the orientation of a normal vector Ve2 (FIG. 5) of an opening surface of the first opening 272 open from the inside to the outside of the cartridge 20.

The engaged portion 274 can engage with the engagement portion 776 (FIG. 3) of the printer 10. The engaged portion 274 is formed by the inner wall portion 271 that defines the engaged structure 27. The engaged portion 274 is a surface that faces the demounting direction (positive Z-axis direction). The engaged portion 274 extends from one wall portion 278 that forms a side wall portion of the receiving portion 275 that is a concave portion to a side (negative Y-axis direction side) on which the unit-side terminals 432 are located in the first direction. The wall portion 278 is located on a side wall portion of the first receiving portion 275A on the side of the unit-side terminals 432 (negative Y-axis direction side) in the first direction. In addition, the wall portion 278 defines the first opening 272. The engaged portion 274 is arranged further inward than the outer surface of the outer shell 28. In other words, the engaged portion 274 is arranged in an area surrounded by the outer surface of the outer shell 28. The engaged portion 274 is also arranged between the first wall portion 21 and the second wall portion 22. The engaged portion 274 is also arranged between the third wall portion 23 and the fourth wall portion 24. The engaged portion 274 is also arranged between the fifth wall portion 25 and the sixth wall portion 26. The configuration of the engaged portion 274 is not limited to that described in this embodiment and may be any configuration that allows the engaged portion 274 to engage with the engagement portion 776 to restrict the movement of the cartridge 20 in the demounting direction. For example, the engagement portion 776 may be a protrusion that extends in a horizontal direction, and the engaged portion 274 may be a through hole portion that accepts the engagement portion 776 that is the protrusion.

Figure 6:
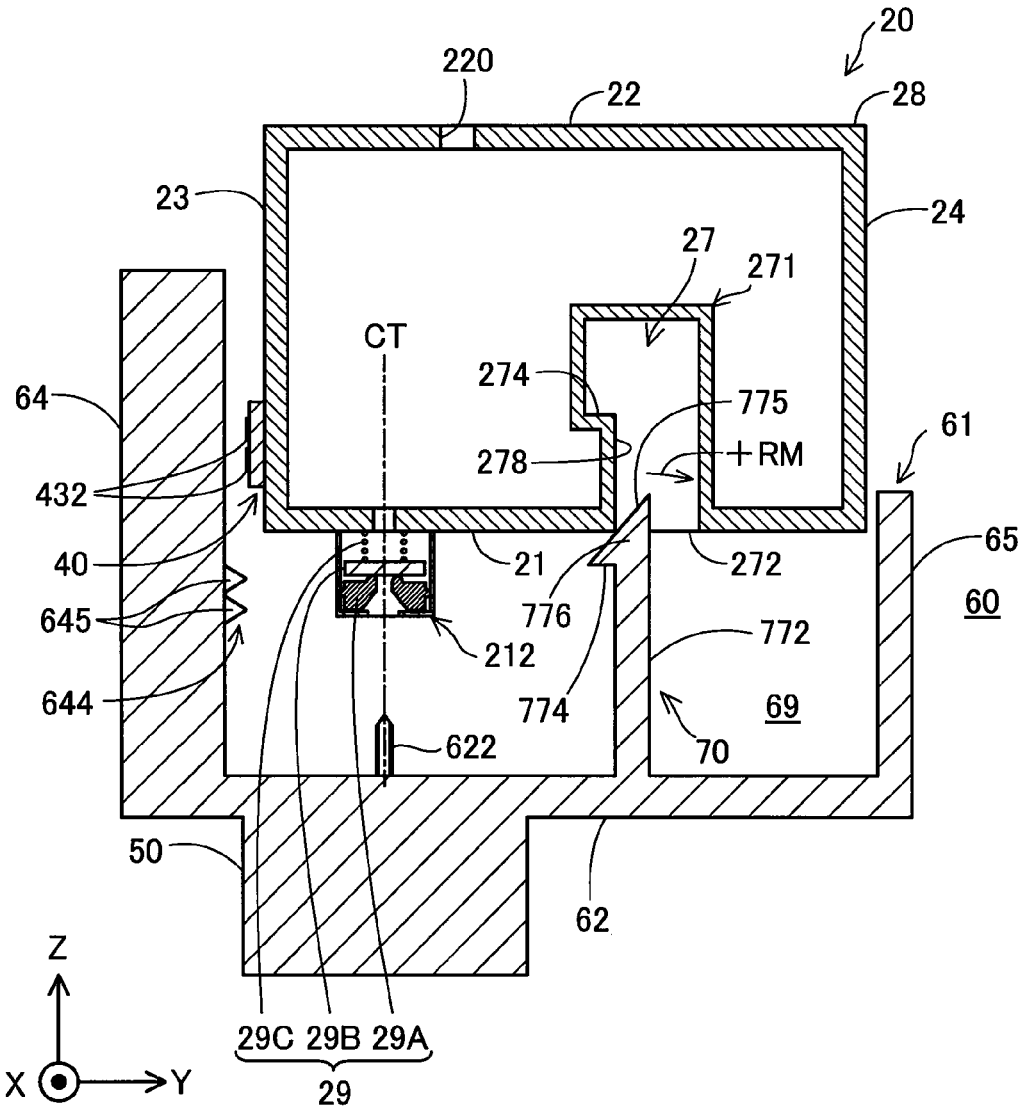
FIG. 6 is a diagram for illustrating a process of mounting the cartridge onto a holder unit.
Figure 7:
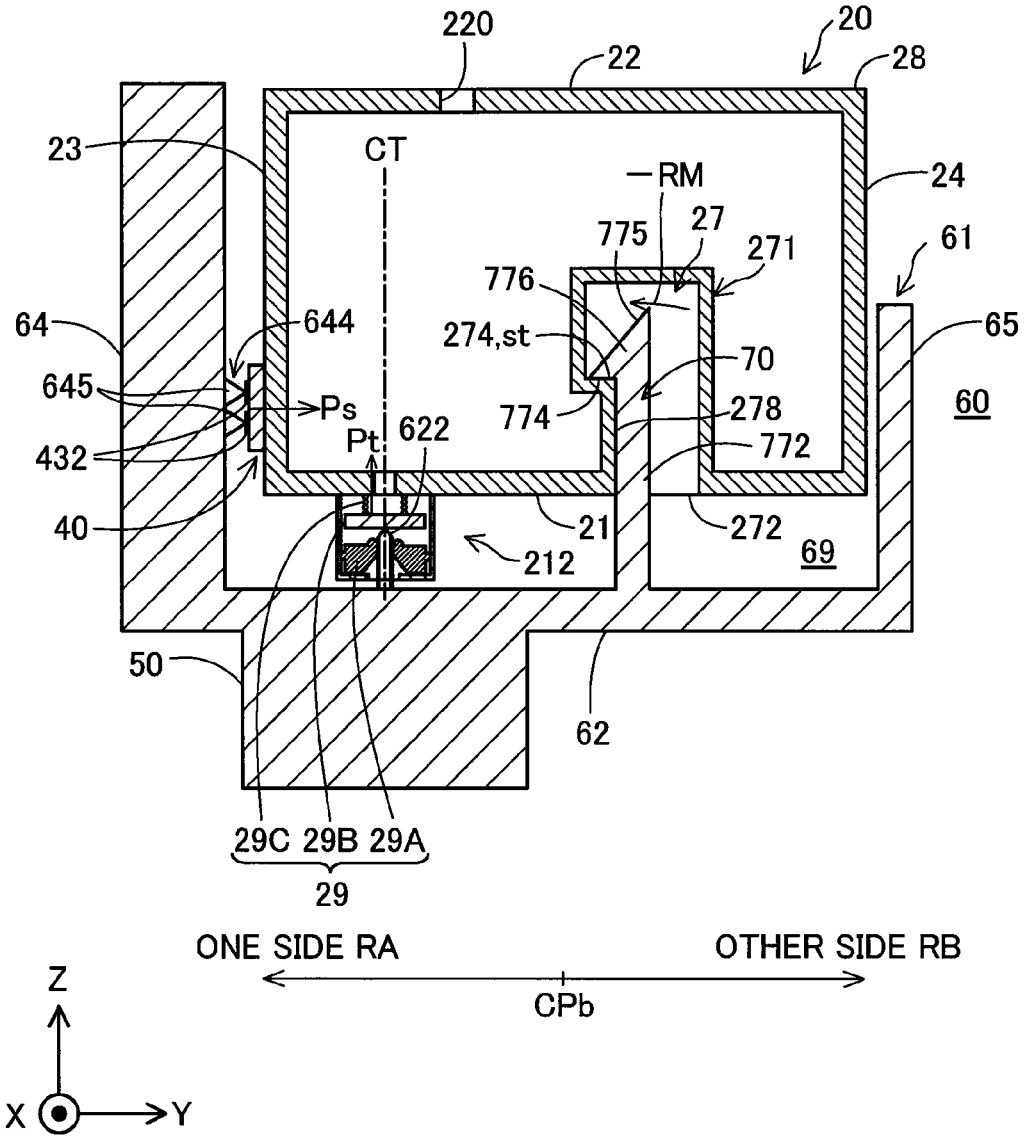
FIG. 7 is a diagram for illustrating a state in which the cartridge is mounted onto the holder unit.

A-4. Aspect of Mounting Cartridge 20 onto Holder Unit 61:

FIG. 6 is a diagram for illustrating a process of mounting the cartridge 20 onto the holder unit 61. FIG. 7 is a diagram for illustrating a state in which the cartridge 20 is mounted onto the holder unit 61. When the cartridge 20 is to be mounted onto the holder unit 61, the user moves the cartridge 20 in the mounting direction toward the cartridge storage chamber 69. More specifically, the user moves the cartridge 20 in the mounting direction while positioning the liquid supply portion 212 on the central axis CT of the liquid injecting needle 622 such that the liquid injecting needle 622 is inserted into the liquid supply portion 212.

In this mounting process, insertion into the receiving portion 275 proceeds while the engagement portion 776 comes into contact with the first wall portion 21 that defines the first opening 272, to thereby elastically deform the main body portion 772 such that the engagement portion 776 moves in a positive RM direction (direction in which fourth wall portion 24 is located). In addition, by moving the cartridge 20 in the mounting direction, the engagement portion 776 proceeds to a back side (positive Z-axis direction side) of the receiving portion 275 toward the engaged portion 274 while the engagement portion 776 (more specifically, a negative Y-axis direction side end of the engagement portion 776) comes into contact with the wall portion 278. Through the engagement portion 776 coming into contact with the wall portion 278, displacement of the engagement portion 776 in the positive RM direction is maintained.

As illustrated in FIG. 7, when the engagement portion 776 has passed through the wall portion 278, the engagement portion 776 and the wall portion 278 separate from each other, and elastic deformation of the main body portion 772 caused by external force applied to the engagement portion 776 by the wall portion 278 is released. Through this action, the engagement portion 776 moves toward a negative RM direction (toward the third wall portion 23) and the engaged portion 274 faces the engagement forming surface 774. As described above, the wall portion 278 also functions as a guiding portion for guiding the engagement portion 776 to the engaged portion 274.

As illustrated in FIG. 7, in the mounted state of the cartridge 20, the liquid supply portion 212 connects with the liquid injecting needle 622, and the unit-side terminals 432 make contact with the holder-side terminals 645. Further, in the mounted state of the cartridge 20, the cartridge 20 is subject to external forces Pt and Ps that are applied from the holder unit 61. The external force Pt is a force applied to the valve body 29B of the cartridge 20 by the liquid injecting needle 622. The external force Pt is oriented in the demounting direction (positive Z-axis direction). The external force Ps is a force applied to the unit-side terminals 432 of the cartridge 20 by the holder-side terminals 645. The external force Ps is oriented in a direction (positive Y-axis direction) extending from the one side RA to the other side RB in the first direction (Y-axis direction).

In the mounted state of the cartridge 20, the cartridge 20 is subject to force in the demounting direction due to the external force Pt. However, in the mounted state of the cartridge 20, the engaged portion 274 engages with the engagement forming surface 774, to thereby restrict the movement of the cartridge 20 in the demounting direction. The cartridge 20 is also subject to force (positive Y-axis direction) in a direction extending from the third wall portion 23 to the fourth wall portion 24 due to the external force Ps. The external force Ps is oriented in a direction (locking direction) opposite to the direction in which engagement between the engaged portion 274 and the engagement forming surface 774 is released. Therefore, the possibility of the engaged portion 274 and the engagement forming surface 774 becoming disengaged can be reduced.

When the cartridge 20 is to be demounted from the holder unit 61, the user operates the apparatus-side operation unit of the engagement structure 70 to move the engagement portion 776 in the positive RM direction. With this action, engagement between the engaged portion 274 and the engagement forming surface 774 is released. In this state, the user moves the cartridge 20 in the demounting direction, to thereby demount the cartridge 20 from the holder unit 61.

Here, a conventional technology (the above-mentioned Patent Literature 1), employs a lever structure as the engaged structure of the cartridge. This lever structure is provided on a side surface that forms an outer shell of the cartridge. In this case, the cartridge and the holder unit may increase in size by the size of the lever structure. In addition, with the conventional technology, because the lever structure is provided on the side surface, the lever structure may break if the cartridge is accidentally dropped. In addition, with the conventional technology, the printer may carry out a printing operation while the cartridge is not completely mounted onto the holder unit. One example of incomplete mounting is a state in which, because the lever structure is provided on the side surface, another side surface of the cartridge not provided with a lever structure is inclined in the mounted state. Another example of incomplete mounting is a state in which engagement between the holder unit and the lever structure is incomplete due to deformation of the lever structure or foreign matter adhering to components. In this embodiment, the above-described problems that can occur in the conventional technology can be at least partly solved.

As illustrated in FIG. 5, according to the first embodiment, for example, the engaged portion 274 is formed further inward than the outer surface of the outer shell 28. With this configuration, the possibility of foreign matter adhering to the engaged portion 274 or the vicinity thereof can be reduced. As a result, because the engaged portion 274 and the engagement portion 776 can precisely engage with each other, the cartridge 20 can be more reliably mounted. For example, according to the first embodiment, because the engaged portion 274 (a position of engagement st with the engagement portion 776 illustrated in FIG. 7) is formed further inward than the outer surface of the outer shell 28, the cartridge 20 can be made smaller compared to a case in which the engaged portion 274 is formed further outward than the outer surface of the outer shell 28.

According to the above-described first embodiment, the engaged portion 274 is formed by the receiving portion 275, which is a concave portion, that can engage with the engagement portion 776, which is a protrusion. With this configuration, the engaged portion 274 can be formed with a simple structure. The engaged portion 274 may have a different configuration provided that the engaged portion 274 can engage with the engagement portion 776 which is a protrusion. For example, the engaged portion 274 may be formed by providing a plate-shaped wall that extends in the mounting direction in the inner wall portion 271 and forming an opening that penetrates the plate-shaped wall in the Y-axis direction. Even with such a structure, the engaged portion 274 can be formed with a simple structure. In addition, the engaged portion 274 is not limited to a horizontal plane that faces the demounting direction and may be inclined toward the demounting direction, provided that the engaged portion 274 can engage with the engagement portion 776.

A-5. Modified Aspects of First Embodiment:

In the above-described first embodiment, the configuration, position, number, and other aspects of the engaged structure 27 and the engagement structure 70 may be changed as necessary provided that the engaged portion 274 is arranged further inward than the outer surface of the outer shell 28. Modified aspects of the engaged structure 27 and the engagement structure 70 according the first embodiment are described below.

A-5-1. Modified Aspects of Number, Position and Shape of Engagement Structure 70 and Engaged Structure 27:

The number, position and shape of the engagement structure 70 is not limited to the above-described embodiment. Modified aspects of the number and position of the engagement structure 70 are described below.

Figure 8:
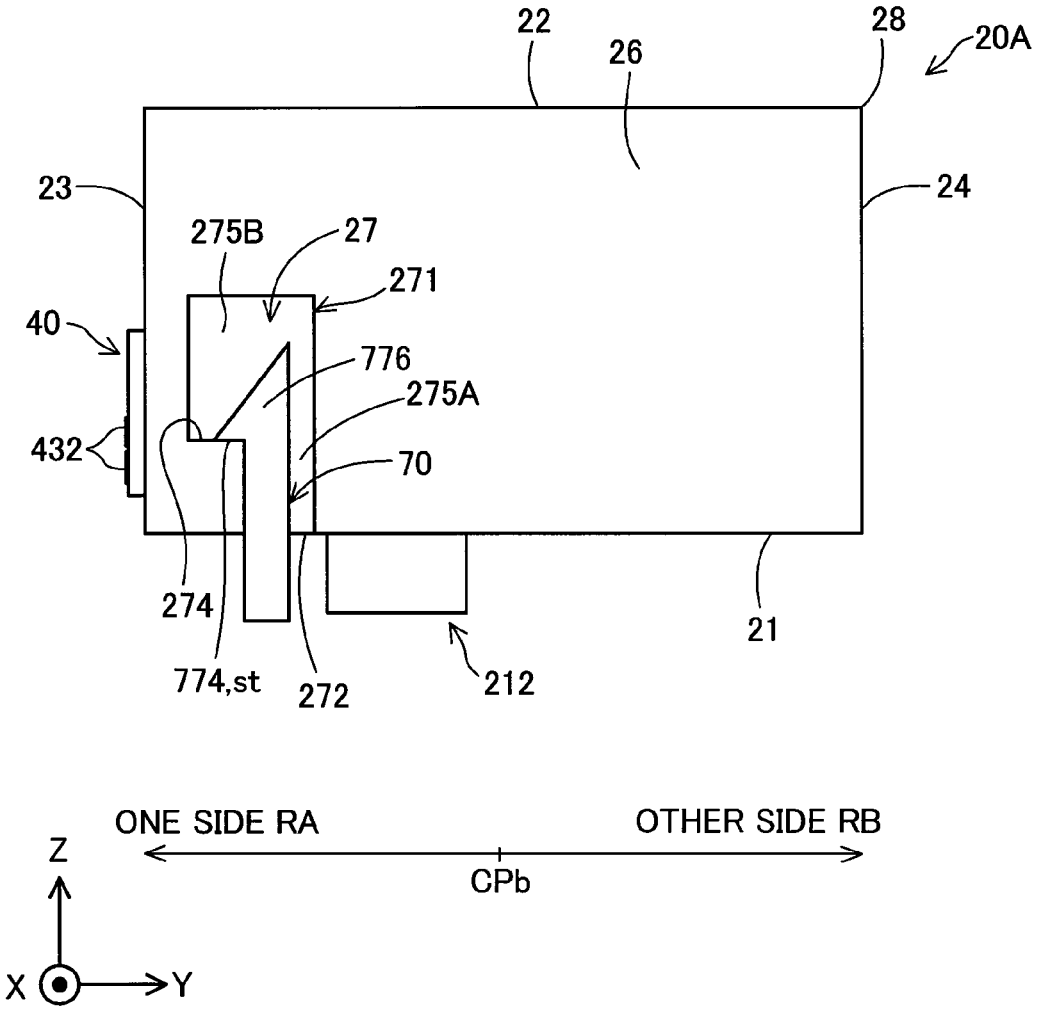
FIG. 8 is a schematic diagram for explaining a first modified aspect.

A-5-1a. First Modified Aspect:

FIG. 8 is a schematic diagram for explaining a first modified aspect. FIG. 8 is a diagram for illustrating a cartridge 20A and the engagement structure 70 as seen from a positive X-axis direction side. To facilitate understanding in FIG. 8, the engaged structure 27 and the engagement structure 70 located closer to the negative X-axis direction than the sixth wall portion 26 are also illustrated. The cartridge 20A differs from the cartridge 20 (FIG. 5) according to the first embodiment in terms of the position of the engaged structure 27 in the Y-axis direction. In addition, the position of the engagement structure 70 is different to the position of the engagement structure 70 according to the first embodiment to correspond to the position of the engaged structure 27. Other configurations of the liquid ejection system are the same as those according to the first embodiment, and hence similar components are denoted by the same reference symbols as those in the first embodiment and a description thereof is omitted.

The engaged structure 27 of the cartridge 20A is located between the liquid supply portion 212 and the contact portion 432 when the cartridge 20A is viewed in plan in a predetermined direction (positive Z-axis direction, demounting direction) extending from the first wall portion 21 to the second wall portion 22. In other words, when the cartridge 20A is viewed in plan in the predetermined direction, the opening 272 and the engaged portion 274 (position of engagement st between engaged portion 274 and engagement portion 776) are located between the liquid supply portion 212 and the contact portion 432. In addition, as in the first embodiment, when the cartridge 20A is viewed in plan in the predetermined direction, the liquid supply portion 212 is located closer to the third wall portion 23 than the fourth wall portion 24. In other words, in the first direction, the liquid supply portion 212 is located on the one side RA.

The first modified aspect has a similar configuration to that of the first embodiment, and hence achieves a similar effect. In addition, according to the first modified aspect, it is possible to reduce the possibility of one of two sides that sandwich the position of engagement st becoming inclined on the one side RA of the cartridge 20, compared to a case in which the position of engagement st is not located between the liquid supply portion 212 and the contact portion 432 in the first direction. As a result, compared to the case in which the position of engagement st is not located between the liquid supply portion 212 and the contact portion 432 in the first direction, contact between the contact portion 432 and the electrode portion 644 can be favorably maintained. Further, according to the first modified aspect, because it is possible to reduce the possibility of one of the two sides that sandwich the position of engagement st becoming inclined, connection between the liquid supply portion 212 and the liquid injecting needle 622 can be favorably maintained. As described above, according to the first modified aspect, the cartridge 20A can be even more reliably mounted.

Figure 9:
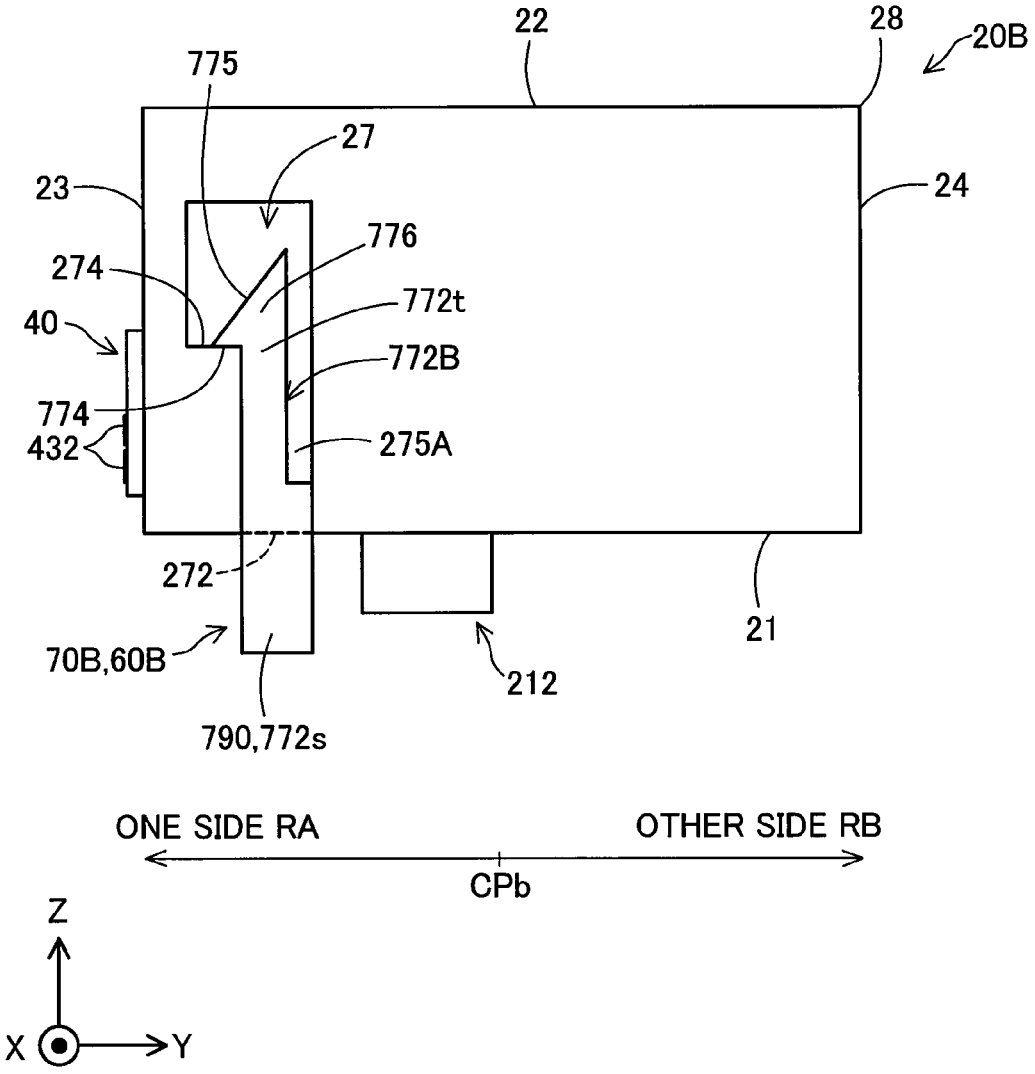
FIG. 9 is a schematic diagram for explaining a second modified aspect.

A-5-1b: Second Modified Aspect:

FIG. 9 is a schematic diagram for explaining a second modified aspect. FIG. 9 illustrates a cartridge 20B and an engagement structure 70B as viewed from the positive X-axis direction side. To facilitate understanding in FIG. 9, the engaged structure 27 and the engagement structure 70B located closer to the negative X-axis direction than the sixth wall portion 26 are also illustrated. The second modified aspect differs from the first modified aspect in terms of the configuration of a main body portion 772B. Other configurations are the same as those according to the first modified aspect, and hence like components are denoted by the same reference symbols as those in the first modified aspect and a description thereof is omitted.

The engagement structure 70B includes a positioning portion 790 used to position the cartridge 20B with respect to the holder unit 61 in a direction orthogonal to the mounting direction. The positioning portion 790 is a portion on a one end 772*s* of the main body portion 772B. A cross section (lateral cross section) of the positioning portion 790 orthogonal to the mounting direction forms an external shape that can be inserted into the opening 272 and that generates a slight gap with the outline of the opening 272. In the mounted state, the positioning portion 790 is inserted into the opening 272. A lateral cross section of an other end 772*t* of the main body portion 772B forms an outer shape that generates a sufficient gap with the outline of the opening 272.

The second modified aspect has a similar configuration to that of the first embodiment and the first modified aspect, and hence achieves a similar effect. In addition, according to the second modified aspect, in the process of mounting the cartridge 20B, through inserting the positioning portion 790 into the opening 272, the cartridge 20B can be positioned in the direction orthogonal to the mounting direction. In the mounting process, the positioning portion 790 is preferably inserted into the opening 272 before the liquid supply portion 212 and the liquid injecting needle 622 connect with each other and before the contact portion 432 and the holder-side terminals 645 make contact with one another. As a result, in the direction orthogonal to the mounting direction, the liquid supply portion 212 can be positioned more precisely with respect to the liquid injecting needle 622 and the contact portion 432 can be positioned more precisely with respect to the holder-side terminals 645. As described above, according to the second modified aspect, the cartridge 20B can be mounted even more reliably.

In the second modified aspect, the positioning portion 790 can perform positioning in the two directions (X-axis direction and Y-axis direction) orthogonal to the mounting direction, but the positioning portion 790 may be configured to perform positioning in one direction (either of the X-axis direction and the Y-axis direction) orthogonal to the mounting direction. For example, if the positioning portion 790 performs positioning in the Y-axis direction, the dimensions of the positioning portion 790 may be slightly smaller than the dimensions of the opening 272 in at least the Y-axis direction.

Figure 10:
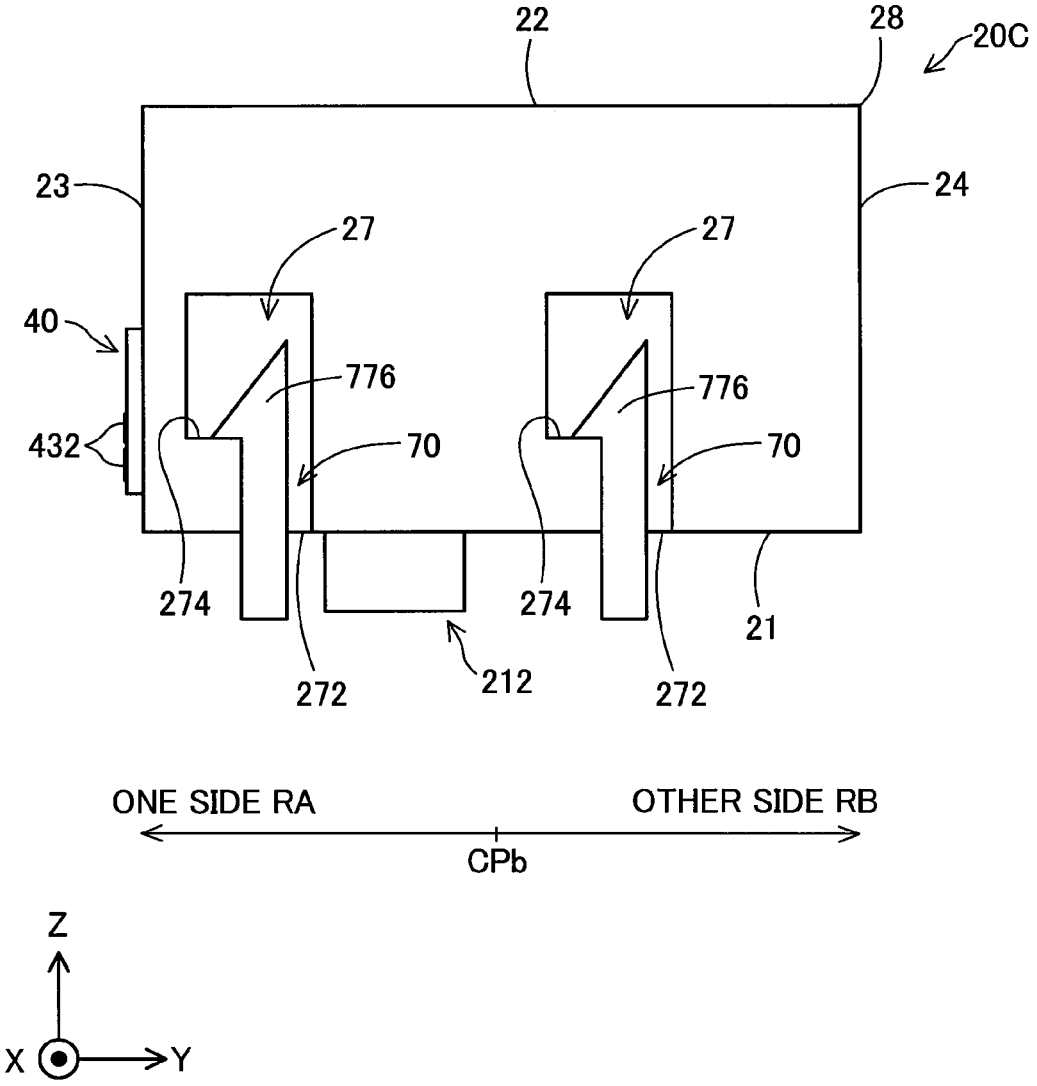
FIG. 10 is a schematic diagram for explaining a third modified aspect.

A-5-1c: Third Modified Aspect:

FIG. 10 is a schematic diagram for explaining a third modified aspect. Similar to FIG. 8, FIG. 10 illustrates a cartridge 20C and the engagement structure 70 as viewed from the positive X-axis direction side. To facilitate understanding in FIG. 10, the engaged structure 27 and the engagement structure 70 located closer to the negative X-axis direction than the sixth wall portion 26 are also illustrated. The cartridge 20C and the cartridge 20 (FIG. 5) according to the first embodiment differ from each other in terms of the number of engaged structures 27. In addition, the same number of engagement structures 70 as engaged structures 27 are provided in the holder unit 61. Other configurations of the liquid ejection system 1000 are the same as those according to the first embodiment, and hence like components are denoted by like reference symbols and a description thereof is omitted.

The cartridge 20C includes two engaged structures 27. As in the first modified aspect (FIG. 8), one engaged structure 27 is positioned between the liquid supply portion 212 and the contact portion 432 when the cartridge 20C is viewed in plan in a predetermined direction (positive Z-axis direction). Similar to the first embodiment (FIG. 7), the other engaged structure 27 is located closer to the fourth wall portion 24 than the liquid supply portion 212 when the cartridge 20C is viewed in plan in the predetermined direction (positive Z-axis direction). In other words, the two engaged structures 27 sandwich the liquid supply portion 212 in the first direction (Y-axis direction).

The third modified aspect has a similar configuration to that of the first embodiment and the modified aspects described above, and hence achieves a similar effect. In addition, according to the third modified aspect, by providing the cartridge 20C with a plurality of the engaged structures 27, the possibility of the cartridge 20C moving in the demounting direction in the mounted state can be reduced even further. In addition, according to the third modified aspect, the two engaged structures 27 are arranged so as to sandwich the liquid supply portion 212 in the first direction (Y-axis direction). With this configuration, external force received by the cartridge 20C from the liquid injecting needle 622 in the demounting direction can be dispersed to the two engaged portions 274. Therefore, connection between the liquid supply portion 212 and the liquid injecting needle 622 can be favorably maintained. As described above, according to the third modified aspect, the cartridge 20C can be mounted even more reliably.

A-5-2. Modified Aspects of Operation Unit:

In the above-described first embodiment, the operation unit used for releasing engagement between the engaged portion 274 and the engagement portion 776 is provided on the side of the printer 10, but the operation unit is not limited thereto and may be provided on, for example, the side of the cartridge 20. Modified aspects of the operation unit are described below.

Figure 11:
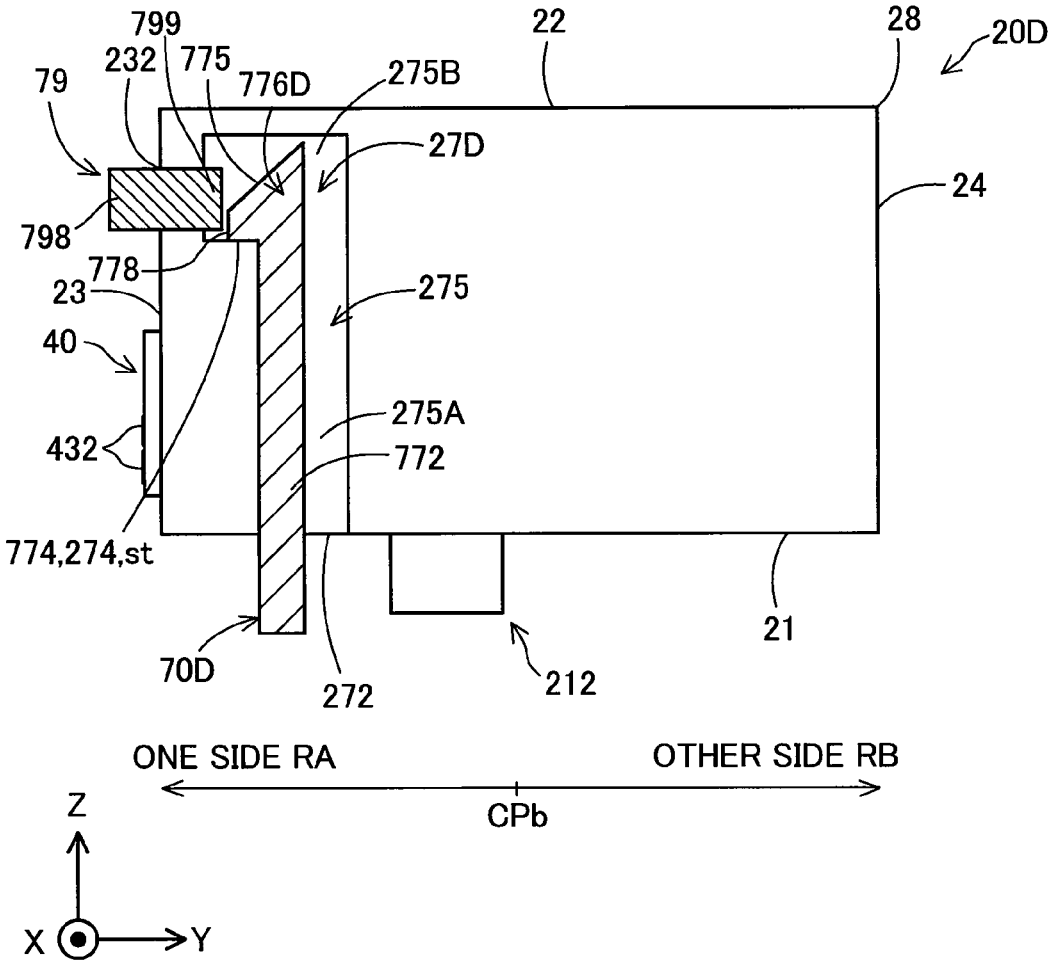
FIG. 11 is a schematic diagram for explaining a first modified aspect of an operation unit.

A-5-2a. First Modified Aspect of Operation Unit:

FIG. 11 is a schematic diagram for explaining a first modified aspect of the operation unit. Similar to FIG. 8, FIG. 11 is a view for illustrating a cartridge 20D and an engagement structure 70D as viewed from the positive X-axis direction side. To facilitate understanding in FIG. 11, an engaged structure 27D and the engagement structure 70D located closer to the negative X-axis direction than the sixth wall portion 26 are also illustrated. The cartridge 20D differs from the cartridge 20 (FIG. 5) according to the first embodiment in terms of the engaged structure 27D including a unit-side operation member 79, and the position of the opening 272 and the position of engagement st in the first direction (Y-axis direction). Other configurations of the liquid ejection system 1000 are the same as those according to the first embodiment, and hence like components are denoted by like reference symbols and a description thereof is omitted.

The opening 272 and the position of engagement st in the first direction (Y-axis direction) are located between the liquid supply portion 212 and the contact portion 432, similar to the cartridge 20A (FIG. 8) according to the first modified aspect. The engagement structure 70D has a cross zone 778 connected to the guideway 775 and the engagement forming surface 774. The cross zone 778 is a flat plane facing a direction that faces the one side RA in the first direction (Y-axis direction).

The engaged structure 27D newly includes the unit-side operation member 79. A unit-side operation member 79 is inserted into a through hole 232 that extends from the third wall portion 23 to the second receiving portion 275B. The unit-side operation member 79 is a columnar member that extends in the first direction (Y-axis direction). The unit-side operation member 79 is inserted into the through hole 232 so as to allow the unit-side operation member 79 to move within the through hole 232 in the first direction. In the mounted state, a one end (unit-side operation unit) 798 of the unit-side operation member 79 is located further outside than the outer shell 28 (first to sixth wall portions 21 to 26). In this modified aspect, the one end 798 protrudes outward from the third wall portion 23. The one end 798 is operated in order to release engagement between the engaged portion 274 and the engagement portion 776. Therefore, the one end 798 is also referred to as "unit-side operation unit 798." An other end (engagement release portion) 799 of the unit-side operation member 79 faces the cross zone 778 of an engagement portion 776D in the mounted state. The engagement release portion 799 comes into contact with the engagement portion 776D, to thereby move the engagement portion 776D in the release direction (positive Y-axis direction).

The unit-side operation member 79 is located at a position closer to the rear side portion 22 than the tip side portion 21 of the outer shell 28. To release engagement between the engaged portion 274 and the engagement portion 776D, the user moves the unit-side operation unit 798 in a direction (positive Y-axis direction) toward the cross zone 778, to thereby cause the engagement release portion 799 to come into contact with the engagement portion 776D and the engagement portion 776D to move toward the positive Y-axis direction (release direction). As a result, engagement between the engaged portion 274 and the engagement portion 776D is released.

The first modified aspect of the operation unit has a similar configuration to that of the first embodiment and the above-described modified aspects, and hence achieves a similar effect. In addition, according to the fourth modified aspect, by including the unit-side operation unit 798 in the engaged structure 27D, the user can operate the unit-side operation unit 798 to easily release engagement between the engaged portion 274 and the engagement portion 776D. Also according to the first modified aspect of the operation unit, the unit-side operation unit 798 is located closer to the rear side portion 22 than the tip side portion 21. With this configuration, the user can more easily operate the unit-side operation unit. In addition, the unit-side operation member 79 moves in a direction (first direction) orthogonal to the mounting direction. As a result, the engagement portion 776D can be easily moved in a direction (positive Y-axis direction) for releasing engagement.

Figure 12:
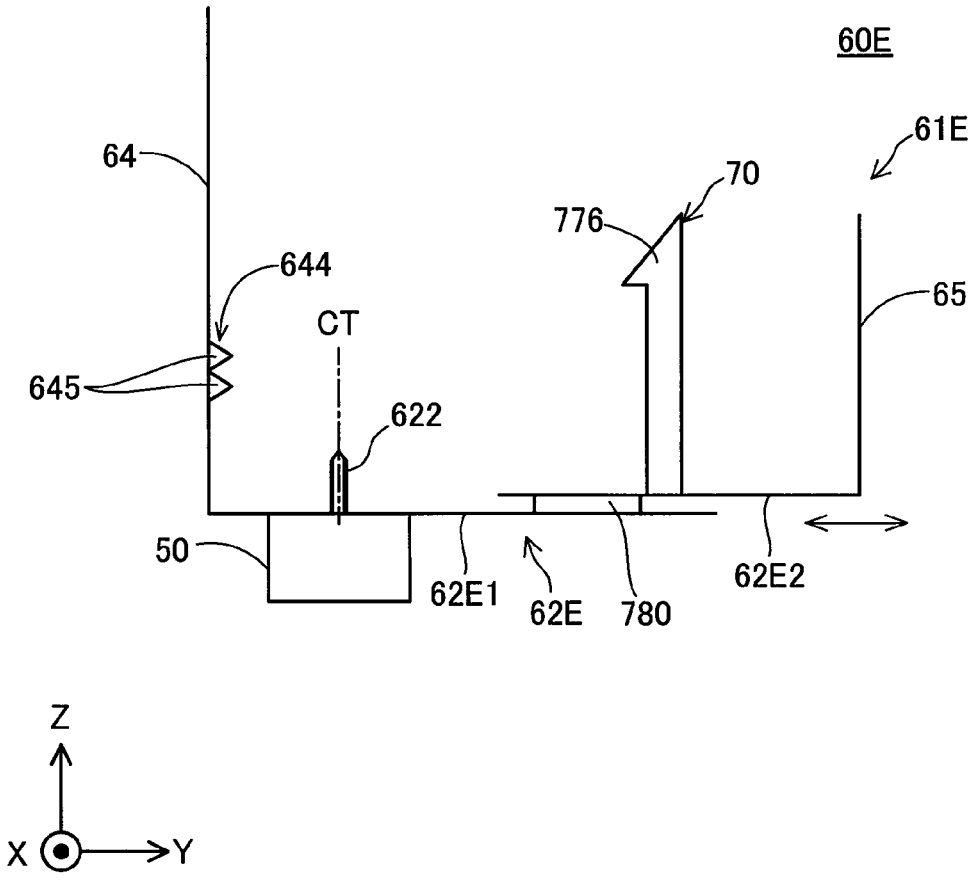
FIG. 12 is a schematic diagram for explaining a second modified aspect of the operation unit.

A-5-2b. Second Modified Aspect of Operation Unit:

FIG. 12 is a schematic diagram for explaining a second modified aspect of the operation unit. A carriage unit 60E and the carriage unit 60 (FIG. 3) according to the first embodiment differ from each other in that a mechanism for releasing engagement between the engagement portion 776 of the engagement structure 70 and the engaged portion 274 (FIG. 5) of the cartridge 20 is provided in a device front wall portion 62E of the carriage unit 60E. Other configurations of the liquid ejection system are the same as those according to the first embodiment, and hence like components are denoted by like reference symbols and a description thereof is omitted.

The device front wall portion 62E includes a fixed wall portion 62E1 and a moving wall portion 62E2. The moving wall portion 62E2 is configured to move in the Y-axis direction with respect to the fixed wall portion 62E1. For example, a rail 780 that extends in the Y-axis direction is provided on the fixed wall portion 62E1, and the moving wall portion 62E2 includes a protrusion provided inside the rail 780. With this configuration, the moving wall portion 62E2 can move in the Y-axis direction with respect to the fixed wall portion 62E1. The liquid injecting needle 622 is arranged inside the fixed wall portion 62E1, and the engagement structure 70 is arranged inside the moving wall portion 62E2. In the mounted state, the moving wall portion 62E2 is caused to move in the positive Y-axis direction, to thereby move the engagement portion 776 is the positive Y-axis direction. As a result, engagement between the engagement portion 776 and the engaged portion 274 (FIG. 5) is released. The moving wall portion 62E2 and another wall portion that moves in conjunction with the motion of the moving wall portion 62E2 (for example, the second side wall portion 65) function as an apparatus-side operation unit. For example, the user grasps the second-side wall portion 65 and moves the second-side wall portion 65 in the positive Y-axis direction, to thereby move the engagement portion 776 in the positive Y-axis direction and release engagement between the engaged portion 274 and the engagement portion 776. With this configuration, engagement between the engaged portion 274 and the engagement portion 776 can easily be released.

Figure 13:
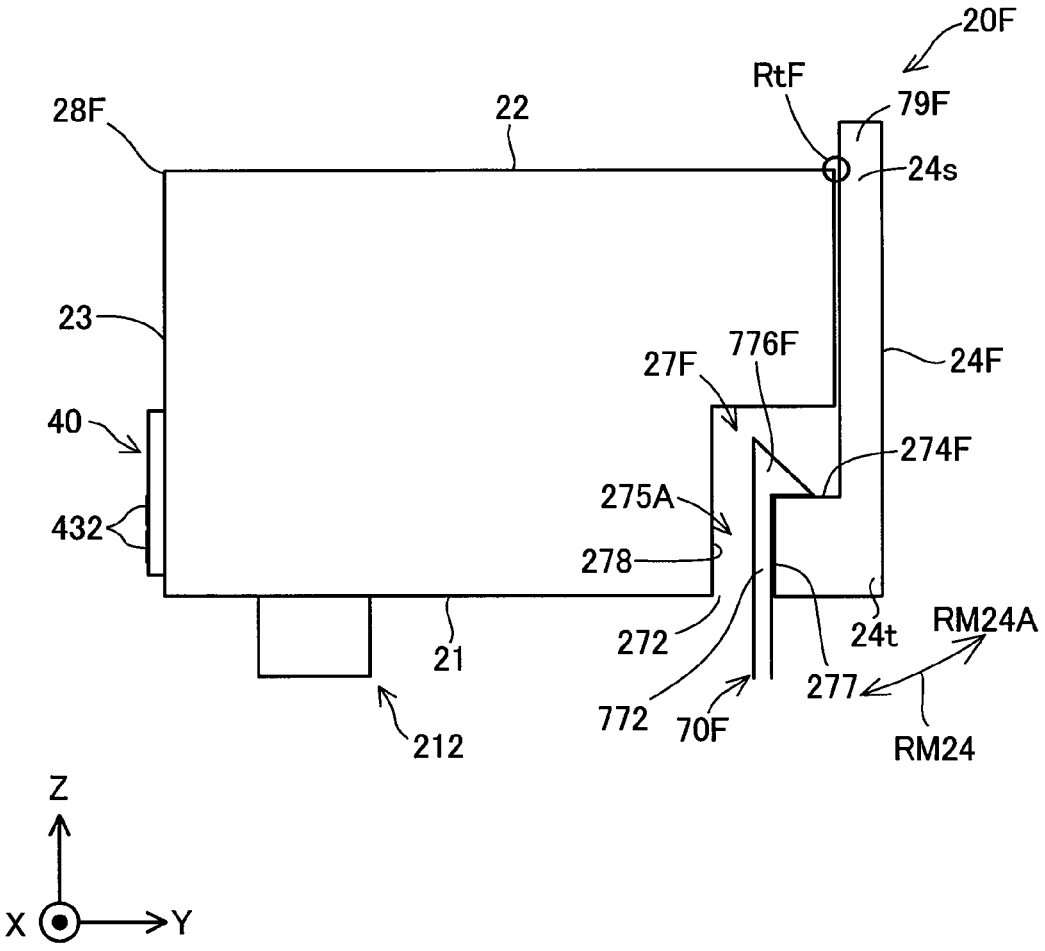
FIG. 13 is a schematic diagram for explaining a third modified aspect of the operation unit.

A-5-2c. Third Modified Aspect of Operation Unit:

FIG. 13 is a schematic diagram for explaining a third modified aspect of the operation unit. A cartridge 20F and the cartridge 20 (FIG. 5) according to the first embodiment differ from each other in terms of the configurations of an engaged structure 27F, a fourth wall portion 24F, and an engagement structure 70F. Other configurations of the liquid ejection system are the same as those according to the first embodiment, and hence like components are denoted by like reference symbols and a description thereof is omitted.

An engaged portion 274F of the engaged structure 27F is a surface of a side wall portion of the first receiving portion 275A that extends from the wall portion 277 opposed to the wall portion 278 in the positive Y-axis direction. The engaged portion 274F is a surface that faces the demounting direction (positive Z-axis direction), similar to that in the first embodiment.

An engagement portion 776F of the engagement structure 70F has a portion that protrudes from the main body portion 772 in the positive Y-axis direction. In other words, the engagement structure 70F has a configuration in which the engagement structure 70 (FIG. 3) according to the first embodiment has been rotated 180° about the Z-axis direction.

In the fourth wall portion 24F, an other end 24*t* of the fourth wall portion 24F located on the mounting direction side is rotatably supported by the second wall portion 22, with a one end 24*s* of the fourth wall portion 24F located on the demounting direction side as a fulcrum RtF. As indicated by the arrow RM24, the other end 24*t* rotates within a plane parallel to the Y-axis direction and the Z-axis direction. The fulcrum RtF is, for example formed of a hinge.

The unit-side operation unit 79F is connected to the one end 24*s*. The unit-side operation unit 79F protrudes outward from the one end 24*s*. The engaged portion 274F is connected to the fourth wall portion 24F. With this configuration, the unit-side operation unit 79F is operated, to thereby move the other end 24*t* side about the fulcrum RtF. The engaged portion 274F also moves by moving in conjunction with the motion of the movement of the other end 24*t* side. By moving the other end 24*t* outward as indicated by the arrow RM24A, the engaged portion 274F also moves outward (positive Y-axis direction). As a result, engagement between the engaged portion 274F and the engagement portion 776F is released.

As described above, according to the third modified aspect of the operation unit, by operating the unit-side operation unit 79F, the fourth wall portion 24F, which is a part of the outer shell 28F, is configured to move. In addition, the engaged portion 274F is connected to the fourth wall portion 24F such that the engaged portion 274F moves in conjunction with the motion of the fourth wall portion 24F. With this configuration, the engaged portion 274F can be easily moved, and hence engagement between the engaged portion 274F and the engagement portion 776F can be easily released due to the movement of the engaged portion 274F.

Figure 14:
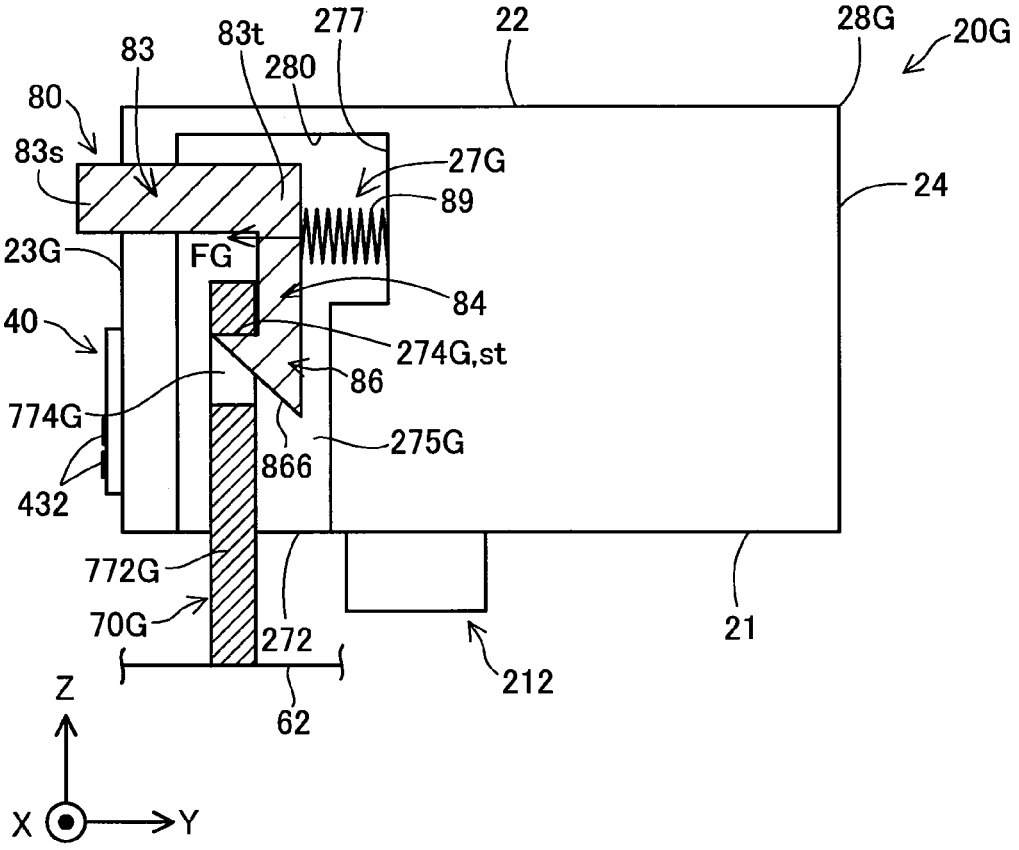
FIG. 14 is a schematic diagram for explaining a fourth modified aspect of the operation unit.

A-5-2d. Fourth Modified Aspect of Operation Unit:

FIG. 14 is a schematic diagram for explaining a fourth modified aspect of the operation unit. As in the first modified aspect (FIG. 8), the position of engagement st and the opening 272 are arranged between the liquid supply portion 212 and the contact portion 432 in the first direction (Y-axis direction). FIG. 14 is a view corresponding to a cross-sectional view along the line F2-F2 in the mounted state of a cartridge 20G, and schematically illustrates an outer shell 28G and the liquid supply portion 212 of the cartridge 20G.

The cartridge 20G and the cartridge 20 (FIG. 5) according to the first embodiment differ from each in terms of configurations of an engaged structure 27G and the engagement structure 70G. In addition, a third wall portion 23G of the cartridge 20G is different to the third wall portion 23 according to the first embodiment and is formed with a through hole (not shown) to allow insertion of the engaged member 80 to be described later. In addition, fourth modified aspect of operation unit and the first embodiment differ from each other in terms of the configuration of an engagement structure 70G. Other configurations of the liquid ejection system 1000 are the same as those according to the first embodiment, and hence like components are denoted by like reference symbols and a description thereof is omitted.

The engagement structure 70G is formed of a columnar member (main body portion 772G) that extends from the device front wall portion 62 in the demounting direction (positive Z-axis direction). In the mounted state, the main body portion 772G is arranged inside a receiving portion 275G, which is a concave portion formed in the first wall portion 21.

The engagement structure 70G has an engagement portion 774G. The engagement portion 774G is an opening located midway down the main body portion 772G and penetrates the main body portion 772G in the Y-axis direction. The engagement portion 774G may be a concave portion located midway down the main body portion 772G and formed into a side surface of the main body portion 772G. The engagement portion 774G as the concave portion receives an engaged portion 274G to be described later.

The engaged structure 27G includes the first opening 272, the receiving portion 275G formed inside the outer shell 28G, the engaged member 80, and a biasing member 89.

The receiving portion 275G is a concave portion formed in the wall portion 21. The first opening 272 is formed on a side opposed to the bottom surface 280 of the concave portion. One portion including the engaged portion 274G of the engaged member 80 and the biasing member 89 are arranged inside the receiving portion 275G.

The engaged member 80 includes a first member 83 inserted into the third wall portion 23G, a second member 84 having one end connected to the first member 83, and a third member 86 connected to another end of the second member 84.

The first member 83 is a columnar member that extends in the first direction (Y-axis direction). A one end 83*s* of the first member 83 is located further outside than the outer shell 28G (first to sixth wall portions 21 to 26) in the mounted state. In this modified aspect, the one end 83*s* protrudes outward from the third wall portion 23G. The one end 83*s* functions as a unit-side operation unit for releasing engagement between the engaged portion 274G and the engagement portion 774G. Therefore, the one end 83*s* is also referred to as "unit-side operation unit 83*s*". An other end 83*t* of the first member 83 is arranged inside the receiving portion 275G.

The second member 84 is a columnar member that extends from the other end 83*t* of the first member 83 in the mounting direction (negative Z-axis direction). The second member 84 is arranged inside the receiving portion 275G. The biasing member 89 is a compression coil spring. One end of the biasing member 89 is located in the wall portion 277 that opposes the second member 84 in the side wall portion that forms the receiving portion 275G. Another end of the biasing member 89 is located in the second member 84. The biasing member 89 biases the engaged member 80 from the fourth wall portion 24 toward a direction (negative Y-axis direction) that faces the third wall portion 23G. The negative Y-axis direction is a direction (locking direction) opposite to a direction in which engagement between the engaged portion 274G and the engagement portion 774G is released.

The third member 86 is a member connected to an end (other end) of the second member 84 on the mounting direction side. The third member 86 includes an engagement guiding portion 866 and the engaged portion 274G. The engaged portion 274G is formed by a protrusion (part of the third member 86) that protrudes from the second member 84 in the negative Y-axis direction. The engaged portion 274G is a surface that faces the demounting direction.

In the process of mounting the cartridge 20G, the engagement guiding portion 866 guides the engagement portion 774G to the engaged portion 274G. The engagement guiding portion 866 is a surface that faces a direction including a mounting direction (negative Z-axis direction) component and a one side RA direction (negative Y-axis direction) component in the first direction. In the process of mounting the cartridge 20G, the engagement guiding portion 866 moves in the mounting direction (negative Z-axis direction) while coming into contact with an end (one end) of the end main body portion 772G located on the demounting direction side. As a result, the engaged member 80 is subject to an external force having a positive Y-axis direction component from the one end of the main body portion 772G. Due to this external force, the engaged member 80 moves in the positive Y-axis direction against biasing force of the biasing member 89. In addition, the engaged portion 274G reaches the engagement portion 774G by the cartridge 20G being moved in the mounting direction. When the engaged portion 274G has reached the engagement portion 774G, a biasing force FG of the biasing member 89 causes the engaged member 80 to move in the negative Y-axis direction. With this configuration, as illustrated in FIG. 14, the engaged portion 274G and the engagement portion 774G engage with each other.

When releasing engagement between the engaged portion 274G and the engagement portion 774G, the user moves the unit-side operation unit 83*s* in the positive Y-axis direction against the biasing force of the biasing member 89. As a result, the engaged portion 274G moves in the positive Y-axis direction, which is a direction in which engagement is released, and engagement between the engaged portion 274G and the engagement portion 774G is released.

The above-described fourth modified aspect of the operation unit has a similar configuration to that of the first embodiment and the modified aspects described above, and hence achieves a similar effect. In addition, according to this modified aspect, the engagement portion 774G is formed by a protrusion (third member 86) that can engage with the engaged portion 274G, which is an opening. With this configuration, the engaged portion 274G can be formed with a simple structure. In addition, according to the fourth modified aspect, in the mounted state, the biasing force FG applied to the engaged member 80 by the biasing member 89 is a force for moving the engaged portion 274G in a direction (negative Y-axis direction, locking direction) opposite to the direction in which engagement between the engaged portion 274G and the engagement portion 774G is released. With this configuration, in the mounted state, the possibility of engagement between the engaged portion 274G and the engagement portion 774G releasing can be reduced. In addition, in the process of mounting the cartridge 20G onto the printer 10, the engaged portion 274G is configured to move by coming into contact with the engagement structure 70G. As a result, the engaged portion 274G can be easily moved. Therefore, operability of mounting the cartridge 20G onto the holder unit 61 can be improved.

Figure 15:
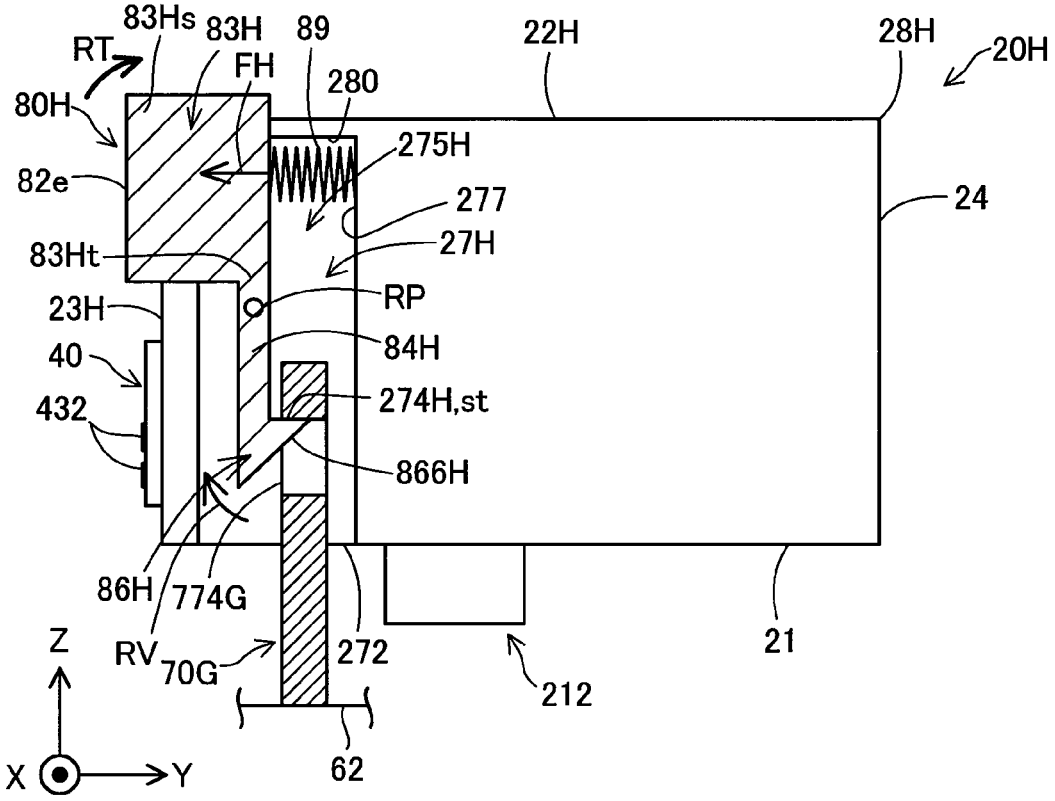
FIG. 15 is a schematic diagram for explaining a fifth modified aspect of the operation unit.

A-5-2e. Fifth Modified Aspect of Operation Unit:

FIG. 15 is a schematic diagram for explaining a fifth modified aspect of the operation unit. As in the first modified aspect (FIG. 8), the position of engagement st and the opening 272 are arranged between the liquid supply portion 212 and the contact portion 432 in the first direction (Y-axis direction). FIG. 15 is a view corresponding to a cross-sectional view (FIGS. 2 and 3) along the line F2-F2 in the mounted state of a cartridge 20H, and schematically illustrates an outer shell 28H and the liquid supply portion 212 of the cartridge 20H. The cartridge 20H differs from the cartridge 20G (FIG. 14) according to the fourth modified aspect in terms of an aspect of movement of an engaged member 80, 80H for engaging and releasing engagement between the engaged member 80, 80H and the engagement portion 774G. The engaged portion 274H having the engaged member 80H according to this modified aspect rotates about a fulcrum RP, to thereby release engagement with the engagement portion 774G. Other configurations of the liquid ejection system 1000 are the same as the those of the fourth modified aspect of the operation unit, and hence like components are denoted by like reference symbols and a description thereof is omitted.

The engaged structure 27H includes the first opening 272, a receiving portion 275H formed inside the outer shell 28H, the engaged member 80H and the biasing member 89.

The receiving portion 275H is a concave portion formed in the first wall portion 21. The first opening 272 is formed on a side opposed to the bottom surface 280 of the concave portion. One portion including the engaged member 274H of the engaged member 80H and the biasing member 89 are arranged inside the receiving portion 275H.

The engaged member 80H includes a first member 83H, a second member 84H connected to one end of the first member 83H, and a third member 86H connected to another end of the second member 84H.

The first member 83H is a substantially cuboid member. The first member 83H is arranged in an opening in the outer shell 28H formed across a third wall portion 23H and a second wall portion 22H. This opening is connected to the receiving portion 275H. A one end corner portion 83H of the first member 83H is arranged further outside than the outer shell 28H. In this modified aspect, the one end corner portion 83H of the first member 83H protrudes outward from the second wall portion 22H and the third wall portion 23H. The one end corner portion 83H of the first member 83H can also be regarded as being arranged across the second wall portion 22H and the third wall portion 23H. The one end corner portion 83Hs functions as a unit-side operation unit that releases engagement between the engaged portion 274H and the engagement portion 774H. Therefore, the one end corner portion 83Hs is also referred to as "unit-side operation unit 83Hs". An other end corner portion 83Ht of the first member 83 at a diagonal position of the unit-side operation unit 83Hs is arranged within the receiving portion 275H.

The biasing member 89 is a compressed coil spring. The biasing member 89 applies a biasing force FH toward the negative Y-axis direction to the first member 83H. The biasing force FH is a force for moving the engaged portion 274H in a direction (positive Y-axis direction, locking direction) opposite to a direction in which engagement between the engaged portion 274H and the engagement portion 774G is released. With this configuration, the possibility of engagement between the engaged portion 274H and the engagement portion 774G releasing in the mounted state can be reduced.

The second member 84H is a columnar member that extends from the other end corner portion 83Ht of the first member 83H in the mounting direction (negative Z-axis direction). The second member 84H is arranged in the receiving portion 275H. The second member 84H is rotatably supported by a shaft forming member such as a pin at wall portions on both sides of the receiving portion 275H in the X-axis direction. With this configuration, the second member 84H forms a fulcrum RP for causing the engaged member 80H to rotate in a plane parallel to the Y-axis direction and the Z-axis direction.

The third member 86H has a configuration in which the third member 86 (FIG. 14) according to the fourth modified aspect of the operation unit has been rotated 180° about the Z-axis direction. In other words, the third member 86H includes an engagement guiding portion 866H and the engaged portion 274H. The engagement guiding portion 866H and the engaged portion 274H correspond to the engagement guiding portion 866 and the engaged portion 274G (FIG. 14) according to the fourth modified aspect, respectively.

When releasing engagement between the engaged portion 274H and the engagement portion 774G, the user moves the unit-side operation unit 83Hs in the direction of an arrow RT against the biasing force of the biasing member 89. As a result, the engaged portion 274H rotates in an engagement release direction (arrow RV) about the fulcrum RP to release engagement between the engaged portion 274H and the engagement portion 774G.

The above-described fifth modified aspect of the operation unit has a similar configuration to that of the first embodiment the modified aspects described above, and hence achieves a similar effect. In addition, according to this modified aspect, by operating the unit-side operation unit 83Hs, engagement between the engaged portion 274H and the engagement portion 774G can be easily released.

In the modified aspects of the operation unit illustrated in FIGS. 14 and 15, the unit-side operation unit 83*s*, 83Hs (FIGS. 14 and 15) are preferably arranged on the rear side portion 22, 22H that opposes the tip side portion 21 and is located on the demounting direction side, rather than on the tip side portion 21 of the outer shell 28G, 28H. With this configuration, the user can more easily operate the unit-side operation unit 83*s*, 83Hs.

Figure 16:
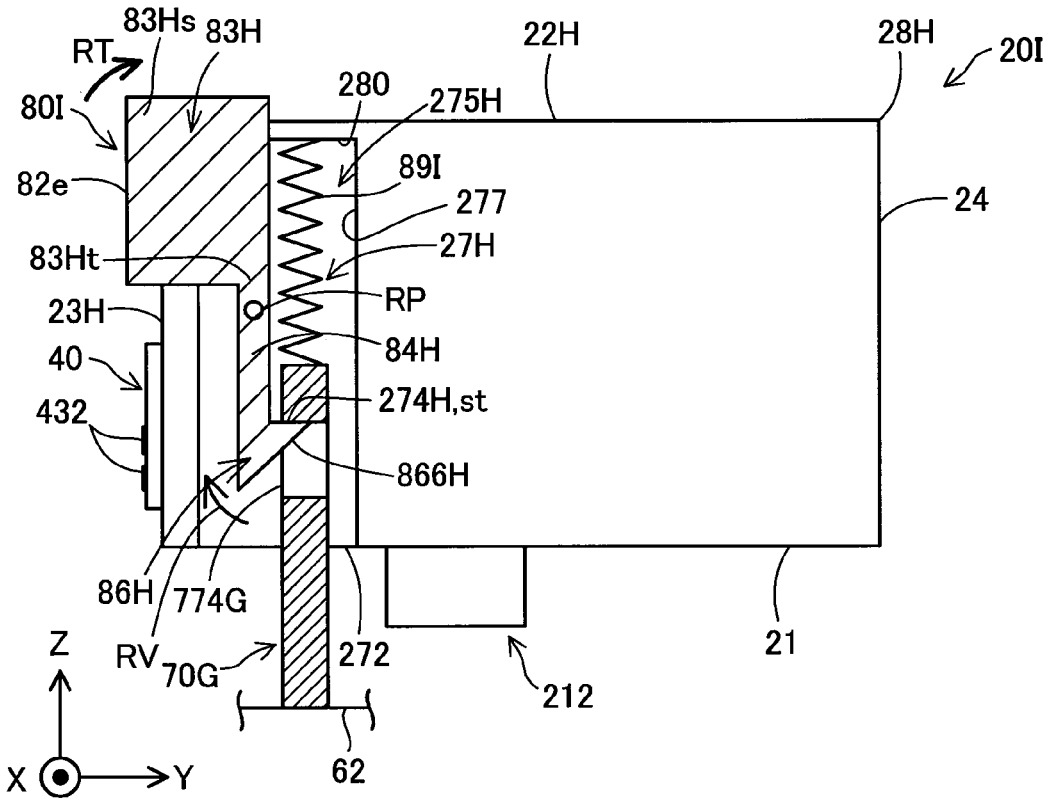
FIG. 16 is a schematic diagram for explaining a sixth modified aspect of the operation unit.

A-5-2f. Sixth Modified Aspect of Operation Unit:

FIG. 16 is a schematic diagram for explaining a sixth modified aspect of the operation unit. The sixth modified aspect differs from the fifth modified aspect of the operation unit in terms of a position of arrangement of a biasing member 89I. Other configurations are the same as those according to the fifth modified aspect, and hence like components are denoted by like reference symbols and a description thereof is omitted.

An engaged member 80I includes the biasing member 89I. The biasing member 89I is a compressed coil spring. One end of the biasing member 89I is arranged on the bottom surface 280 of the receiving portion 275H. In the mounted state of a cartridge 20I, the engagement structure 70G is biased toward the mounting direction (negative Z-axis direction). In other words, in the mounted state of the cartridge 20I, the cartridge 20I is subject to an external force directed in the demounting direction (positive Z-axis direction) from the engagement structure 70G as reaction force of the biasing member 89I.

The sixth modified aspect of the operation unit has a similar configuration to that of the first embodiment and the modified aspects described above, and hence achieves a similar effect. In addition, according to this modified aspect, the cartridge 20I includes the biasing member 89I that biases the outer shell 28H toward the demounting direction (positive Z-axis direction) in the mounted state. With this configuration, the unit-side operation unit 83Hs is made to rotate in the direction of an arrow Rt and, when engagement between the engaged portion 274H and the engagement portion 774G has been released, the outer shell 28H moves toward the demounting direction due to the biasing force of the biasing member 89I. As a result, operability when demounting the cartridge 20I from the holder unit 61 can be improved.

The contact portion 432 and a member (sealing portion 29A) located inside the liquid supply portion 212 make contact with corresponding portions (holder-side terminals 645 and liquid injecting needle 622) of the holder unit 61, respectively. Therefore, frictional force is generated at the portions that make contact when the outer shell 28H moves along the mounting direction. Here, in this modified aspect, in the first direction (Y-axis direction), the biasing member 89I is arranged between the contact portion 432 and the liquid supply portion 212. With this configuration, the outer shell 28H can be reliably moved toward the demounting direction due to the biasing force of the biasing member 89I against the frictional force that is generated when the outer shell 28H moves toward the demounting direction.

A-5-3. Modified Aspect of Engaged Portion:

In the above-described first embodiment, the engaged portion 274 is a surface that faces the demounting direction (positive Z-axis direction) (FIG. 5), but the engaged portion 274 is not limited thereto and may have a configuration that can engage with the engagement portion 776 to restrict movement of the cartridge 20 in the demounting direction, or another configuration.

Figure 17:
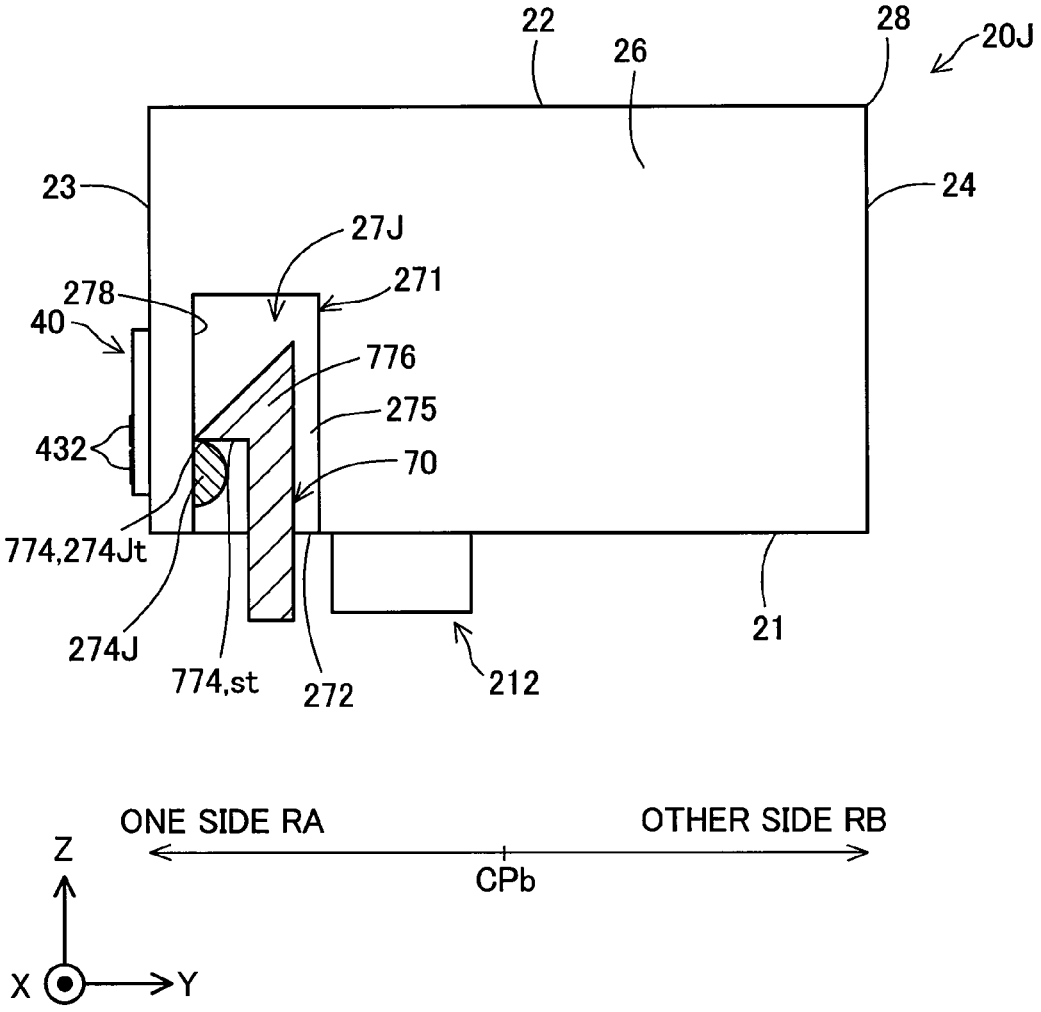
FIG. 17 is a diagram for explaining a modified aspect of an engaged portion.

FIG. 17 is a diagram for explaining a modified aspect of an engaged portion 274J. The cartridge 20 according to the modified aspect illustrated in FIG. 17 and the cartridge 20A according to the modified aspect illustrated in FIG. 8 differ from each other in terms of shape of the engaged portion 274J. Other configurations of the liquid ejection system 1000 are the same as those according to the modified aspect illustrated in FIG. 8, and hence like components are denoted by like reference symbols and a description thereof is omitted.

The engaged portion 274J has a function of releasing engagement with the engagement portion 776 in addition to a function of engaging with the engagement portion 776. The engaged portion 274J is a hemispherical member provided in the wall portion 278 of the receiving portion 275. In the process of mounting a cartridge 20J onto the holder unit 61, the engagement portion 776 comes into contact with a spherical surface that forms an outer surface of the engaged portion 274J. With this configuration, a demounting direction side end of the engagement structure 70 moves in the direction of engagement release (positive Y-axis direction). In addition, through the cartridge 20J moving in the mounting direction, the engagement forming surface 774 reaches a demounting direction side end 274Jt of the engaged portion 274J. With this configuration, the engagement forming surface 774 engages with the demounting direction side end 274Jt of the engaged portion 274J. A normal vector of the demounting direction side end 274Jt is oriented in the demounting direction (positive Z-axis direction).

When demounting the cartridge 20J from the holder unit 61, the cartridge 20J is moved toward the demounting direction (positive Z-axis direction). With this configuration, the engagement portion 776 comes into contact with the spherical surface that forms the outer surface of the engaged portion 274J, to thereby move in the direction of engagement release (positive Y-axis direction). As a result, engagement between the engagement forming surface 774 and the demounting direction side end 274Jt is released.

This modified aspect has a similar configuration to that of the first embodiment and the modified aspects described above, and hence achieves a similar effect. In addition, according to this modified aspect, engagement between the engaged portion 274J and the engagement portion 776 can be released using a member separate to the engaged portion 274J.

A-5-4. Other Modified Aspects of First Embodiment:

The first embodiment and each above-described modified aspect may be combined with one another. For example, the engagement structure 70B illustrated in FIG. 9 may be used in place of the two engagement structures 70 illustrated in FIG. 10. Further, for example, the unit-side operation member 79 of the cartridge 20D illustrated in FIG. 11 may be used for the cartridge 20B illustrated in FIG. 9.

In addition, the unit-side operation unit 798, 79F, 83*s*, 83Hs (FIGS. 11, 13, 14 and 15) described in the modified aspects is preferably arranged at a position exposed from the holder unit 61 in the mounted state of the cartridge 20D, 20F, 20G, 20H. With this configuration, the user can easily operate the unit-side operation unit 798, 79F, 83*s*, 83Hs.

B. Second Embodiment

Figure 18:
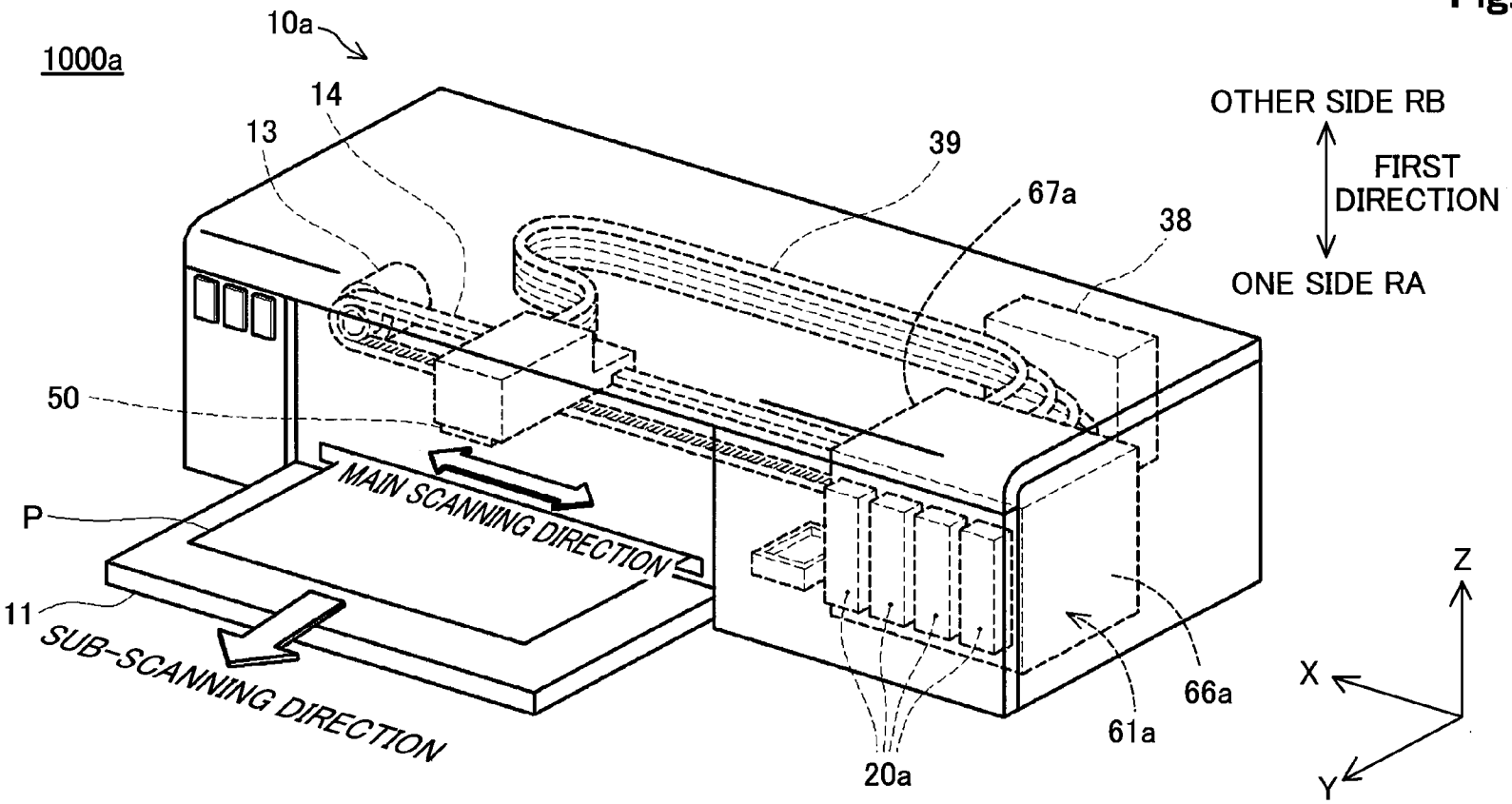
FIG. 18 is a perspective view for illustrating a configuration of a liquid ejection system according to a second embodiment.

B-1. Configuration of Liquid Ejection System:

FIG. 18 is a perspective view for illustrating the configuration of a liquid ejection system 1000*a* according to a second embodiment of the present invention. The liquid ejection system 1000*a* and the liquid ejection system 1000 (FIG. 1) differ from each other in that the liquid ejection system 1000*a* is an off-carriage printer 10*a* and a cartridge 20*a* has a different configuration. In addition, the mounting direction and the demounting direction of the cartridge 20*a* is a horizontal direction and, in this embodiment, is a direction along the Y-axis direction. Other configurations are the same as those according to the first embodiment, and hence like components are denoted by like reference symbols and a description thereof is omitted. Although not shown in FIG. 18, the printer 10*a* includes the flexible cable 37 (FIG. 1) as in the first embodiment.

The printer 10*a* includes a tube 39 for distributing ink stored in the cartridge 20*a* to the head unit 50. The ink is supplied to the head unit 50 by intaking the ink in the cartridge 20*a* using a pumping mechanism (not shown) of the printer 10*a*. The holder unit 61*a* is configured such that four cartridges 20*a* can be mounted thereon. In the second embodiment, the mounting direction of the cartridge 20*a* is the negative Y-axis direction, and the demounting direction of the cartridge 20*a* is the positive Y-axis direction. In addition, in the second embodiment, the first direction is the Z-axis direction, the one side RA is on the negative Z-axis direction side, and the other side RB is on the positive Z-axis direction side.

Figure 19:
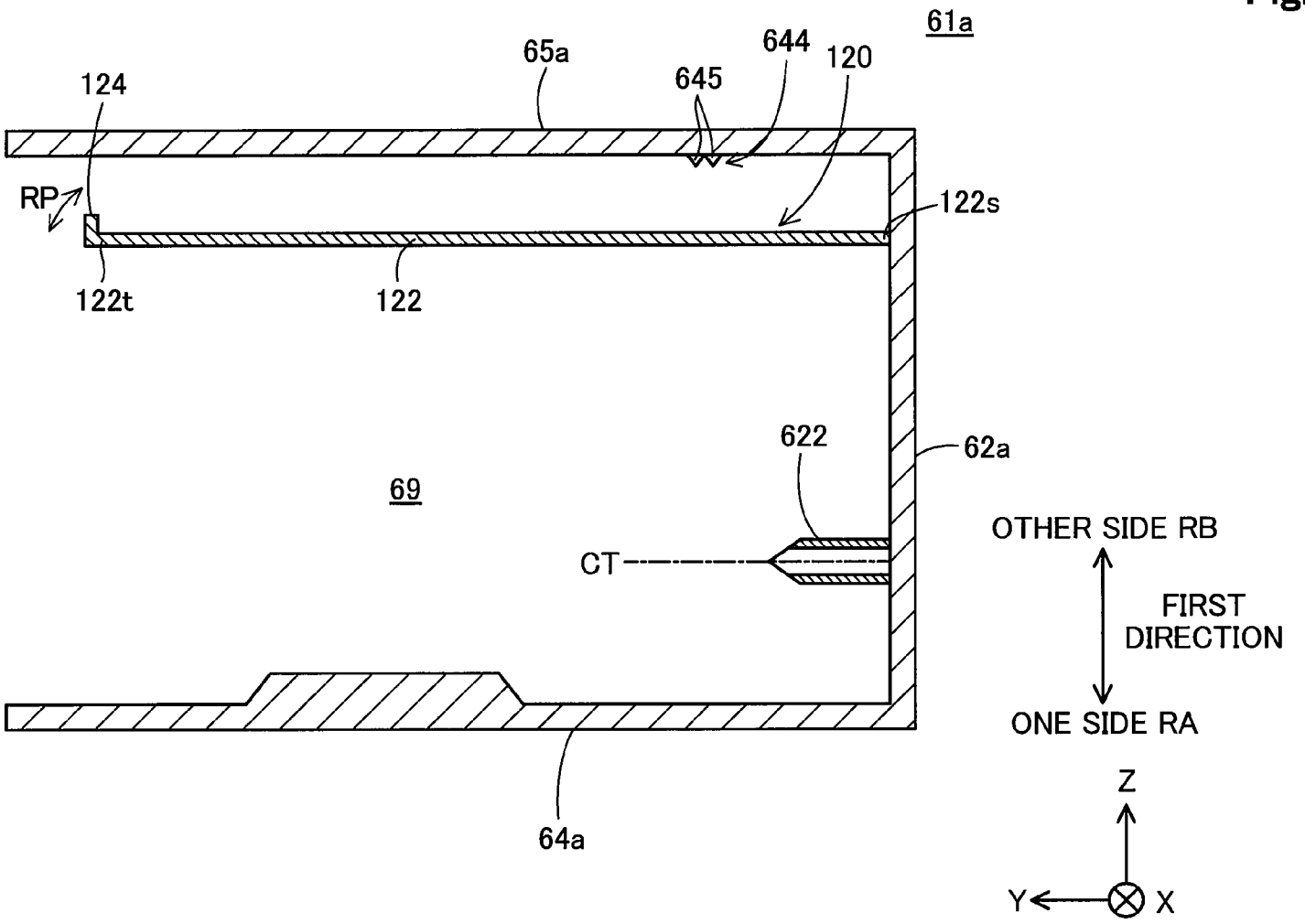
FIG. 19 is a diagram for explaining the holder unit.

FIG. 19 is a diagram for explaining the holder unit 61*a*. The holder unit 61*a* includes five wall portions 62*a*, 64*a*, 65*a*, 66*a* and 67*a* (FIGS. 18 and 19). These five wall portions 62*a*, 64*a*, 65*a*, 66*a* and 67*a* correspond to the five wall portions 62, 64, 65, 66 and 67 according to the first embodiment, respectively. In other words, the wall portion 62*a* is located on the mounting direction (negative Y-axis direction) side. In the second embodiment, the wall portion 64*a* forms a bottom wall of the holder unit 61*a*. The four wall portions 64*a*, 65*a*, 66*a* and 67*a* extend from a periphery edge portion of the wall portion 62*a* in the positive Y-axis direction (demounting direction). The five wall portions 62*a*, 64*a*, 65*a*, 66*a* and 67*a* form the concave cartridge storage chamber 69. The cartridge storage chamber 69 is divided into a plurality of slots (mounting spaces) that can each receive one cartridges 20*a*.

The wall portion 62*a* is also referred to as "device front wall portion 62*a*," the wall portion 64*a* is also referred to as "first side wall portion 64*a*," the wall portion 65*a* is also referred to as "second side wall portion 65*a*," the wall portion 66*a* is also referred to as "third side wall portion 66*a*," and the wall portion 67*a* is also referred to as "fourth side wall portion 67*a*."

For every slot, the holder unit 61*a* includes the liquid injecting needle 622, an engagement structure 120 and the electrode portion 644. Unlike the first embodiment, the liquid injecting needle 622 protrudes from the wall portion 62*a* in the positive Y-axis direction. In addition, the central axis CT of the liquid injecting needle 622 extends in the Y-axis direction. The electrode portion 644 is provided on the second side wall portion 65*a* that forms an upper wall. In the mounted state of the cartridge 20*a*, the holder-side terminals 645 of the electrode portion 644 bias the cartridge 20*a* toward the negative Z-axis direction.

The holder unit 61*a* is arranged in the vicinity of the liquid injecting needle 622, and a biasing member (for example, a coil spring) for biasing the cartridge 20*a* toward the demounting direction in the mounted state of the cartridge 20*a* may be provided. With this configuration, the possibility of engagement between a second engaged portion 642*a* and a second engagement portion of the cartridge 20*a*, both to be described later, unintentionally releasing can be reduced.

The engagement structure 120 is a plate-shaped member that extends from the device front wall portion 62*a* in the demounting direction (positive Y-axis direction). The engagement structure 120 includes a main body portion 122 that extends from the device front wall portion 62*a* in the demounting direction, and an engagement portion 124 connected to an end (demounting direction side end) of the main body portion 122. The engagement structure 120 may be, for example, molded integrally with the device front wall portion 62*a* out of a synthetic resin, or molded as a member separate to the device front wall portion 62*a*.

A one end 122*s* of the main body portion 122 is connected to the device front wall portion 62*a*. The main body portion 122 elastically deforms such that an other end 122*t* of the main body portion 122 can move about the one end 122*s* due to external force in the direction RP including a Z-axis direction component. The external force applied to the main body portion 122 is, for example, force that is applied as a result of the engagement structure 120 coming into contact with the cartridge 20*a* in the process of mounting the cartridge 20*a*.

The engagement portion 124 is a protrusion connected to the other end 122*t* of the main body portion 122. The engagement portion 124 protrudes from the other end 122*t* of the main body portion 122 in a direction (positive Z-axis direction) orthogonal to the demounting direction (positive Y-axis direction) and that extends from the first side wall portion 64*a* to the second side wall portion 65*a*. The engagement portion 124 can engage with the cartridge 20*a* (more specifically, an engaged portion to be described later) in the mounted state in which the cartridge 20*a* is mounted onto the holder unit 61*a*. Through the engagement portion 124 and the engaged portion of the cartridge 20*a* engaging with each other, movement of the cartridge 20*a* in the demounting direction (positive Y-axis direction) in the mounted state is restricted.

Figure 20:
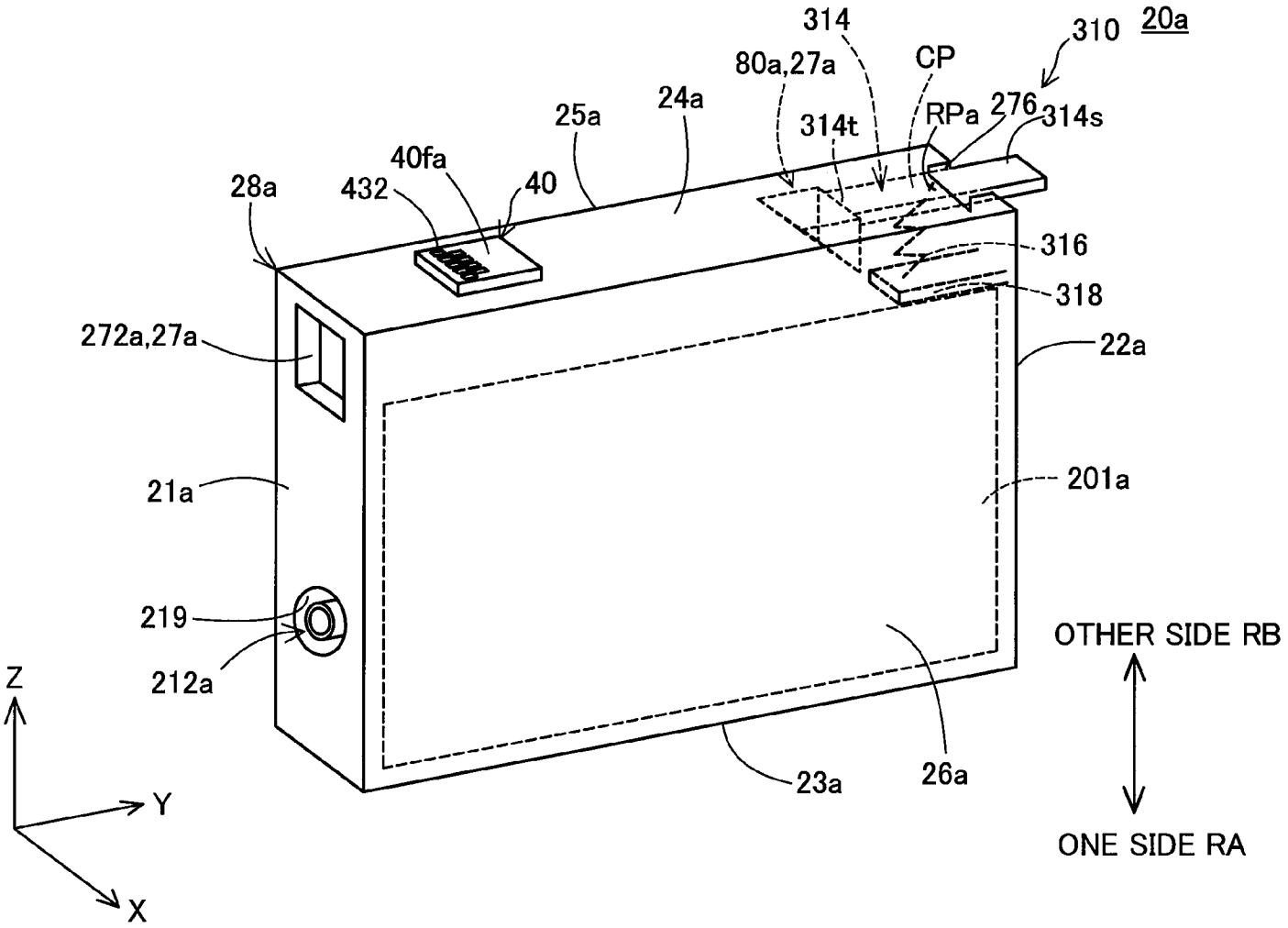
FIG. 20 is a perspective view for illustrating the cartridge.
Figure 21:
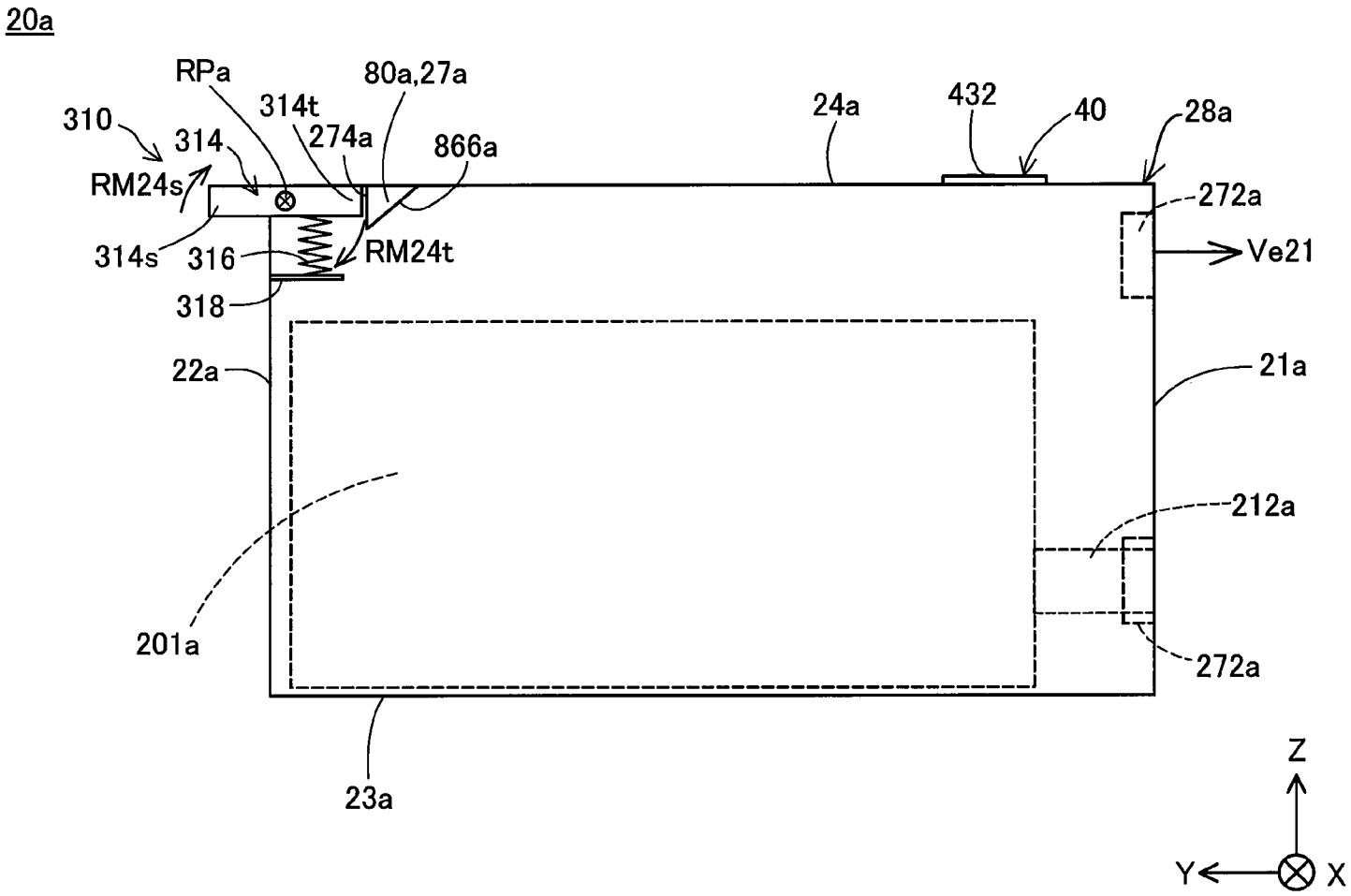
FIG. 21 is a schematic diagram for primarily explaining an internal configuration of the cartridge.

B-2. Configuration of Cartridge:

FIG. 20 is a perspective view of the cartridge 20*a*. FIG. 21 is a schematic diagram for primarily explaining an internal configuration of the cartridge 20*a*. The cartridge 20*a* (FIG. 20) includes an outer shell 28*a*, an engaged structure 27*a*, a liquid storage portion 201*a*, the circuit substrate 40, a liquid supply portion 212*a* and a unit-side operation structure 310. The liquid storage portion 201*a* is a bag member stored in the outer shell 28*a*. The ink is filled into this bag member.

The outer shell 28*a* (FIG. 20) forms an outer surface having a substantially quadrangular cylindrical shape or a substantially cuboid shape. As in the first embodiment, the outer shell 28*a* includes first to sixth wall portions 21*a* to 26*a*. The first to sixth wall portions 21*a* to 26*a* correspond to the first to sixth wall portions 21 to 26 (FIG. 4) according to the first embodiment, respectively. In other words, the first wall portion 21*a* forms a tip side portion of the cartridge 20*a*. In this embodiment, as in the first embodiment, the first wall portion 21*a* faces the mounting direction (negative Y-axis direction). The second wall portion 22*a* opposes the first wall portion 21*a* and is located on the demounting direction (positive Y-axis direction) side. The third wall portion 23*a* is located on the one side RA (negative Z-axis direction side) in the first direction (Z-axis direction). The fourth wall portion 24*a* opposes the third wall portion 23*a* and is located on the other side RB (positive Z-axis direction side) in the first direction. The fifth wall portion 25*a* and the sixth wall portion 26*a* form both side surfaces in the second direction (X-axis direction) orthogonal to the mounting direction and the first direction. An opening 276 (described later) that allows a unit-side operation unit 314*s* to move is formed at a corner portion at which the second wall portion 22*a* and the fourth wall portion 24*a* intersect with each other. In addition, the first wall portion (tip side portion) 21*a* is a portion that faces the device front wall portion 62*a* provided with the liquid injecting needle 622.

In the outer shell 28*a*, dimensions of a direction (X-axis direction) in which the fifth wall portion 25*a* and the sixth wall portion 26*a* oppose each other are preferably smaller than dimensions of a direction (Y-axis direction) in which the first wall portion 21*a* and the second wall portion 22*a* oppose each other and dimensions of a direction (Z-axis direction) in which the third wall portion 23*a* and the fourth wall portion 24*a* oppose each other. In other words, a distance between the third wall portion 23*a* and the fourth wall portion 24*a* is longer than a distance between the fifth wall portion 25*a* and the sixth wall portion 26*a*.

A supply unit arrangement port 219 used to arrange the liquid supply portion 212*a* is formed in the first wall portion 21*a*. The supply unit arrangement port 219 is located on the one side RA.

The liquid supply portion 212*a* can connect with the liquid injecting needle 622 (FIG. 19). The liquid supply portion 212*a* communicates with the liquid storage portion 201*a*. The liquid supply portion 212*a* is arranged in the supply unit arrangement port 219. As in the first embodiment, the valve mechanism 29 (FIG. 5) is provided inside the liquid supply portion 212*a*. This valve mechanism 29 may be omitted.

The circuit substrate 40 is arranged on the fourth wall portion 24*a*. A normal vector of the front surface 40*fa* of the circuit substrate 40 is oriented in the positive Z-axis direction. A plurality of unit-side terminals (contact portions) 432 are provided on the front surface 40*fa* of the circuit substrate 40.

The engaged structure 27*a* (FIG. 20) includes a first opening 272*a* and an engaged member 80*a*. The first opening 272*a* is an opening formed in the first wall portion 21*a*. The first opening 272*a* opens so as to allow the main body portion 122 of the engagement structure 120 to be inserted there through. The first opening 272*a* opens in the mounting direction (negative Y-axis direction). This opening direction is the orientation of a normal vector Ve21 (FIG. 21) of an opening surface of the first opening 272*a* from the inside to the outside of the cartridge 20*a*.

The engaged member 28*a* is a member disposed on an inner surface of the fourth wall portion 24*a*. In other words, the engaged member 80*a* is a protrusion that protrudes from the fourth wall portion 24*a* to inside the outer shell 80*a*. As illustrated in FIG. 21, the engaged member 80*a* includes an engagement guiding portion 866*a* and an engaged portion 274*a*.

The engagement guiding portion 866*a* guides the engagement portion 124 to the engaged portion 274*a* in the process of mounting the cartridge 20*a*. The engagement guiding portion 866*a* is a surface that faces a direction including a one side RA direction (negative Z-axis direction) component in the first direction and a mounting direction (negative Y-axis direction) component.

The engaged portion 274*a* can engage with the engagement portion 124 (FIG. 19) of the printer 10*a*. The engagement portion 124 is a surface connected to a demounting direction (positive Y-axis direction) side end of the engagement guiding portion 866*a*. The engagement portion 124 is a surface that faces the demounting direction (positive Y-axis direction). The engaged portion 274*a* is arranged further inward than the outer surface of the outer shell 28*a* of the cartridge 20*a*. In other words, the engaged portion 274*a* is arranged within a region surrounded by the outer surface of the outer shell 28*a*.

The unit-side operation structure 310 (FIG. 20) includes a unit-side operation member 314 and a biasing member 316. The unit-side operation member 314 is a plate-shaped member. The unit-side operation member 314 extends in the mounting direction (negative Y-axis direction). The unit-side operation member 314 is located at a position facing the engaged member 80*a* closer to the demounting direction (positive Y-axis direction) side than the engaged member 80*a*. The one end 314*s* of the unit-side operation member 314 protrudes outward from the second wall portion 22*a*. In other words, the one end 314*s* is arranged on the second wall portion 22*a* (rear end portion 22*a*). An other end 314*t* of the unit-side operation member 314 faces the engaged member 80*a*. The one end 314*s* is operated by the user in order to release engagement between the engaged portion 274*a* and the engagement portion 124. More specifically, the user moves the one end 314*s*, to thereby move the engagement portion 124 in the release direction using the other end 314*t*. Therefore, the one end 314*s* is also referred to as "unit-side operation unit 314*s*." The other end 314*t* comes into contact with the engagement portion 124 while moving, to thereby move the engagement portion 124 to a position at which engagement is released. Therefore, the other end 314*t* is also referred to as "engagement releasing portion 314*t*."

The biasing member 316 is a compressed coil spring. The biasing member 316 biases the other end 314*t* toward the fourth wall portion 24*a*. One end of the biasing member 316 is arranged on an inner wall 318 connected to the second wall portion 22*a*. Another end of the biasing member 316 is arranged between a fulcrum RPa and the other end 314*t* of the unit-side operation member 314.

The fulcrum RPa used to cause the unit-side operation unit 314*s* and the engagement releasing portion 314*t* to rotate is formed in the unit-side operation member 314. The fulcrum RPa is, for example, formed of a pin (not shown) connected to the unit-side operation member 314 and rotatably supported by the fifth wall portion 25*a* and the sixth wall portion 26*a*.

As illustrated in FIG. 21, the unit-side operation unit 314*s* rotates about the fulcrum RPa in the direction indicated by the arrow RM24*s*, to thereby cause the engagement releasing portion 314*t* to rotate in the direction indicated by the arrow RM24*t* against biasing force of the biasing member 316. The direction indicated by the arrow RM24*t* includes a release direction (negative Z-axis direction) component for releasing engagement between the engaged portion 274*a* and the engagement portion 124.

Figure 22:
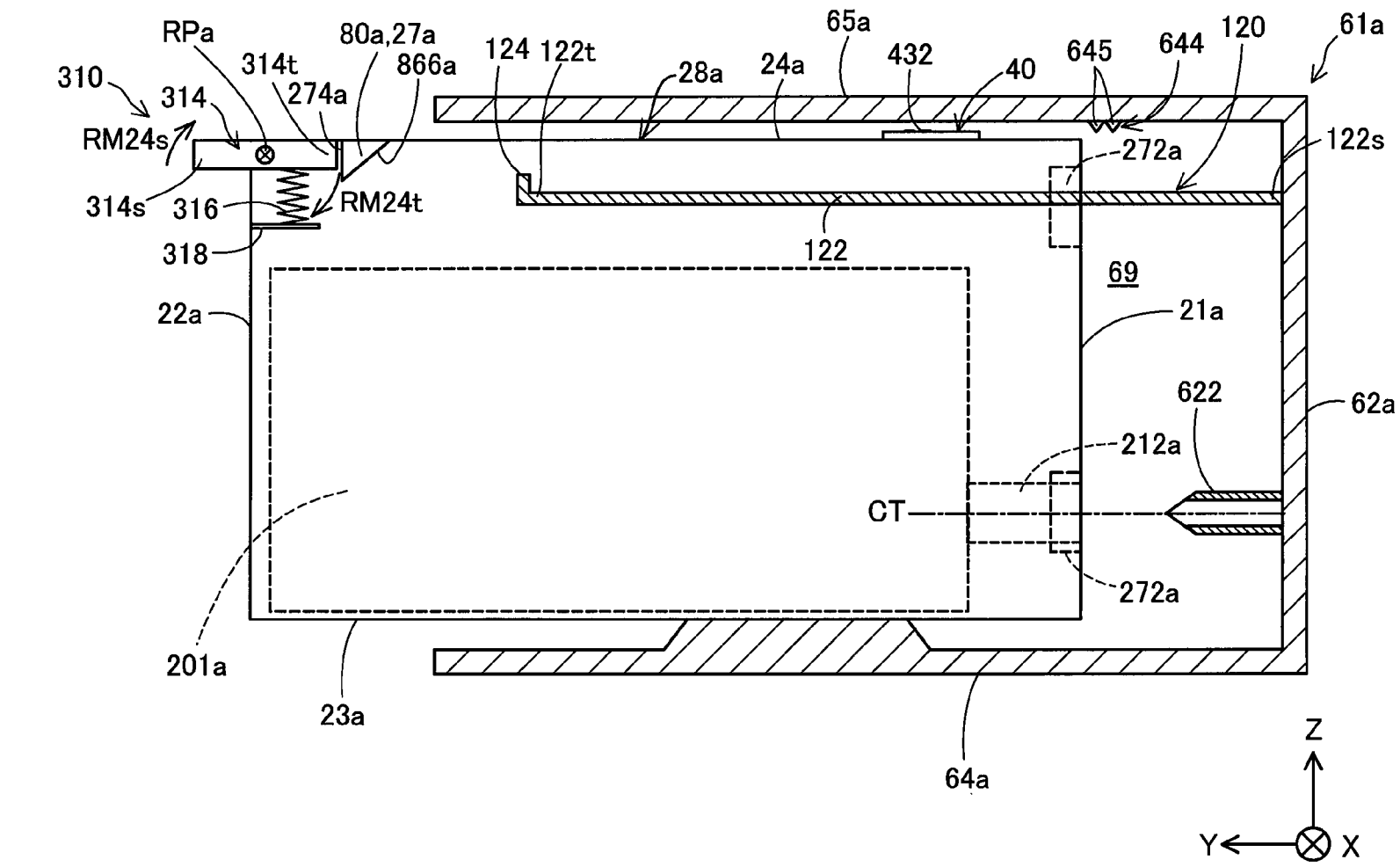
FIG. 22 is a diagram for illustrating a process of mounting the cartridge onto the holder unit.
Figure 23:
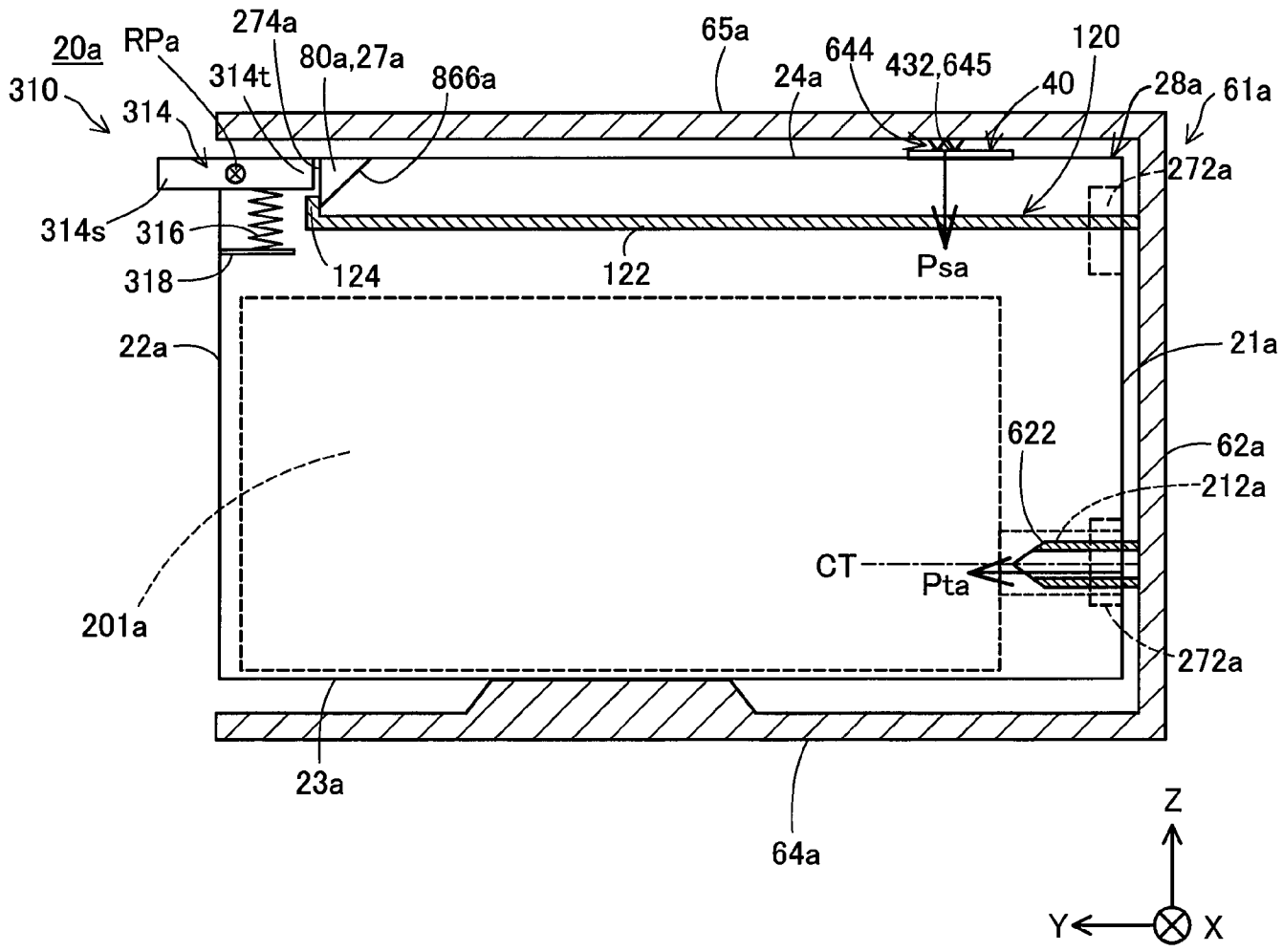
FIG. 23 is a diagram for illustrating a state in which the cartridge is mounted onto the holder unit.

B-3. Aspect of Mounting Cartridge 20*a* onto Holder Unit 61*a*:

FIG. 22 is a diagram for illustrating a process of mounting the cartridge 20*a* onto the holder unit 61*a*. FIG. 23 is a diagram for illustrating a state in which the cartridge 20*a* is mounted onto the holder unit 61*a*. When mounting the cartridge 20*a* onto the holder unit 61*a*, the user moves the cartridge 20*a* in the mounting direction toward the cartridge storage chamber 69 (FIG. 22). More specifically, the user moves the cartridge 20*a* in the mounting direction while positioning the liquid supply portion 212*a* on the central axis CT of the liquid injecting needle 622 such that the liquid injecting needle 622 is inserted into the liquid supply portion 212*a*. In this mounting process, the engagement portion 124 enters the outer shell 28*a* after passing through the first opening 272*a*.

From the state illustrated in FIG. 22, the cartridge 20*a* is further pushed in the mounting direction, to thereby cause the engagement portion 124 to come into contact with the engagement guiding portion 866*a*. With this configuration, the main body portion 122 elastically deforms such that engagement portion 124 moves to the negative Z-axis direction side about the one end 122*s*. As illustrated in FIG. 23, the cartridge 20*a* is then further pushed in the mounting direction, to thereby cause the engagement portion 124 to reach the engaged portion 274*a* and engage with the engaged portion 274*a*. In the mounted state, a biasing force Pta toward the demounting direction is applied to the cartridge 20*a* (outer shell 28*a*) with, for example, the biasing member 29C (FIG. 7) arranged inside the liquid supply portion 212 or a biasing member (not shown) arranged in the vicinity of the liquid injecting needle 622. However, movement of the cartridge 20*a* in the demounting direction is restricted by engagement between the engagement portion 124 and the engaged portion 274*a*.

As illustrated in FIG. 23, in the mounted state of the cartridge 20*a*, the liquid injecting needle 622 is connected to the liquid supply portion 212 and the unit-side terminal 432 makes contact with the holder-side terminal 645. Due to this contact, the cartridge 20*a* is subject to an external force Psa from the holder-side terminal 645. This external force Psa is oriented in a direction (locking direction) opposite to a direction in which engagement between the engaged portion 274*a* and the engagement portion 124 is released. Therefore, the possibility of the engaged portion 274*a* and the engagement portion 124 becoming disengaged in the mounted state of the cartridge 20*a* can be reduced.

Figure 24:
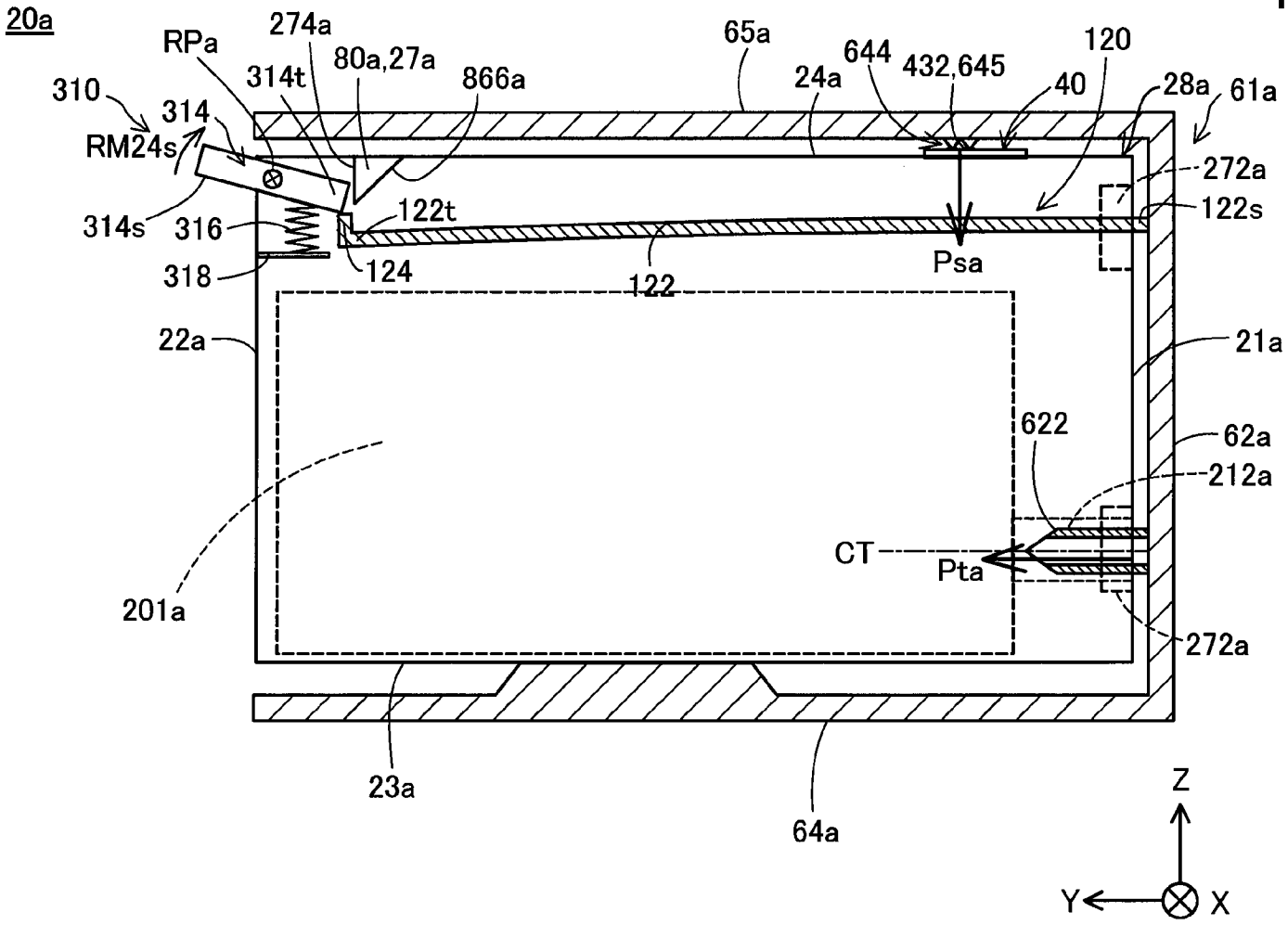
FIG. 24 is a diagram for explaining a method of releasing engagement between an engagement portion and an engaged portion.

FIG. 24 is a diagram for explaining a method of releasing engagement between the engagement portion 124 and the engaged portion 274*a*. When releasing engagement between the engagement portion 124 and the engaged portion 274*a*, the user rotates the unit-side operation unit 314*s* about the fulcrum RPa to move the unit-side operation unit 314*s* in the positive Z-axis direction. With this configuration, the engagement releasing portion 314*t* causes the engagement portion 124 to move in the release direction (negative Z-axis direction). As a result, engagement between the engagement portion 124 and the engaged portion 274*a* is released. In this state, the user moves the cartridge 20*a* in the demounting direction (positive Y-axis direction), to thereby demount the cartridge 20*a* from the holder unit 61*a*.

As illustrated in FIG. 21, according to the second embodiment, the engaged portion 274*a* is formed further inward than the outer surface of the outer shell 28*a*. With this configuration, the possibility of foreign matter such as dirt adhering to the engaged portion 274*a* or the vicinity thereof can be reduced. As a result, the cartridge 20*a* can be mounted more reliably because the engaged portion 274*a* and the engagement portion 124 can precisely engage with each other. Further, for example, in the second embodiment, the engaged portion 274*a* is formed further inward than the outer surface of the outer shell 28*a*, and hence the cartridge 20*a* can be made smaller as compared to a case in which the engaged portion 274*a* is formed further outward than the outer surface of the outer shell 28*a*.

As illustrated in FIG. 24, according to the second embodiment, the cartridge 20*a* includes the unit-side operation unit 314*s* that is operated so as to release engagement between the engaged portion 274*a* and the engagement portion 124. With this configuration, engagement between the engaged portion 274*a* and the engagement portion 124 can be easily released by operating the unit-side operation unit 314*s*. In addition, as illustrated in FIG. 23, the unit-side operation unit 314*s* is arranged at a position exposed from the holder unit 61*a* in the mounted state in which the cartridge 20*a* is mounted onto the holder unit 61*a*. In the second embodiment, the unit-side operation unit 314*s* is arranged further outward than the opening that opposes the first wall portion 21*a* of the holder unit 61*a*. With this configuration, the user can easily operate the unit-side operation unit 314*s*. In addition, as illustrated in FIG. 23, the unit-side operation unit 314*s* is arranged at a position of the outer shell 28*a* closer to the rear end portion 22*a*, which opposes the tip end portion 21*a* and is located in the demounting direction opposite to the mounting direction, than the tip end portion 21*a*. With this configuration, the user can even more easily operate the unit-side operation member 314*s*. In particular, according to the second embodiment, the unit-side operation unit 314*s* is located on the rear edge portion 22*a*, and hence the user can even more easily operate the unit-side operation unit 314*s*.

B-4. Modified Aspects of Second Embodiment:

In the above-described second embodiment, the configuration, placement and number of the engaged structure 27*a* and the engagement structure 120 may be changed as necessary, provided that the engaged portion 274*a* is arranged further inward than the outer surface of the outer shell 28*a*. Modified aspects of the engaged structure 27*a* and the engagement structure 120 according to the second embodiment are described below.

Figure 25:
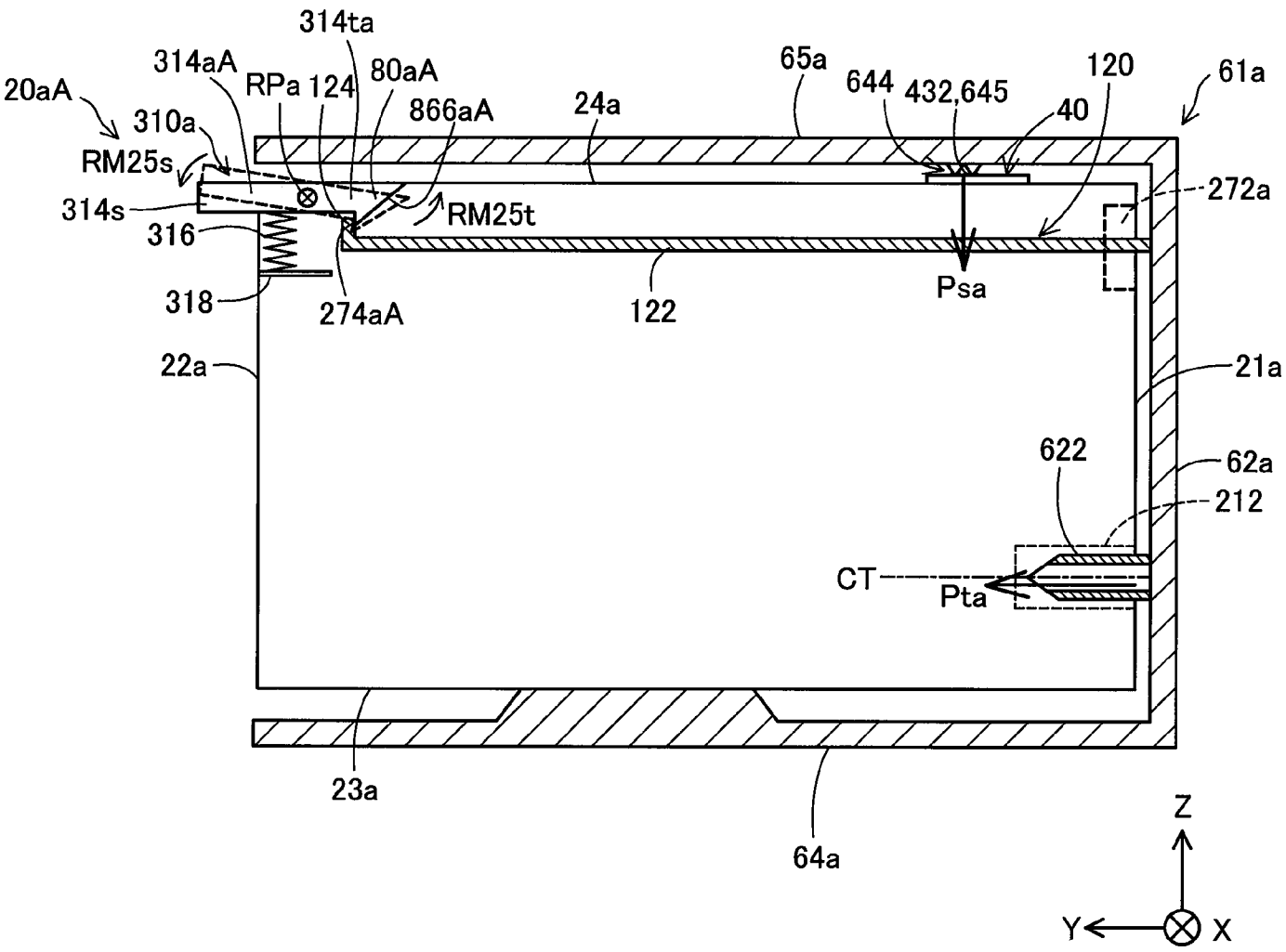
FIG. 25 is a schematic diagram for explaining a first modified aspect of the second embodiment.

B-4-1. First Modified Aspect of Second Embodiment:

FIG. 25 is a schematic diagram for explaining a first modified aspect of the second embodiment. The first modified aspect and the second embodiment differ from each other in terms of the configuration of a unit-side operation structure 310*a* of a cartridge 20*a*A. In the second embodiment, the unit-side operation member 314*a* and the engaged member 80*a* are separate from each other, but in the first modified aspect, a unit-side operation member 314*a*A and an engaged member 80*a*A are integrated. Other configurations are the same as those according to the second embodiment, and hence like components are denoted by the same reference symbols as those used in the second embodiment and a description thereof is omitted.

The biasing member 316 is located closer to the unit-side operation unit 314*s* than the fulcrum RPa. In the mounted state of the cartridge 20*a*A, the biasing member 316 biases the unit-side operation unit 314*s* toward the positive Z-axis direction. An other end 314*ta* of the unit-side operation member 314*a* is connected to the engaged member 80*a*A. The engaged member 80*a*A is not mounted onto the outer shell 28*a* and is configured to move. The engaged member 80*a*A includes an engagement guiding portion 866*a*A and an engaged portion 274*a*A. The engagement guiding portion 866*a*A and the engaged portion 274*a*A correspond to the engagement guiding portion 866*a* and the engaged portion 274*a* (FIG. 21) according to the second embodiment, respectively.

The engaged portion 274*a*A is a surface that extends from the other end 314*ta* in the negative Z-axis direction and faces the demounting direction (positive Y-axis direction) in the mounted state. Positions of the unit-side operation member 314*a*A and the engaged member 80*a*A in a state (non-mounted state) in which the cartridge 20*a*A has not been mounted onto the holder unit 61*a* are indicated by broken lines. In the process of mounting the cartridge 20*a*A, the engagement portion 124 comes into contact with the engagement guiding portion 866*a*A, to thereby cause the engaged member 80*a*A to rotate about the fulcrum RPa and move to the positive Z-axis direction side. In addition, the cartridge 20*a*A is moved in the mounting direction to cause the engagement portion 124 to reach the engaged portion 274*a*A. With this configuration, the engagement portion 124 and the engaged portion 274*a*A engage with each other. In this way, in the process of mounting the cartridge 20*a*A, the engaged portion 274*a*A is configured to move by coming into contact with the engagement structure 120. As a result, the engaged portion 274*a*A can be easily moved.

Figure 26:
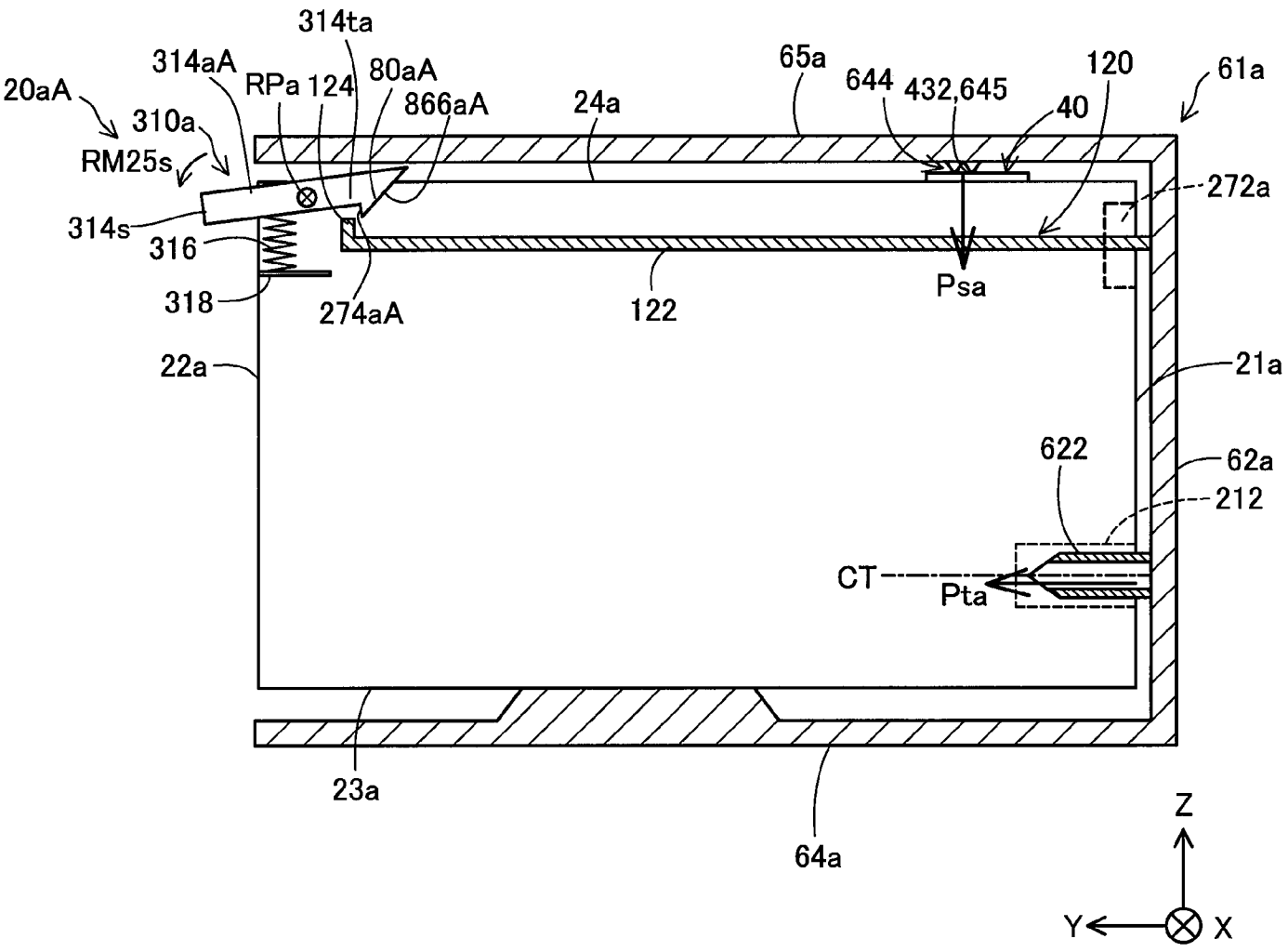
FIG. 26 is a diagram for explaining the method of releasing the engagement between the engagement portion and the engaged portion.

FIG. 26 is a diagram for explaining the method of releasing the engagement between the engagement portion 124 and the engaged portion 274*a*A. When releasing engagement between the engagement portion 124 and the engaged portion 274*a*A, the user performs the following operation. That is, the user rotates the unit-side operation unit 314*s* against the biasing force of the biasing member 316 about the fulcrum RPa, to thereby move the unit-side operation unit 314*s* in a direction (direction indicated by the arrow RM25*s*) including the negative Z-axis direction. With this configuration, the engaged member 80*a*A moves about the fulcrum RPa in a direction (direction indicated by the arrow RM25*t*) including the release direction (positive Z-axis direction). As a result of this movement, engagement between the engagement portion 124 and the engaged portion 274*a*A is released. In this state, the user moves the cartridge 20*a*A in the demounting direction (positive Y-axis direction), to thereby demount the cartridge 20*a*A from the holder unit 61*a*.

The first modified aspect of the second embodiment achieves the following effect in addition to the effects of the second embodiment. In other words, by integrally forming the unit-side operation member 314*a*A and the engaged member 80*a*A, the engaged member 80*a*A can be easily moved.

B-4-2. Other Modified Aspects of Second Embodiment:

The modified aspects of the first embodiment may be adopted in the second embodiment within an applicable range. For example, as in the modified aspect illustrated in FIG. 10, two engagement structures 120 that sandwich the liquid injecting needle 622 may be provided. In addition, for example, there may be adopted a configuration such as that illustrated in FIG. 12 in which the engagement structure 120 is moved to release engagement. In this case, the cartridge 20*a* need not include the unit-side operation structure 310 (FIG. 21).

C. Third Embodiment

Figure 27:
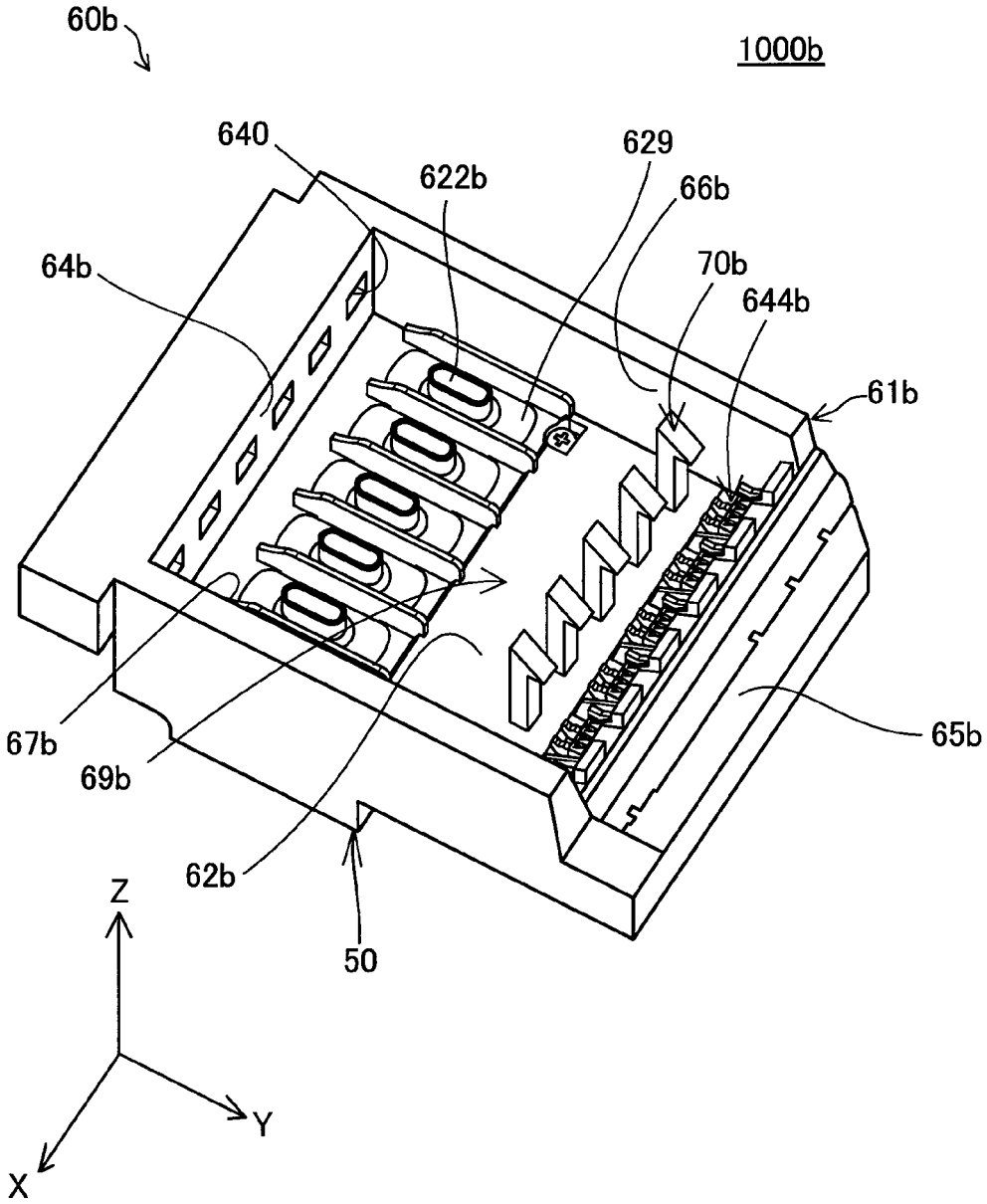
FIG. 27 is a diagram for explaining a liquid ejection system according to a third embodiment.
Figure 28:
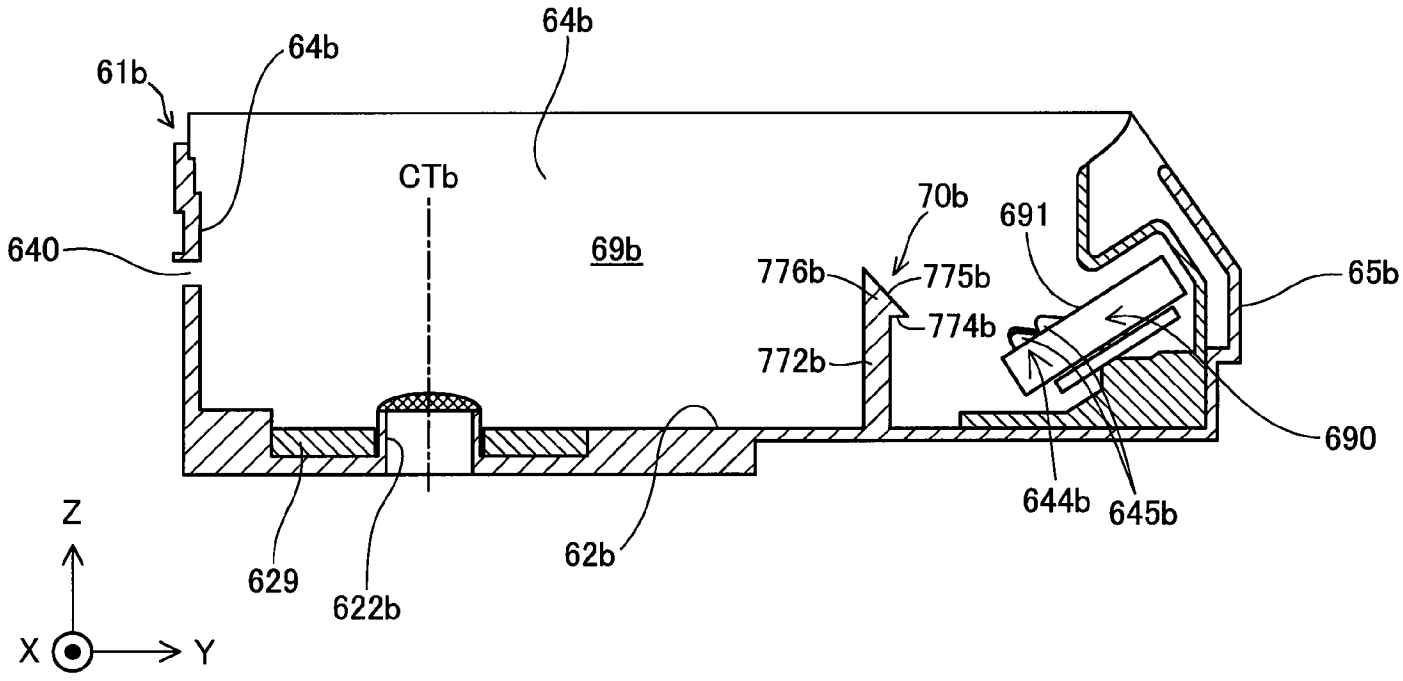
FIG. 28 is a cross-sectional view of the carriage unit.

C-1. Configuration of Carriage Unit 60*b*:

FIG. 27 is a diagram for explaining a liquid ejection system 1000*b* according to a third embodiment. FIG. 28 is a cross-sectional view of a carriage unit 60*b*. The liquid ejection system 1000*b* and the liquid ejection system 1000 (FIG. 1) differ from each other in terms of the configurations of a holder unit 61*b* and a cartridge to be described later. Other configurations are the same as those according to the first embodiment, and hence like components are denoted by the same reference symbols used in the first embodiment and a description thereof is omitted.

The carriage unit 60*b* includes the holder unit 61*b* and the head unit 50. The carriage unit 60*b* can be used in place of the carriage unit 60 of the printer 10 (FIG. 1).

The holder unit 61*b* includes five wall portions 62*b*, 64*b*, 65*b*, 66*b* and 67*b*. These five wall portions 62*b*, 64*b*, 65*b*, 66*b* and 67*b* correspond to the five wall portions 62, 64, 65, 66 and 67 of the holder unit according to the first embodiment, respectively. In other words, the wall portion 62*b* is located on a mounting direction (negative Z-axis direction) side and forms a bottom wall of the holder unit 61*b*. The four wall portions 64*b*, 65*b*, 66*b* and 67*b* extend from a peripheral edge portion of the wall portion 62*b* in the positive Z-axis direction (demounting direction). The wall portion 62*b* is also referred to as "device front wall portion 62*b*," the wall portion 64*b* is also referred to as "first side wall portion 64*b*," the wall portion 65*b* is also referred to as "second side wall portion 65*b*," the wall portion 66*b* is also referred to as "third side wall portion 66*b*," and the wall portion 67*b* is also referred to as "fourth side wall portion 67*b*." The five wall portions 62*b*, 64*b*, 65*b*, 66*b* and 67*b* are molded of, for example, a synthetic resin.

The five wall portions 62*b*, 64*b*, 65*b*, 66*b* and 67*b* form a concave cartridge storage chamber 69*b*. The cartridge storage chamber 69*b* is divided into a plurality of slots (mounting spaces) that can receive one cartridge each.

For every slot, the holder unit 61*b* includes a liquid introduction pipe 622*b* as a liquid introduction portion, a first engagement structure 70*b* as an engagement structure, an electrode portion 644*b*, and a second engagement structure 640.

The liquid introduction pipe 622*b* is arranged on the device front wall portion 62*b*. Similar to the liquid injecting needle 622 (FIG. 3) according to the first embodiment, the liquid introduction pipe 622*b* has a central axis CTb (FIG. 28) that extends along the negative Z-axis direction (mounting direction). The liquid introduction pipe 622*b* communicates with the head unit 50. An elastic member 629 is provided in the vicinity of the liquid introduction pipe 622*b*. The elastic member 629 seals the vicinity of a liquid supply portion (described later) of the cartridge in the mounted state of the cartridge. With this configuration, ink is prevented from leaking from the liquid supply portion to surrounding areas. In addition, in the mounted state of the cartridge, the elastic member 629 generates a biasing force in a direction (demounting direction, positive Z-axis direction) in which the cartridge is pushed back.

The first engagement structure 70*b* (FIG. 28) is a columnar member that extends from the device front wall portion 62*b* in the demounting direction (positive Z-axis direction). The first engagement structure 70*b* includes the main body portion 772*b* that extends from the device front wall portion 62*b* in the demounting direction (positive Z-axis direction), and an engagement portion 776*b* connected to an end (demounting direction side end) of the main body portion 772*b*. The engagement portion 776*b* is a protrusion connected to the main body portion 772*b*. The main body portion 772*b* and the engagement portion 776*b* have a configuration in which the main body portion 772 and the engagement portion 776 (FIG. 3) according to the first embodiment have been rotated 180° about the Z-axis direction. In other words, a guideway 775*b* of the engagement portion 776*b* is a direction that includes a positive Z-axis direction component and a positive Y-axis direction component. An engagement forming surface 774*b* of the engagement portion 776*b* is a surface that faces the mounting direction (negative Z-axis direction).

The electrode portion 644*b* (FIG. 28) is arranged at a corner portion formed between the device front wall portion 62*b* and the second side wall portion 65*b*. The electrode portion 644*b* includes a plurality of holder-side terminals 645*b*. In this embodiment, nine holder-side terminals 645*b* are provided. The number of holder-side terminals 645*b* is not limited thereto and may be less than or more than nine.

The holder-side terminals 645*b* are held by a terminal holder 690. The holder-side terminal 645*b* generates a biasing force of pushing back the cartridge in a direction (direction including positive Z-axis direction and negative Y-axis direction components) including a demounting direction component (positive Z-axis direction) of the cartridge in the mounted state of the cartridge. The direction of this biasing force is a direction substantially perpendicular to an inclined surface 691 of the terminal holder 690. In other words, when the holder-side terminal 645*b* that has one portion protruding from the inclined surface 691 is pushed by the cartridge into the inclined surface 691, a biasing force in an inclined direction is applied to the cartridge as reaction force of that action.

The second engagement structure 640 is a through hole that penetrates the first side wall portion 64*b* in the Y-axis direction. The second engagement structure 640 may be a concave portion open toward the cartridge storage chamber 69*b*. In the mounting state of the cartridge, the second engagement structure 640 engages with a corresponding member of the cartridge, to thereby restrict the movement of the cartridge in the demounting direction.

In the Y-axis direction (first direction), the first engagement structure 70*b* and the second engagement structure 640 are arranged so as to sandwich the liquid introduction pipe 622*b*. In addition, in the Y-axis direction (first direction), the engagement portion 776*b* is arranged between the liquid introduction pipe 622*b* and the holder-side terminal 645*b*.

The mounting direction of the cartridge is the negative Z-axis direction (in this embodiment, a vertically downward direction). Here, when the cartridge is actually inserted into the holder unit 61*b*, the state of the cartridge is not necessarily always constant. While trying to mount the cartridge onto the holder unit 61*b*, the cartridge may incline in the Z-axis direction. However, both immediately before mounting and in the mounted state, the liquid supply portion of the cartridge accepts the liquid introduction pipe 622*b* having the central axis CTb parallel to the Z-axis direction. Therefore, the cartridge can be mounted onto the holder unit 61*b* in the negative Z-axis direction.

C-2. Configuration of Cartridge 20*b:*

Figure 29:
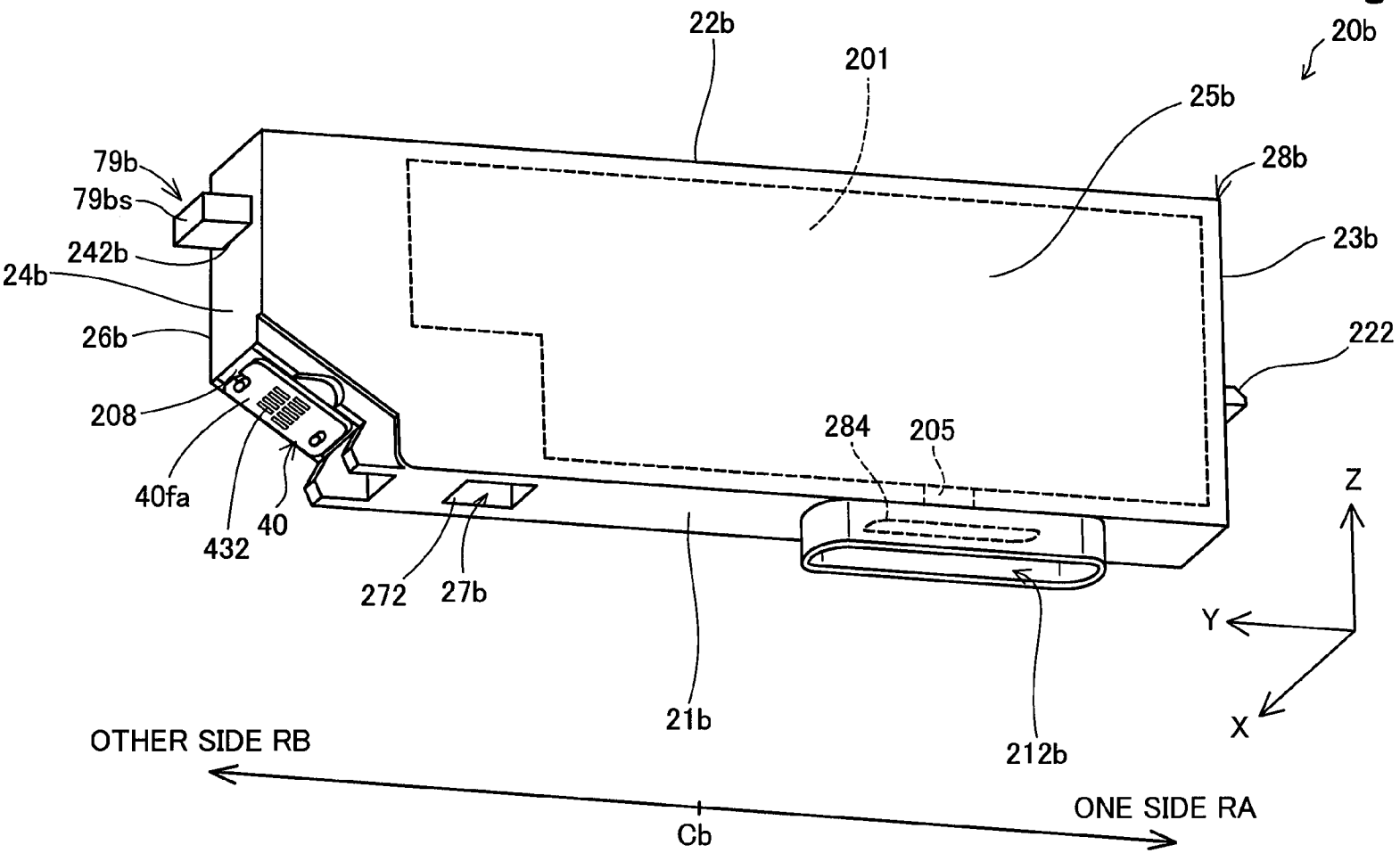
FIG. 29 is a perspective view for illustrating a cartridge according to the third embodiment.
Figure 30:
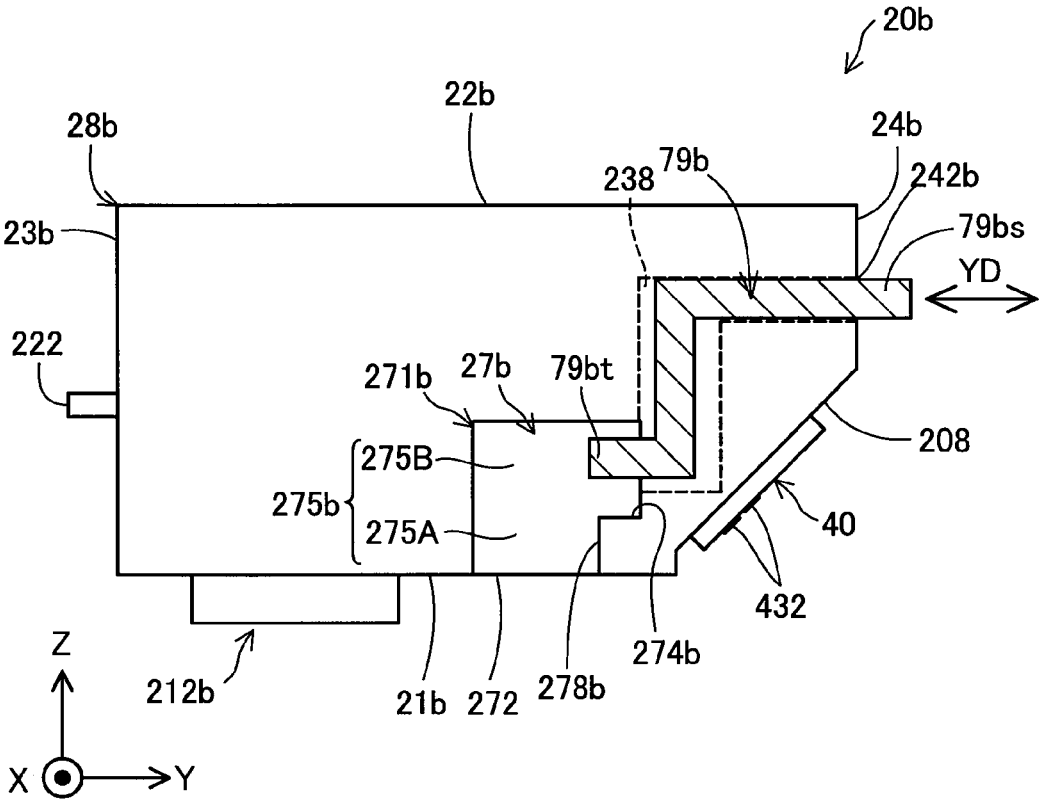
FIG. 30 is a schematic diagram for explaining an engaged structure and a unit-side operation member.

FIG. 29 is a perspective view for illustrating the cartridge 20*b* according to the third embodiment. FIG. 30 is a schematic diagram for explaining an engaged structure 27*b* and a unit-side operation member 79*b*. The cartridge 20 (FIG. 4) according to the first embodiment and the cartridge 20*b* according to the third embodiment differ from each other in that an outer shell 28*b* newly includes a connecting wall portion 208, the cartridge 20*b* newly includes the unit-side operation member 79*b*, and that a liquid supply portion 212*b* has a different configuration. Other configurations are the same as the cartridge 20 according to the first embodiment, and hence like components are denoted by the same reference symbols used in the first embodiment and a description thereof is omitted.

The cartridge 20*b* includes the outer shell 28*b*, the liquid storage portion 201, the liquid supply portion 212*b*, the first engaged structure 27*b* as an engaged structure, the unit-side operation member 79*b*, a second engaged structure 222 and the circuit substrate 40.

The outer shell 28*b* of the cartridge 20*b* (FIG. 29) forms an outer surface having a substantially quadrangular cylindrical shape or a substantially cuboid shape. The outer shell 28*b* includes the connecting wall portion 208 in addition to first to sixth wall portions 21*b* to 26*b*. The first to sixth wall portions 21*b* to 26*b* correspond to the first to sixth wall portions 21 to 26 (FIG. 4) according to the first embodiment, respectively. In other words, the first wall portion 21*b* forms a tip side portion of the cartridge 20*b*. In this embodiment, as in the first embodiment, the first wall portion 21*b* faces the mounting direction (negative Z-axis direction). The second wall portion 22*b* opposes the first wall portion 21*b* and is located on the demounting direction (positive Z-axis direction) side. The third wall portion 23*b* is located on the one side RA (negative Y-axis direction side) in the first direction (Y-axis direction). The fourth wall portion 24*b* opposes the third wall portion 23*b* and is located on the other side RB (positive Y-axis direction side) in the first direction. The fourth wall portion 24*b* forms a front surface in the mounted state. The fifth wall portion 25*b* and the sixth wall portion 26*b* form both side surfaces in the second direction (X-axis direction) that is orthogonal to the mounting direction and the first direction. The first wall portion (tip side portion) 21*b* is a portion that faces a device front wall portion 62*b* (FIG. 28) provided with the liquid introduction pipe 622*b*.

The connecting wall portion 208 connects the first wall portion 21*b* and the fourth wall portion 24*b* to each other. The connecting wall portion 208 includes a surface (inclined surface) inclined toward a direction including a mounting direction (negative Z-axis direction) component and a positive Y-axis direction component. The circuit substrate 40 is arranged on the inclined surface. The front surface 40*fa* of the circuit substrate 40 is inclined in the mounting direction (negative Z-axis direction). More specifically, the front surface 40*fa* is inclined in a direction that includes a mounting direction (negative Z-axis direction) component and a positive Y-axis direction component. A plurality of the unit-side terminals (contact portions) 432 are provided on the front surface 40*fa*.

The liquid storage portion 201 stores ink to be supplied to the head unit 50. The liquid storage portion 201 is defined by the outer shell 28*b*. In other words, the liquid storage portion 201 is arranged inside the outer shell 28*b*. Air is introduced to the liquid storage portion 201 via an air induction port (not shown) formed in the second wall portion 22*b* in accordance with consumption of the ink in the liquid storage portion 201.

The liquid supply portion 212*b* communicates with the liquid storage portion 201 via the communication hole 205 formed in the first wall portion 21*b*. The liquid supply portion 212*b* can supply ink to the printer 10. The liquid supply portion 212*b* is arranged on the first wall portion 21*b* that forms a tip edge portion of the outer shell 28*b*. The liquid supply portion 212*b* is arranged on the one side RA in the first direction. A foam resin 284 for holding the ink is provided in the liquid supply portion 212*b*. The foam resin 284 makes contact with the communication hole 205. In the mounted state of the cartridge 20*b*, the foam resin 284 and a tip portion (positive Z-axis direction side end) of the liquid introduction pipe 622*b* make contact, to thereby achieve a state in which ink can be distributed from the foam resin 284 to the liquid introduction pipe 622*b*.

The first engaged structure 27*b* (FIG. 30) includes an engaged portion 274*b*, a receiving portion 275*b* and the first opening 272. The first engaged structure 27*b* is a concave portion formed in the first wall portion 21*b*. The engaged structure 27*b* is defined by a wall portion 271*b* in the cartridge 20*b*. The receiving portion 275*b* receives the columnar engagement structure 70*b* (FIG. 28) in the mounted state. The receiving portion 275*b* includes a first receiving portion 275A for receiving the main body portion 772*b* and a second receiving portion 275B for receiving the engagement portion 776. The first receiving portion 275A is located closer to the mounting direction side than the second receiving portion 275B. A step is formed at a boundary portion between the first receiving portion 275A and the second receiving portion 275B. This step forms the engaged portion 274*b*.

The first opening 272 is an opening formed in the first wall portion 21*b*. The first opening 272 can also be referred to as an opening of the receiving portion 275*b*, which is a concave portion. The first opening 272 is open such that the main body portion 772*b* of the engagement structure 70*b* can be inserted there through. The opening direction of the first opening 272 is the mounting direction (negative Z-axis direction).

The engaged portion 274*b* can engage with the engagement portion 776*b* (FIG. 28). The engaged portion 274*b* is formed by an inner wall portion 271*b* that defines the engaged structure 27*b*. The engaged portion 274*b* is a surface that faces the demounting direction (negative Z-axis direction). The engaged portion 274*b* extends in the first direction from one wall portion 278*b* that forms a side wall portion of the receiving portion 275*b* that is the concave portion to a side (positive Y-axis direction side) on which the unit-side terminal 432 is located. The wall portion 278*b* is located on a side (positive Y-axis direction side) of the side wall portion of the first receiving portion 275A on which the unit-side terminal 432 is located. In addition, the wall portion 278*b* defines the first opening 272. The engaged portion 274*b* is arranged further inward than the outer surface of the outer shell 28*b*. In other words, the engaged portion 274*b* is arranged within a region surrounded by the outer surface of the outer shell 28*b*. The engaged portion 274*b* is arranged between the first wall portion 21*b* and the second wall portion 22*b*. The engaged portion 274*b* is also arranged between the third wall portion 23*b* and the fourth wall portion 24*b*. In addition, the engaged portion 274*b* is arranged between the fifth wall portion 25*b* and the sixth wall portion 26*b*.

The second engaged structure 222 is a protrusion provided on the third wall portion 23*b*. The second engaged structure 222 engages with the second engagement structure 640 (FIG. 28) in the mounted state of the cartridge 20*b*.

A unit-side operation member 79*b* (FIG. 30) is inserted into a through hole 242*b* formed in the fourth wall portion 24*b*. In addition, the unit-side operation member 79*b* is formed by an inner wall of the outer shell 28*b* and is inserted from the through hole 242*b* into an internal space 238 that connects the receiving portion 275*b*. The unit-side operation member 79*b* is arranged so as to be moveable in the direction (Y-axis direction) indicated by the arrow YD.

The unit-side operation member 79*b* includes a unit-side operation unit 79*bs* that forms one end of the unit-side operation member 79*b* and an engagement releasing member 79*bt* that forms another end of the unit-side operation member 79*b*.

The unit-side operation unit 79*bs* is arranged further outward than the outer shell 28*b* in the mounted state. In this embodiment, the unit-side operation unit 79*bs* protrudes outward from the fourth wall portion 24*b*. The unit-side operation unit 79*bs* is operated in order to release engagement between the engaged portion 274*b* and the engagement portion 776*b* (FIG. 28). The unit-side operation unit 79*bs* is arranged at a position closer to the rear end portion 22*b*, which opposes the tip end portion 21*b* and is located on the demounting direction side, than the tip end portion 21*b* in the mounting direction. The unit-side operation unit 79*bs* is preferably arranged at a position exposed from the holder unit 61*b*. With such a configuration, the user can easily operate the unit-side operation unit 79*bs*.

The engagement releasing portion 79*bt* comes into contact with the engagement portion 776*b* to move the engagement portion 776*b* in the release direction. With this action, the engagement releasing portion 79*bt* can release engagement between the engaged portion 274*b* and the engagement portion 776*b*. In the mounted state, the engagement releasing portion 79*bt* faces the engagement portion 776*b* and the release direction (negative Y-axis direction).

C-3. Aspects of Mounting Cartridge 20*b* onto Holder Unit 61*a:*

Figure 31:
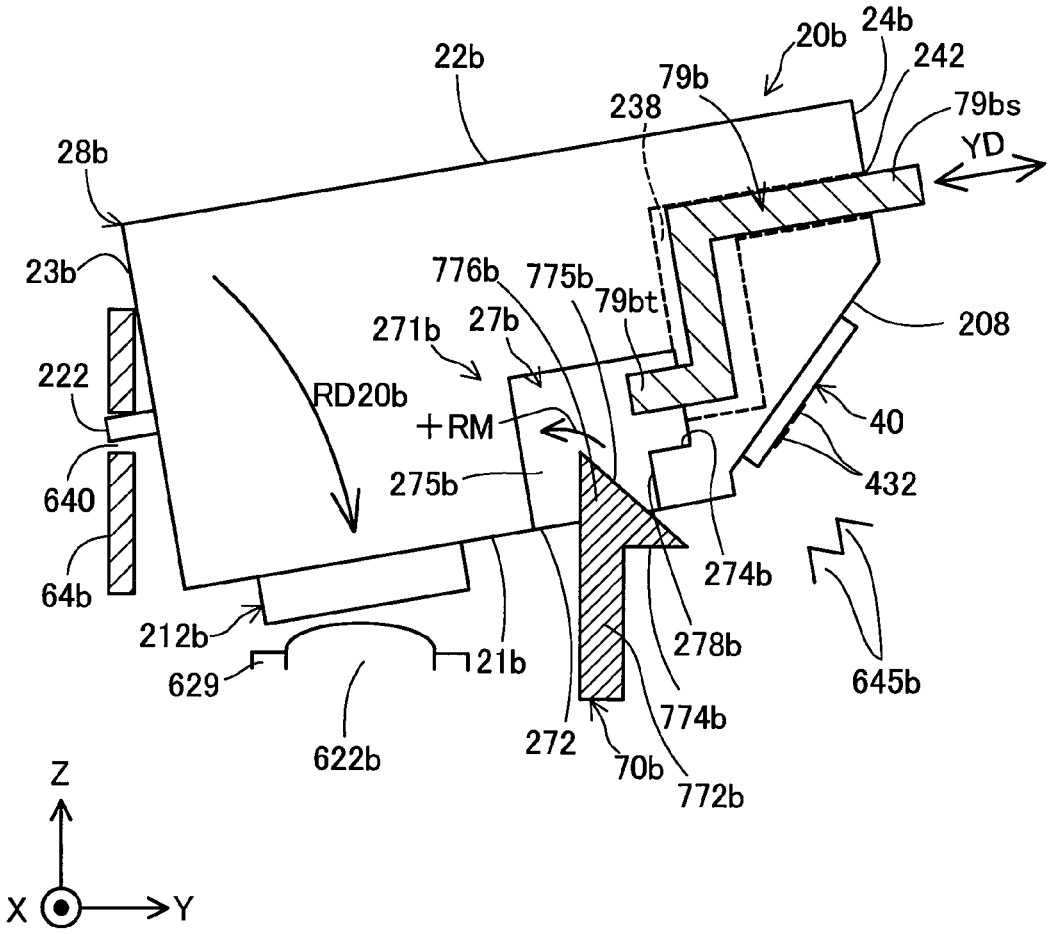
FIG. 31 is a diagram for illustrating a process of mounting the cartridge onto the holder unit.
Figure 32:
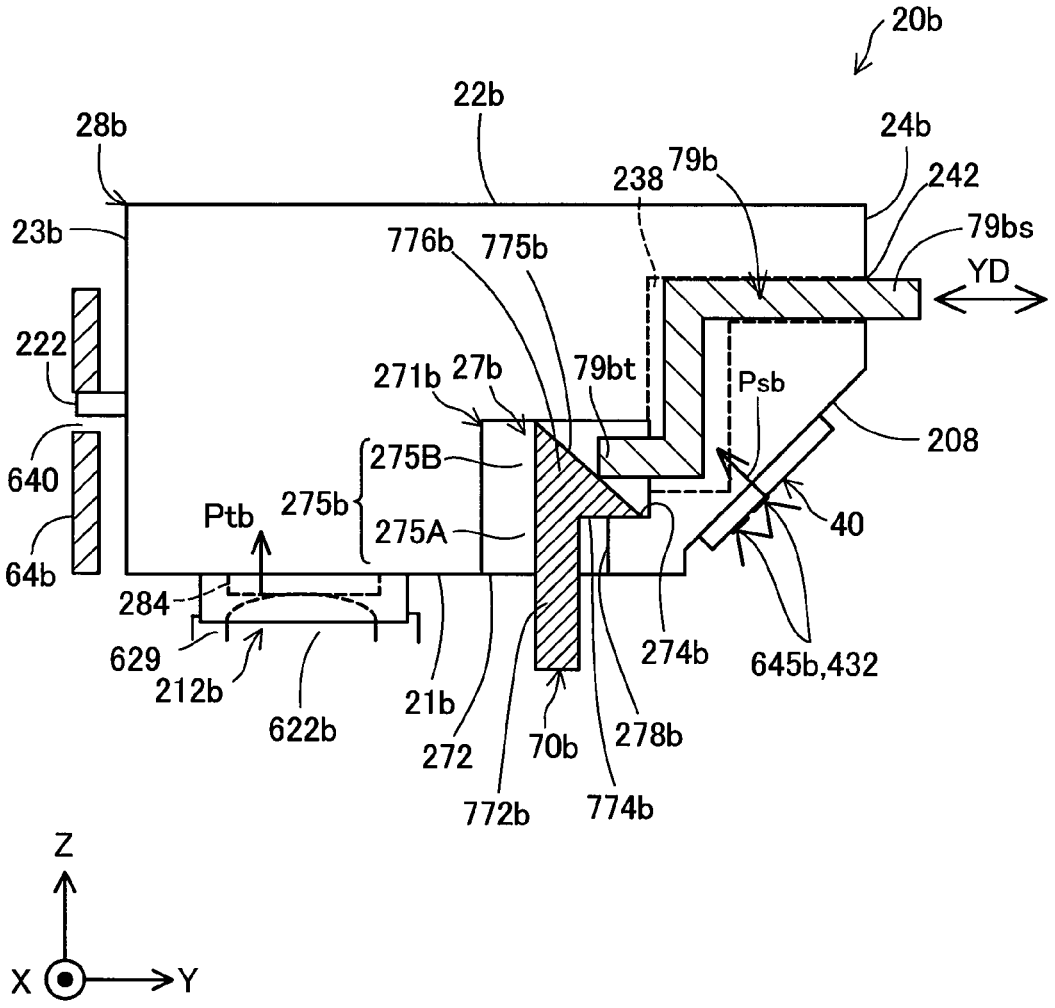
FIG. 32 is a diagram for illustrating a state in which the cartridge is mounted onto the holder unit.

The FIG. 31 is a diagram for illustrating a process of mounting the cartridge 20*b* onto the holder unit 61*b*. FIG. 32 is a diagram for illustrating a state in which the cartridge 20*b* is mounted onto the holder unit 61*a*.

As illustrated in FIG. 31, when mounting the cartridge 20*b* onto the holder unit 61*b*, the user first inclines the cartridge 20*b* such that the third wall portion 23*b* faces a direction including a mounting direction (negative Z-axis direction) component, and then inserts the second engaged structure 222 which is a protrusion into the second engagement structure 640 which is a through hole. Then, the user moves the cartridge 20*b* in the direction indicated by the arrow RD20*b* about the second engaged structure 222. The cartridge 20*b* moves along the negative Z-axis direction immediately before being mounted.

From the state illustrated in FIG. 31, by proceeding further with the mounting operation of the cartridge 20*b*, the guideway 775*b* of the engagement portion 776*b* comes into contact with the wall portion 278*b* of the receiving portion 275*b*. With this configuration, the main body portion 772*b* elastically deforms such that the engagement portion 776*b* moves in the positive RM direction. By proceeding even further with the mounting operation of the cartridge 20*b*, the engagement portion 776*b* moves toward a back side (positive Z-axis direction side) of the receiving portion 275*b* toward the engaged portion 274*b* while coming into contact with the wall portion 278*b*. Through the engagement portion 776*b* coming into contact with the wall portion 278*b*, deformation of the engagement portion 776*b* in the positive RM direction is maintained.

As illustrated in FIG. 32, when the engagement portion 776*b* reaches the second receiving portion 275B, the engagement portion 776*b* and the wall portion 278*b* separate from each other, and the elastic deformation of the main body portion 772*b* caused by the external force applied to the engagement portion 776*b* from the wall portion 278*b* is released. As a result, the engagement portion 776*b* moves toward a direction in which the fourth wall portion 24*b* is located and the engaged portion 274*b* faces the engagement forming surface 774*b*. As described above, the wall portion 278*b* also functions as a guiding portion for guiding the engagement portion 776*b* to the engaged portion 274*b*.

As illustrated in FIG. 32, in the mounted state of the cartridge 20*b*, the liquid supply portion 212*b* is connected to the liquid introduction pipe 622*b*, and the unit-side terminal 432 makes contact with the holder-side terminal 645. In addition, in the mounted state of the cartridge 20*b*, the cartridge 20*b* is subject to the external forces Ptb and Psb from the holder unit 61. The external force Ptb is a force applied to the liquid supply portion 212*b* of the cartridge 20*b* by the elastic member 629. The external force Ptb is oriented in the demounting direction (positive Z-axis direction). The external force Psb is a force applied to the unit-side terminal 432 of the cartridge 20*b* by the holder-side terminal 645*b*. The external force Psb is oriented in a direction that includes a negative Y-axis direction component and a positive Z-axis direction component.

In the mounted state of the cartridge 20*b*, the cartridge 20*b* is subject to force in the demounting direction due to the external forces Ptb and Psb. However, in the mounted state of the cartridge 20*b*, the engaged portion 274*b* engages with the engagement forming surface 774*b*, to thereby restrict the movement of the cartridge 20*b* (more specifically, the one side RA of the cartridge 20*b*) in the demounting direction. In addition, through the second engaged structure 222 engaging with the second engagement structure 640, the movement of the cartridge 20*b* (more specifically, the other side RB of the cartridge 20*b*) in the demounting direction is restricted. The cartridge 20*b* is subject to force toward the negative Y-axis direction due to an external force Psb. The negative Y-axis direction is a direction (locking direction) opposite to a direction in which engagement between the engaged portion 274*b* and the engagement forming surface 774*b* is released. Therefore, the possibility of the engaged portion 274*b* and the engagement forming surface 774*b* disengaging from each other can be reduced.

When the cartridge 20*b* is to be demounted from the holder unit 61*b*, the unit-side operation unit 79*bs* is moved in the negative Y-axis direction. With this configuration, the engagement releasing portion 79*bt* pushes the engagement portion 776*b* toward the release direction (negative Y-axis direction). As a result, engagement between the engaged portion 274*b* and the engagement portion 776*b* is released. In this state, the cartridge 20*b* is demounted from the holder unit 61*b* by moving the cartridge 20*b* in the demounting direction (positive Z-axis direction).

The third embodiment has a similar configuration to that of the first and second embodiments and the modified aspects thereof, and hence achieves a similar effect. For example, as illustrated in FIG. 32, according to the third embodiment, the engaged portion 274*b* is formed further inward than the outer surface of the outer shell 28*b*. With this configuration, the possibility of foreign matter adhering to the engaged portion 274*b* or the vicinity thereof can be reduced. As a result, because the engaged portion 274*b* and the engagement portion 776*b* can precisely engage with each other, the cartridge 20*b* can be mounted more reliably. In addition, for example, according to the third embodiment, because the engaged portion 274*b* is formed further inward than the outer surface of the outer shell 28*b*, the cartridge 20*b* can be made smaller compared to a case in which the engaged portion 274*b* is formed further outward than the outer surface of the outer shell 28*b*. Further, for example, according to the third embodiment, the engaged portion 274*b* is formed by the receiving portion 275*b* which is a concave portion that can engage with the engagement portion 776*b* which is a protrusion. With this configuration, the engaged portion 274*b* can be formed with a simple structure. Further, for example, by providing the cartridge 20*b* with the unit-side operation unit 79*bs*, engagement between the engaged portion 274*b* and the engagement portion 776*b* can be easily released by operating the unit-side operation unit 79*bs*.

C-4. Modified Aspect of Third Embodiment:

In the above-described third embodiment, the structure, placement and number of the engaged structure 27*b* and the engagement structure 70*b* may be changed as necessary, provided that the engaged portion 274*b* is arranged further inward than the outer surface of the outer shell 28*b*. Modified aspects of the engaged structure 27*b* and the engagement structure 70*b* according to the third embodiment are described below.

C-4-1. First Modified Aspect of Third Embodiment:

In the third embodiment, the unit-side operation member 79*b* is separate from the engaged portion 274*b* (FIG. 30), but the third embodiment is not limited thereto and the unit-side operation member 79*b* and the engaged portion 274*b* may be integral. A specific example of such a case is described below.

Figure 33:
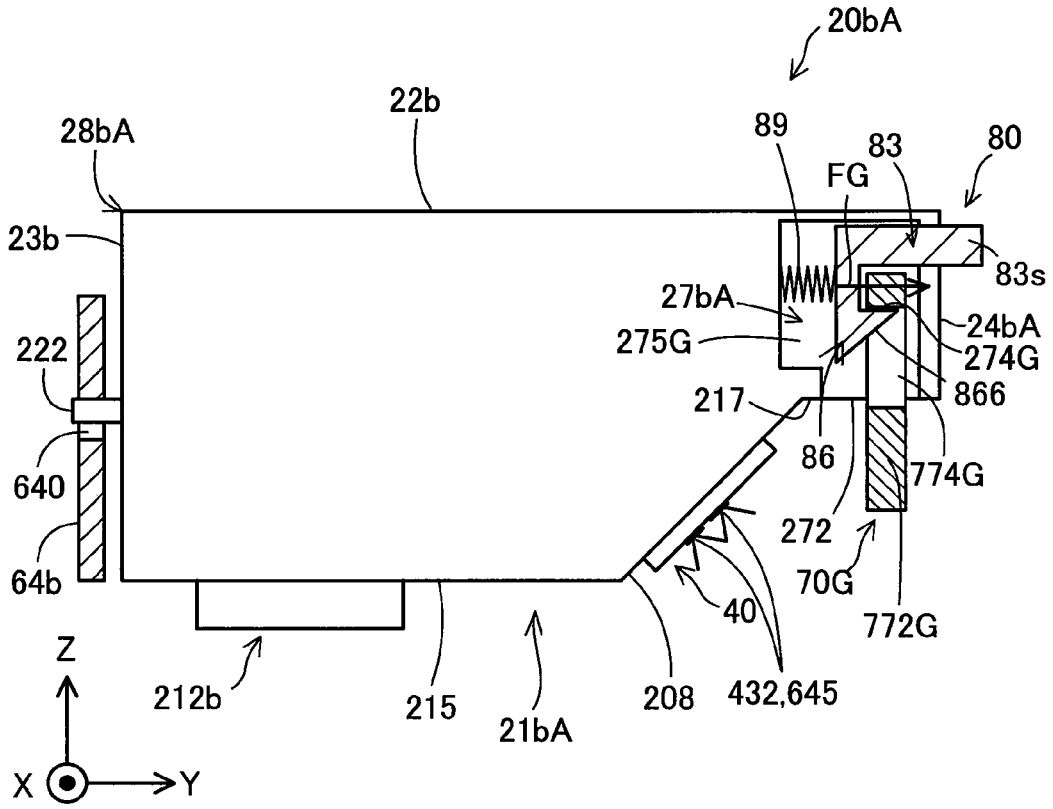
FIG. 33 is a schematic diagram for explaining a first modified aspect of the third embodiment.

FIG. 33 is a schematic diagram for explaining a first modified aspect of the third embodiment. The liquid ejection system 1000*b* according to the third embodiment differs from the liquid ejection system according to the first modified aspect in terms of the configuration of an engaged structure 27*b*A, the configuration of an outer shell 28*b*A, and the configuration of an engagement structure 70G. Other configurations are the same as those according to the third embodiment, and hence like components are denoted by the same reference symbols used in the first embodiment and a description thereof is omitted.

A first wall portion 21*b*A of the outer shell 28*b*A includes a first bottom wall portion 215 connected to the third wall portion 23*b*, a second bottom wall portion 217 connected to a fourth wall portion 24*b*A and an inclined wall portion 216 that connects the first bottom wall portion 215 and the second bottom wall portion 217 to each other. The inclined wall portion 216 corresponds to the connecting wall portion 208 illustrated in FIG. 30. The first wall portion 21*b*A faces a direction including a mounting direction (negative Z-axis direction) component. The circuit substrate 40 is arranged in the inclined wall portion 216. The first opening 272 is formed in the second bottom wall portion 217.

The engagement structure 70G has the same structure as that of the engagement structure 70G illustrated in FIG. 14. In other words, the engagement structure 70G includes the engagement portion 774G as an opening formed in the main body portion 772G.

The configuration of the engaged structure 27*b*A is a configuration in which the engaged structure 27G illustrated in FIG. 14 has been rotated 180° about the Z-axis direction. Therefore, a configuration similar to that of the engaged structure 27G is denoted by like references symbols and a description thereof is omitted. In other words, the engaged structure 27*b*A includes the first opening 272, the receiving portion 275G formed inside the outer shell 28G, the engaged member 80 and the biasing member 89. The biasing member 89 biases the engaged member 80 in the positive Y-axis direction.

When releasing engagement between the engaged portion 274G and the engagement portion 774G, the user moves the unit-side operation unit 83*s* in the negative Y-axis direction against the biasing force of the biasing member 89. With this configuration, the engaged portion 274G moves in the negative Y-axis direction which is the release direction of engagement to release engagement between the engaged portion 274G and the engagement portion 774G.

C-4-2. Other Modified Aspects of Third Embodiment:

In the third embodiment, the modified aspects of the first and second embodiments can be adopted within an applicable range. For example, similar to the modified aspect illustrated in FIG. 10, two engagement structures 70*b* that sandwich the liquid introduction pipe 622*b* may be provided. For example, as illustrated in FIG. 12, a configuration in which the engagement structure 70*b* is moved to release engagement may be adopted. In this case, the cartridge 20*b* need not include the unit-side operation member 79*b* (FIG. 29).

D. Modification Examples

The present invention is not limited to the above-described examples and embodiments and may be embodied in various forms without departing from the spirit and scope thereof. For example, the present invention can be modified in the following ways.

D-1. First Modification Example:

The engaged structure 27, 27*a*, 27*b* (FIGS. 4, 20 and 29) of the cartridge 20, 20*b*, 20*c* according to the first to third embodiments includes the first opening 272, 272*a* formed in the first wall portion 21, 21*a*, 21*b*, but the engaged structure 27, 27*a*, 27*b* may include another opening formed in the outer shell 28, 28*a*, 28*b* in addition to the first opening 272, 272*a*. For example, the engaged structure 27, 27*a*, 27*b* may include another opening that communicates with an inner space (for example, the receiving portion 275 illustrated in FIG. 5) inside the outer shell 28, 28*a*, 28*b* in which the engaged portion 274, 274*a*, 274*b* (FIGS. 5, 21 and 30) is located. A specific example of such a case is described below as a modified example of the cartridge 20 according to the first embodiment. The present modification example can also be applied to the cartridges 20*a* and 20*b* according to the second and third embodiments, respectively.

Figure 34:
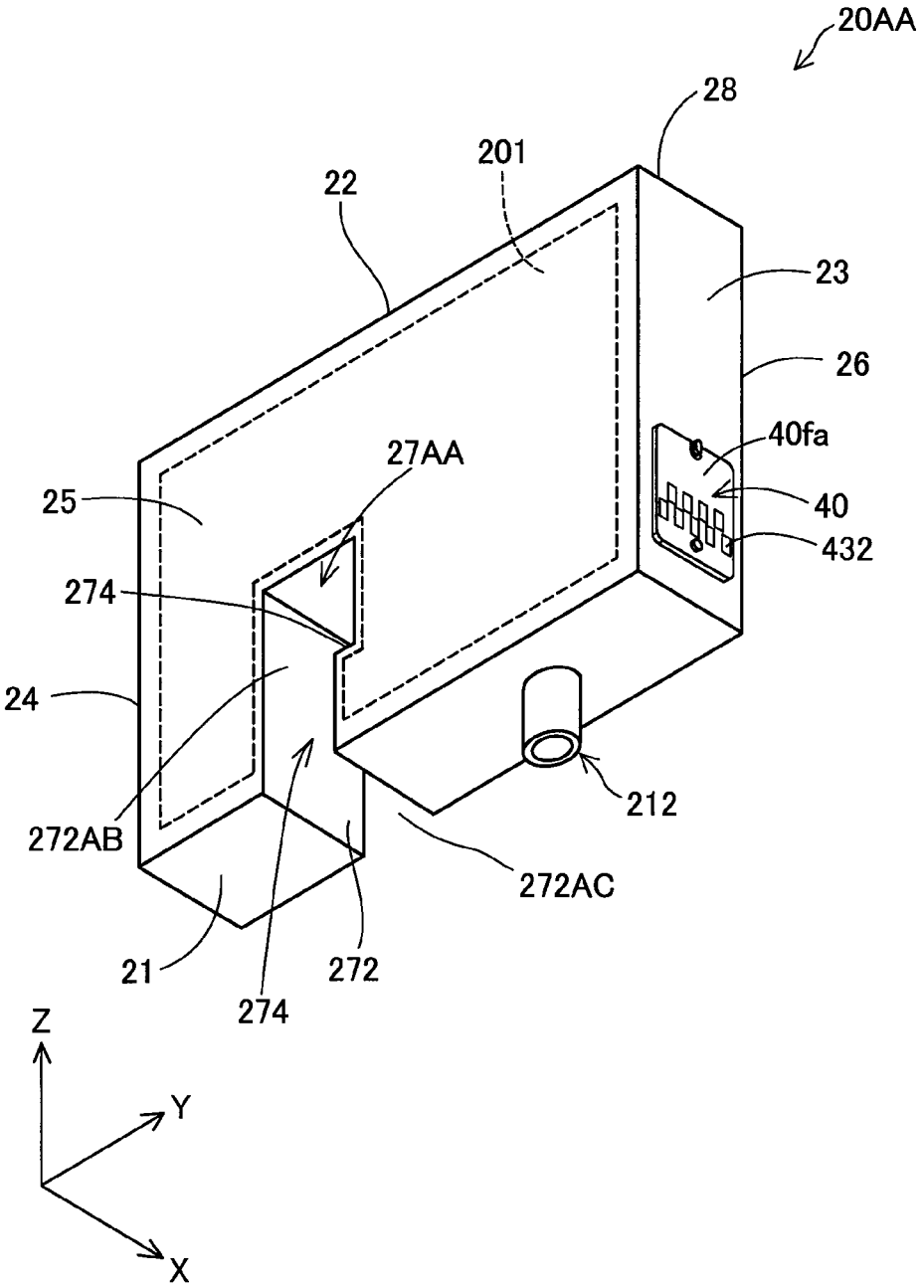
FIG. 34 is a perspective view for illustrating a cartridge according to a first modification example.

FIG. 34 is a perspective view for illustrating a cartridge 20AA according to a first modification example. An engaged structure 27AA further includes a second opening 272AB open toward a direction different to the direction in which the first opening 272 is open. The engaged structure 27AA also includes a third opening 272AC open toward a direction different to the directions in which the first opening 272 and the second opening 272AB are open. In the first modification example, the second opening 272AB is formed in the fifth wall portion 25 and the second opening 275AC is formed in the sixth wall portion 26. The second opening 272AB is open in the negative X-axis direction. The third opening 272AC is open in the positive X-axis direction. The second opening 272AB and the third opening 272AC can also be regarded as openings formed in a side wall portion of the receiving portion 275. In addition, the second opening 272AB and the third opening 272AC can also be regarded as communicating with the receiving portion 275 inside the outer shell 28.

According to the first modification example, because the engaged structure 27AA includes the second opening 272AB and the third opening 272AC in addition to the first opening 272, even when foreign matter such as dirt enters the engaged structure 27AA, the foreign matter can easily be expelled to the outside of the engaged structure 27AA. The third opening 272AC may be omitted.

Figure 35:
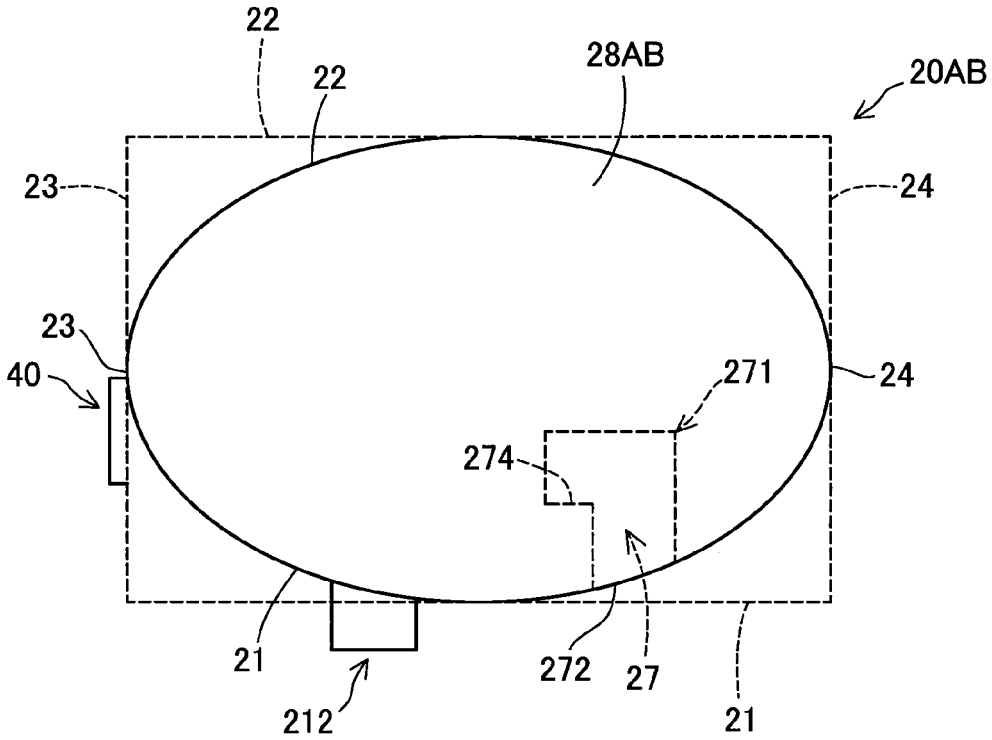
FIG. 35 is a conceptual view for illustrating a modified example of the shape of the cartridge.

D-2. Second Modification Example:

FIG. 35 is a conceptual view for illustrating a modified example of the shape of the cartridge. FIG. 35 shows a modification example of the cartridge 20 (FIG. 4) according to the first embodiment as one example. In the first to third embodiments, the outer shell 28, 28*a*, 28*b* of the cartridge 20, 20*a*, 20*b* has a substantially cuboid shape (FIGS. 4, 20 and 29), but the shape of the outer shell 28, 28*a*, 28*b* is not limited thereto and may be another shape provided that the outer shell 28, 28*a*, 20*b* can be mounted onto the corresponding holder unit 61, 61*a*, 61*b*. In FIG. 35, the outer shell according to the first embodiment is indicated by the broken line.

For example, as illustrated in FIG. 35, an outer shell 28AB has an elliptic or rectangular side surface and, when a cartridge 20AB is viewed from the front (right side of FIG. 35), has a constant width. The liquid supply portion 212 is arranged on the tip edge portion 21 of the outer shell 28AB that faces a direction including a mounting direction component. The first opening 272 is formed in the tip edge portion 21. In addition, the engaged portion 274 is arranged further inward than the outer surface of the outer shell 28AB.

As described above, the shape of the outer shell 28, 28*a*, 28*b* is not limited to that according to the above-described first to third embodiments, provided that compatibility with the cartridge 20, 20*a*, 20*b* can be guaranteed.

D-3. Third modification example:

In the first to third embodiments, in the cartridge 20, 20*a*, 20*b*, the liquid storage portion 201, 201*a* is formed in the outer shell 28, 28*a*, 28*b* on which the engaged structure 27 is provided (FIGS. 4, 20 and 29), but the cartridge 20, 20*a*, 20*b* is not limited thereto. A specific example of such a case is described below as a modification example of the cartridge 20 according to the first embodiment. This modification example can also be applied to the cartridges 20*a* and 20*b* according to the second and third embodiments, respectively.

Figure 36:
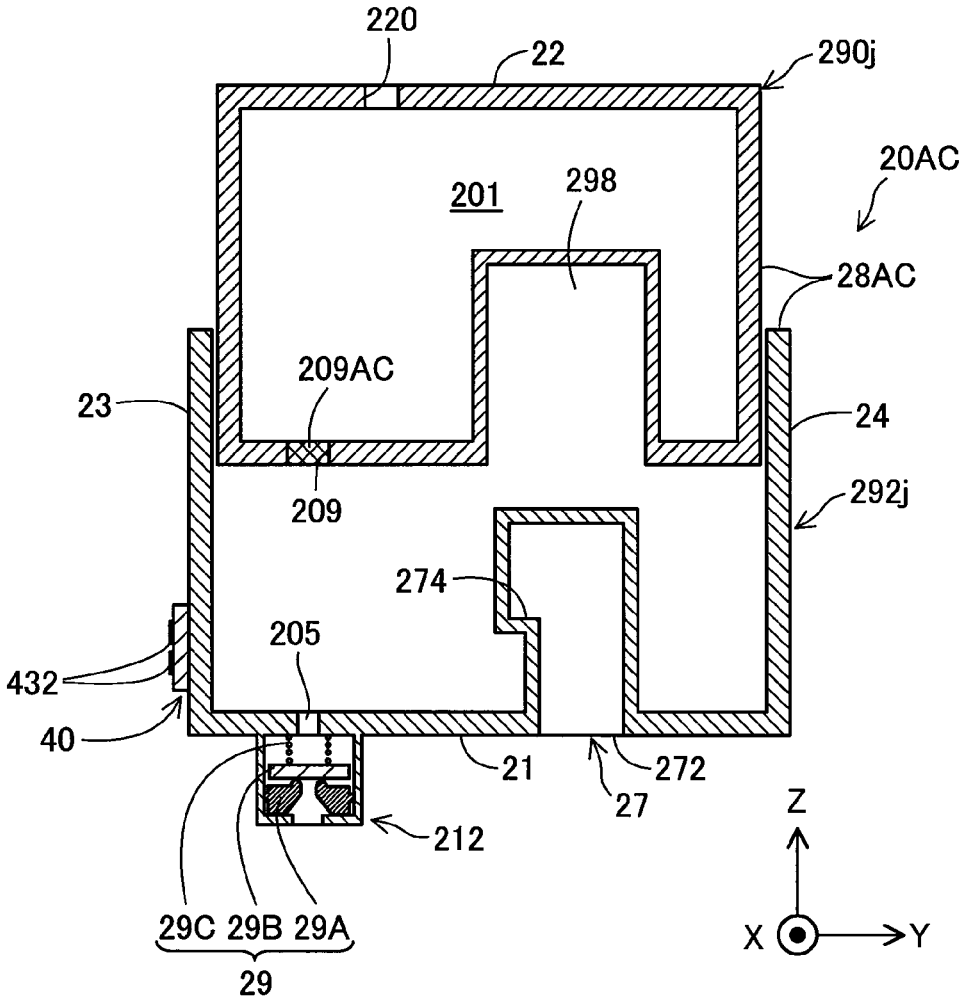
FIG. 36 is a diagram for illustrating a cartridge according to a third modification example.

FIG. 36 is a diagram for illustrating a cartridge 20AC according to a third modification example. The cartridge 20AC is a cartridge that employs an adaptor 292*j*. The cartridge 20AC can be disassembled into a storage member 290*j* that includes the liquid storage portion 210 and the adaptor 292*j*. When ink inside the storage member 290*j* has run out, the user either replaces the storage member 290*j* with a new storage member 290*j* or refills the ink in the storage member 290*j*. The adaptor 292*j* can be reused. The cartridge 20AC is compatible with the cartridge 20 according to the first embodiment.

An outer shell 28AC of the cartridge 20AC is formed of a combination of an outer shell of the storage member 290*j* and an outer shell of the adaptor 292*j*. The storage member 290*j* forms the second wall portion 22 of the outer shell 28AC of the cartridge 20AC. The storage member 290*j* includes the liquid storage portion 210 that stores the ink and a distribution unit 209 used for distributing the ink through the liquid supply portion 212. A liquid holding member 209AC (for example, a porous member) used to hold the ink is provided in the distribution unit 209, which is an opening. The liquid holding member 209AC makes contact with the communication hole 205.

The adaptor 292*j* forms the first wall portion 21, the third wall portion 23, the fourth wall portion 24, the fifth wall portion (not shown) and the sixth wall portion (not shown) of the outer shell 28AC of the cartridge 20AC. The adaptor 292*j* is provided with members that correspond to each of members of the holder unit 61, such as the liquid supply portion 212, the circuit substrate 40 and the first opening 272. The engaged portion 274 is arranged further inward than the outer surface of the outer shell 28AC.

Figure 37:
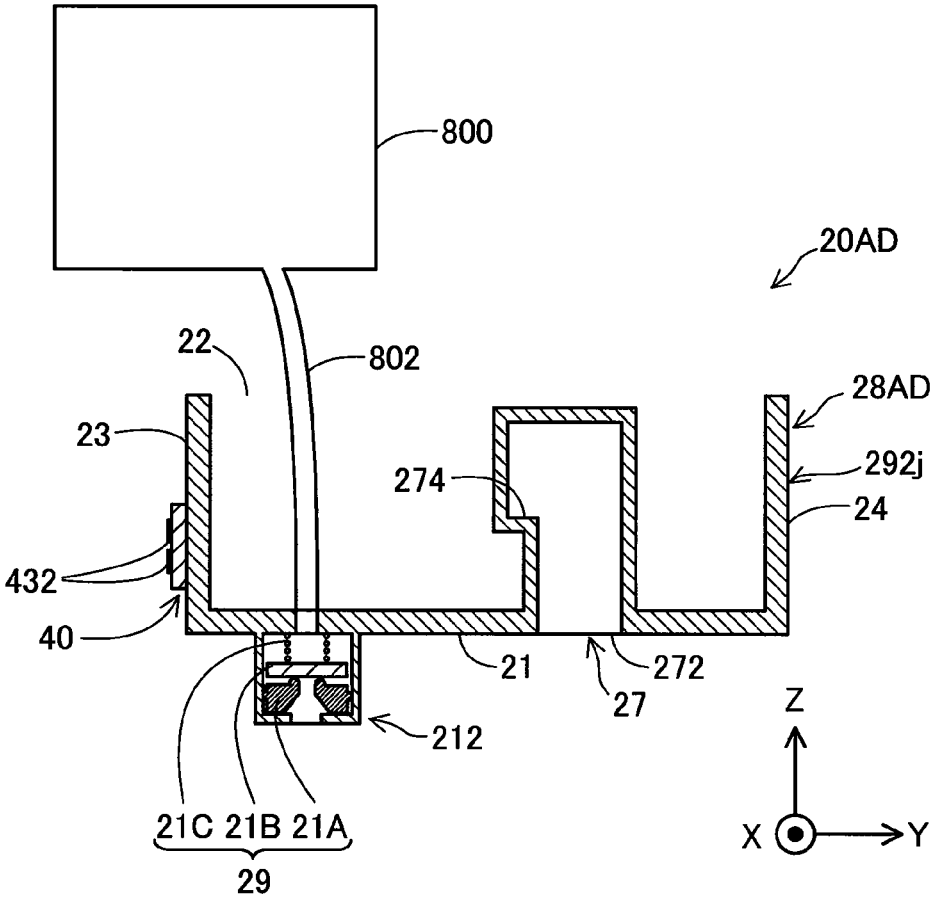
FIG. 37 is a diagram for explaining a cartridge according to a fourth modification example.

D-4. Fourth Modification Example:

FIG. 37 is a diagram for explaining a cartridge 20AC according to a fourth modification example. The cartridge 20AC is another example of the cartridge that employs the adaptor 292*j*. The cartridge 20AC includes the adaptor 292*j*, an external tank 800 for storing the ink, and a tube 802 that connects the external tank 800 and the liquid supply portion 212 to each other. The external tank 800 is, for example, arranged outside of the printer 10. The outer shell 28AD is formed by the adaptor 292*j*. The second wall portion 22 of the outer shell 28AD is open. The cartridge 20AD is compatible with the cartridge 20 according to the first embodiment. This modification example can also be applied to the cartridges 20*a* and 20*b* according to the second and third embodiments, respectively. The engaged portion 274 is arranged further inward than the outer surface of the outer shell 28AD.

D-5. Fifth Modification Example:

The present invention is not limited to an inkjet printer and a liquid supply unit for supplying ink to an inkjet printer, and can also be applied to any type of liquid ejection apparatus that ejects a liquid other than ink, and a liquid supply unit (cartridge) for storing such a liquid. For example, the present invention can be applied to the following types of liquid ejection apparatus and liquid supply units therefor.

(1) image recording device, such as a facsimile machine;

(2) color material ejection device used to manufacture color filters for an image display device, e.g., a liquid crystal display;

(3) electrode material ejection device used to form electrodes of, for example, an organic EL (electroluminescence) display and a field emission display (FED);

(4) fluid consuming device configured to eject a bioorganic material-containing fluid used for manufacturing biochips;

(5) sample ejection device used as a precision pipette;

(6) ejection device of lubricating oil;

(7) ejection device of a resin solution;

(8) fluid consuming device for pinpoint ejection of lubricating oil on precision machines such as watches or cameras;

(9) fluid consuming device configured to eject a transparent resin solution, such as an ultraviolet curable resin solution, onto a substrate in order to manufacture a hemispherical microlens (optical lens) used for, for example, optical communication elements;

(10) fluid consuming device configured to eject an acidic or alkaline etching solution in order to etch a substrate or the like; and

(11) fluid consuming device equipped with a fluid ejection head for ejecting a very small volume of droplets of any other fluid.

The "droplet" herein means the state of fluid ejected from the fluid consuming device and may be in a granular shape, a teardrop shape or a tapered threadlike shape. The "fluid" herein may be any material ejectable by the fluid consuming device. The "fluid" may be any material in the liquid phase. For example, liquid-state materials of high viscosity or low viscosity, sols, aqueous gels and other liquid-state materials having inorganic solvents, organic solvents, solutions, liquid resins and liquid metals (metal melts) are included in the "fluid". The "fluid" is not limited to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiment and liquid crystal. The ink herein includes general water-based inks and oil-based inks, as well as various fluid compositions, such as gel inks and hot-melt inks.

D-6. Sixth Modification Example:

The present invention can also be implemented as the following modified aspects.

[Modified Aspect 1]

A liquid supply unit that includes an apparatus-side engagement structure including an apparatus-side engagement portion and is mountable onto a liquid ejection apparatus, the liquid supply unit comprising:

a first wall portion;

a second wall portion that opposes the first wall portion;

a third wall portion that intersects with the first wall portion and the second wall portion;

a fourth wall portion that intersects with the first wall portion and the second wall portion and that opposes the third wall portion;

a fifth wall portion that intersects with the first wall portion, the second wall portion, the third wall portion and the fourth wall portion;

a sixth wall portion that intersects with the first wall portion, the second wall portion, the third wall portion and the fourth wall portion and that opposes the fifth wall portion;

a liquid supply portion that is arranged on the first wall portion and that can supply a liquid to the liquid ejection apparatus;

an opening that is formed in the first wall portion and used for accepting insertion of the apparatus-side engagement structure of the liquid ejection apparatus; and an engaged portion that is arranged between the third wall portion and the fourth wall portion and that can engage with the engagement portion of the liquid ejection apparatus.

According to this modified aspect, because the engaged portion is arranged between the third wall portion and the fourth wall portion, the liquid supply unit can be made smaller in a direction along a direction extending from the third wall portion to the fourth wall portion, compared to a case in which the engaged portion is arranged further outward than the third wall portion or the fourth wall portion.

[Modified Aspect 2]

The liquid supply unit according to modified aspect 1, in which a distance between the third wall portion and the fourth wall portion is longer than a distance between the fifth wall portion and the sixth wall portion.

[Modified Aspect 3]

The liquid supply unit according to modified aspect 1 or 2, in which the opening opens to at least the first wall portion and the fifth wall portion.

[Modified Aspect 4]

The liquid supply unit according to the modified aspect 3, in which the opening further opens to the sixth wall portion.

[Modified Aspect 5]

The liquid supply unit according to any one of the modified aspects 1 to 4, further including a unit-side operation unit that is operated in order to release engagement between the engaged portion and the engagement portion.

[Modified Aspect 6]

The liquid supply unit according to modified aspect 5, in which, in a process of mounting the liquid supply unit onto the liquid ejection apparatus, the engaged portion is configured to move by coming into contact with the engagement structure.

[Modified Aspect 7]

The liquid supply unit according to modified aspect 5 or 6, in which the engaged portion is formed of a protrusion that can engage with the engagement portion which is a concave portion or an opening.

[Modified Aspect 8]

The liquid supply unit according to modified aspect 5 or 6, in which the engaged portion is formed of a concave portion or an opening that can engage with the engaged portion which is a protrusion.

[Modified Aspect 9]

The liquid supply unit according to any one of the modified aspects 5 to 8, in which the liquid ejection apparatus includes a holder unit that is provided with the engagement structure and onto which the liquid supply unit can be mounted, the unit-side operation unit protrudes outward from the third wall portion and is located closer to the second wall portion than the first wall portion, and the unit-side operation unit is arranged at a position exposed from the holder unit in the mounted state in which the liquid supply unit is mounted onto the liquid ejection apparatus.

[Modified Aspect 10]

The liquid supply unit according to any one of the modified aspects 5 to 8, in which the third wall portion can move by the unit-side operation unit being operated, and the engaged portion is connected to a moveable part of the outer shell such that the engaged portion moves in conjunction with the motion of the moveable part of an outer shell.

[Modified Aspect 11]

The liquid supply unit according to any one of the modified aspects 5 to 8, in which the unit-side operation unit protrudes outward from the second wall portion.

[Modified Aspect 12]

The liquid supply unit according to any one of the modified aspects 1 to 3, in which the engagement structure further includes an apparatus-side operation unit that can move the engagement portion through being operated, and engagement between the engaged portion and the engagement portion is released by the engagement portion moving.

[Modified Aspect 13]

The liquid supply unit according to any one of the modified aspects 1 to 12, further including a contact portion that is arranged on the fifth wall portion and is electronically connected to an electrode portion that includes the liquid ejection apparatus by making contact with the electrode portion, in which, when the liquid supply unit is viewed in plan in a direction from the first wall portion to the second wall portion, the liquid supply portion is located closer to the third wall portion than the fourth wall portion, and the opening is located between the liquid supply portion and the contact portion.

The invention is not limited to any of the embodiment, the examples and the modifications described herein but may be implemented by a diversity of other configurations without departing from the scope of the invention. For example, the technical features of the embodiment, examples and modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

REFERENCE SYMBOLS LIST

10,10*a* . . . printer, 12 . . . platen, 13 . . . carriage motor, 14 . . . drive belt, 18 . . . transfer motor, 20, 20A to 20J, 20AA, 20AB, 20AC, 20AD, 20*a* to 20*c*, 20*a*A, 20*b*A . . . cartridge, 21, 21*a*, 21*b*, 21*b*A . . . first wall portion (tip edge portion), 22, 22*a*, 22*b*, 22H . . . second wall portion (rear edge portion), 23, 23G, 23H, 23*a*, 23*b* . . . third wall portion, 24 . . . fourth wall portion, 24F, 24*b*, 24*b*A, 24*s* . . . one end, 24*t* . . . other end, 25, 25*a*, 25*b* . . . fifth wall portion, 26, 26*a*, 26*b* . . . sixth wall portion, 27, 27AA, 27DD, 27D, 27F, 27G, 27H, 27*a*, 27*b*, 27*b*A . . . engaged structure, 28, 28AB, 28AC, 28AD, 28F, 28G, 28H, 28*a*, 28*b*, 29*b*A . . . outer shell, 29 . . . valve mechanism, 29A . . . sealing portion, 29B . . . valve body, 29C . . . biasing member, 37 . . . flexible cable, 38 . . . control unit, 39 . . . tube, 40 . . . circuit substrate, 40*fa* . . . front surface, 50 . . . head unit, 57 . . . liquid supply portion, 60, 60E, 60*b* . . . carriage unit, 61, 61B, 61*a*, 61*b* . . . holder unit, 62, 62E, 62*a*, 62*b* . . . device front wall portion, 64, 64*a*, 64*b* . . . first side wall portion, 65, 65*a*, 65*b* . . . second side wall portion, 66, 66*a*, 66*b* . . . third side wall portion, 67, 67*a*, 67*b* . . . fourth wall portion, 69, 69*b* . . . cartridge storage chamber, 69A to 69F . . . slot, 70, 70A to 70G, 70*b* . . . engagement structure, 79, 79*b* . . . unit-side operation member, 79F, 79*bs* . . . unit-side operation unit, 79*bt* . . . engagement releasing portion, 80, 80H, 80I, 80*a*, 80*a*A . . . engaged portion member, 83 . . . first member, 83H . . . first member, 83Hs . . . unit-side operation unit, 83Ht . . . other end corner portion, 83*s* . . . unit-side operation unit, 83*t* . . . other end, 84, 84H . . . second member, 86, 86H . . . third member, 89, 89I . . . biasing member, 120 . . . engagement structure, 122 . . . main body portion, 122*s* . . . one end, 122*t* . . . other end, 124 . . . engagement portion, 201, 201*a* . . . liquid storage portion, 205 . . . communication hole, 208 . . . connecting wall portion, 209 . . . distribution portion, 209AC . . . liquid holding member, 210 . . . liquid storage portion, 212, 212*a*, 212*b* . . . liquid supply portion, 215 . . . first bottom wall portion, 216 . . . inclined wall portion, 217 . . . second bottom wall portion, 219 . . . supply unit arrangement port, 220 . . . air induction port, 222 . . . second engaged structure, 232 . . . through hole, 238 . . . internal space, 242*b* . . . through hole, 271, 271*b* . . . inner wall portion, 272, 272*a* . . . first opening, 272AB . . . second opening, 272AC . . . third opening, 274, 274F, 274G, 274H, 274J, 274*a*, 274*a*A, 274*b* . . . engaged portion, 275, 275G, 275H, 275*b* . . . receiving portion, 275A . . . first receiving portion, 275AC . . . third opening, 275B . . . second receiving portion, 276 . . . opening, 277 . . . wall portion, 278, 278*b* . . . wall portion, 280 . . . bottom surface, 284 . . . foam resin, 290*j* . . . storage member, 292*j* . . . adaptor, 310, 310*a* . . . unit-side operation structure, 314, 314*a*, 314*a*A . . . unit-side operation member, 314*s* . . . unit-side operation unit, 314*t*, 314*ta* . . . engagement releasing member, 316 . . . biasing member, 318 . . . inner wall, 432 . . . contact portion (unit-side terminal), 62E1 . . . fixed wall portion, 62E2 . . . moving wall portion, 622 . . . liquid injecting needle, 622*b* . . . liquid introduction pipe, 622*s* . . . base portion, 622*t* . . . tip portion, 629 . . . elastic member, 640, 642*a* . . . second engagement structure, 644, 644*b* . . . electrode portion, 645, 645*b* . . . holder-side terminal, 690 . . . terminal holding member, 691 . . . inclined surface, 772, 772B, 772G, 772*b* . . . main body portion, 772*s* . . . one end, 772*t* . . . other end, 774 . . . engagement forming surface, 774G . . . engagement portion, 774*b* . . . engagement forming surface, 775, 775*b* . . . guideway, 776 . . . engagement portion, 776D . . . engagement portion, 776F . . . engagement portion, 776*b* . . . engagement portion, 778 . . . cross zone, 780 . . . rail, 790 . . . positioning portion, 798 . . . unit-side operation unit, 799 . . . engagement releasing portion, 800 . . . external tank, 802 . . . tube, 866, 866H, 866*a*, 866*a*A . . . engagement forming portion, 1000, 1000*a*, 1000*b* . . . liquid ejection system, 62E2 . . . moving wall portion, CPa, CPb . . . central portion, CT, CTb . . . central axis, FG, FH . . . biasing force, P . . . printing medium, Ps, Psa, Pst, Pt, Pta, Ptb . . . external force, RA . . . one side, RB . . . other side, RtF . . . fulcrum, Ve, Ve1, Ve2, V21 . . . normal vector, st . . . position of engagement.

What is claimed is:

1. A liquid ejection system comprising:

a liquid ejection apparatus comprising:

a first apparatus-side engagement structure including a first apparatus-side engagement portion; and a second apparatus-side engagement structure including a second apparatus-side engagement portion, the first apparatus-side engagement structure and the second apparatus-side engagement structure each being formed by a polygonal protrusion; and an ink cartridge that is configured to be mounted into the liquid ejection apparatus, the ink cartridge comprising:

an outer shell;

a liquid supply port;

a first cartridge-side engagement structure including first cartridge-side receiving portions and a first cartridge-side engagement portion disposed between the first cartridge-side receiving portions, the first cartridge-side engagement portion being a first step that is configured to engage with the first apparatus-side engagement portion; and a second cartridge-side engagement structure including second cartridge-side receiving portions and a second cartridge-side engagement portion disposed between the second cartridge-side receiving portions, the second cartridge-side engagement portion being a second step that is configured to engage with the second apparatus-side engagement portion, wherein:

the shape of the first cartridge-side engagement structure is the same as the shape of the second cartridge-side engagement structure;

the first cartridge-side engagement portion and the second cartridge-side engagement portion sandwich the liquid supply port;

a movement of the ink cartridge in a demounting direction opposite to a mounting direction is restricted by engaging the polygonal protrusion of the first apparatus-side engagement portion with the first step included in the first cartridge-side engagement structure, and by engaging the polygonal protrusion of the second apparatus-side engagement portion with second step included in the second cartridge-side engagement structure; and the first cartridge-side engagement portion is located higher than the liquid supply port in the demounting direction and the second cartridge-side engagement portion is located higher than the liquid supply port in the demounting direction.

2. The liquid ejection system according to claim 1, wherein:

the first apparatus-side engagement portion and the second apparatus-side engagement portion further include an apparatus-side engagement surface facing the mounting direction, respectively;

the first cartridge-side engagement portion and the second cartridge-side engagement portion further include a cartridge-side engagement surface facing the demounting direction, respectively; and the first cartridge-side engagement portion is configured to engage with the first apparatus-side engagement portion and the second cartridge-side engagement portion is configured to engage with the second apparatus-side engagement portion by contacting between each of the cartridge-side engagement surface of the first cartridge-side engagement portion and the second cartridge-side engagement portion and contacting between each of the apparatus-side engagement surface of the first cartridge-side engagement portion and the second cartridge-side engagement portion.

3. The liquid ejection system according to claim 1, wherein:

the first cartridge-side engagement structure and the second cartridge-side engagement structure further include a cartridge-side guiding surface that is formed along the mounting direction, respectively; and the first apparatus-side engagement structure and the second apparatus-side engagement structure further include an apparatus-side guiding surface that is configured to contact with each of the cartridge-side guiding surface of the first cartridge-side engagement structure and the second cartridge-side engagement structure in a process of mounting the ink cartridge into the liquid ejection apparatus, respectively.

4. The liquid ejection system according to claim 1, wherein:

the liquid ejection apparatus further comprises an apparatus-side operation unit that is configured to move the first apparatus-side engagement portion and the second apparatus-side engagement portion; and the first cartridge-side engagement portion and the second cartridge-side engagement portion are released from an engagement with the first apparatus-side engagement portion and the second apparatus-side engagement portion as a result of the apparatus-side operation unit operated.

5. The liquid ejection system according to claim 1, wherein the first cartridge-side engagement structure and the second cartridge-side engagement structure are polygonal.

6. The liquid ejection system according to claim 1, wherein the first cartridge-side engagement portion and the second cartridge-side engagement portion are arranged further inward than an outer surface of the outer shell.

7. An ink cartridge that is configured to be mounted into a liquid ejection apparatus that comprises a first apparatus-side engagement structure including a first apparatus-side engagement portion and a second apparatus-side engagement structure including a second apparatus-side engagement portion, the ink cartridge comprising:

an outer shell;

a liquid supply port;

a first cartridge-side engagement structure including first cartridge-side receiving portions and a first cartridge-side engagement portion disposed between the first cartridge-side receiving portions, the first cartridge-side engagement portion being a first step that is configured to engage with the first apparatus-side engagement portion; and a second cartridge-side engagement structure including second cartridge-side receiving portions and a second cartridge-side engagement portion disposed between the second cartridge-side receiving portions, the second cartridge-side engagement portion being a second step that is configured to engage with the second apparatus-side engagement portion, the first apparatus-side engagement structure and the second apparatus-side engagement structure each being formed by a polygonal protrusion, wherein:

the shape of the first cartridge-side engagement structure is the same as the shape of the second cartridge-side engagement structure;

the first cartridge-side engagement portion and the second cartridge-side engagement portion sandwich the liquid supply port;

a movement in a demounting direction opposite to a mounting direction is restricted by the polygonal protrusion of the first apparatus-side engagement portion with the first step included in the first cartridge-side engagement structure, and by engaging the polygonal protrusion of the second apparatus-side engagement portion with second step included in the second cartridge-side engagement structure; and the first cartridge-side engagement portion is located higher than the liquid supply port in the demounting direction and the second cartridge-side engagement portion is located higher than the liquid supply port in the demounting direction.

8. The ink cartridge according to claim 7, wherein:

the first cartridge-side engagement portion and the second cartridge-side engagement portion further include a cartridge-side engagement surface facing the demounting direction, respectively; and the first cartridge-side engagement portion is configured to engage with the first apparatus-side engagement portion and the second cartridge-side engagement portion is configured to engage with the second apparatus-side engagement portion by contacting between each of the cartridge-side engagement surface of the first cartridge-side engagement portion and the second cartridge-side engagement portion and contacting between each of an apparatus-side engagement surface of the first cartridge-side engagement portion and the second cartridge-side engagement portion, the apparatus-side engagement surface is provided with the first apparatus-side engagement portion and the second apparatus-side engagement portion, respectively and facing the mounting direction.

9. The ink cartridge according to claim 7, wherein:

the first cartridge-side engagement structure and the second cartridge-side engagement structure further include a cartridge-side guiding surface that is formed along the mounting direction, respectively; and each of the cartridge-side guiding surface of the first cartridge-side engagement structure and the second cartridge-side engagement structure is configured to contact an apparatus-side guiding surface in a process of mounting into the liquid ejection apparatus, the apparatus-side guiding surface is provided with the first apparatus-side engagement structure and the second apparatus-side engagement structure respectively.

10. The ink cartridge according to claim 7, wherein:

the liquid ejection apparatus further comprises an apparatus-side operation unit which is configured to move the first apparatus-side engagement portion and the second apparatus-side engagement portion; and the first cartridge-side engagement portion and the second cartridge-side engagement portion are released from an engagement with the first apparatus-side engagement portion and the second apparatus-side engagement portion as a result of the apparatus-side operation unit operated.

11. The ink cartridge according to claim 7, wherein the first cartridge-side engagement structure and the second cartridge-side engagement structure are polygonal.

12. The ink cartridge according to claim 7, wherein the first cartridge-side engagement portion and the second cartridge-side engagement portion are arranged further inward than an outer surface of the outer shell.

* * * * *